United States Patent [19]

Masubuchi et al.

[11] Patent Number: 4,914,999

[45] Date of Patent: Apr. 10, 1990

[54] KEYBOARD ASSEMBLY FOR FORMING KEYBOARD APPARATUS OF ELECTRONIC MUSICAL INSTRUMENT

[75] Inventors: Takamichi Masubuchi; Jun-ichi Mishima, both of Shizuoka, Japan

[73] Assignee: Yamaha Corporation, Hamamatsu, Japan

[21] Appl. No.: 239,798

[22] Filed: Sep. 2, 1988

[30] Foreign Application Priority Data

| | | | |
|---|---|---|---|
| Sep. 4, 1987 | [JP] | Japan | 62-222752 |
| Sep. 21, 1987 | [JP] | Japan | 62-237857 |
| Oct. 1, 1987 | [JP] | Japan | 62-151295[U] |
| Oct. 1, 1987 | [JP] | Japan | 62-249500 |
| Oct. 1, 1987 | [JP] | Japan | 62-249501 |
| Nov. 30, 1987 | [JP] | Japan | 62-303889 |
| Dec. 25, 1987 | [JP] | Japan | 62-332958 |
| Dec. 25, 1987 | [JP] | Japan | 62-332960 |

[51] Int. Cl.[4] ..... G10C 3/12; G10H 1/34

[52] U.S. Cl. ..... 84/423 R; 84/DIG. 7; 200/5 A

[58] Field of Search ..... 84/1.01, 1.09, 1.1, 84/1.24–1.27, 423 R, 433, DIG. 7; 200/5 R, 5 A; 340/365 R, 365 S; 341/20, 22, 26

[56] References Cited

U.S. PATENT DOCUMENTS

| | | | |
|---|---|---|---|
| 1,853,630 | 4/1932 | Martenot | 84/1.25 |
| 3,570,359 | 3/1971 | Ohno | 84/423 R |
| 4,186,638 | 2/1980 | Iijima . | |
| 4,272,657 | 6/1981 | Iijima . | |

FOREIGN PATENT DOCUMENTS

| | | | |
|---|---|---|---|
| 963637 | 7/1950 | France | 84/1.25 |
| 57-3080 | 1/1982 | Japan . | |
| 59-60694 | 4/1984 | Japan . | |

*Primary Examiner*—Stanley J. Witkowski

*Attorney, Agent, or Firm*—Burns, Doane, Swecker & Mathis

[57] ABSTRACT

A keyboard assembly for forming a keyboard apparatus of an electronic musical instrument, including a combination of at least two key units each having a plurality of key members and an elongated bracket portion connecting the key members together, a frame structure to which the key units are assembled together in such a manner that each of the individual key members of the key units is allowed to rock independently of each other about an axis fixed with respect to the frame structure and parallel with the bracket portion of each key unit, and plural combinations of a concavity formed in the bracket portion of one of the key units and a projection formed in the bracket portion of the other of the key units and received in the concavity for establishing a first predetermined positional relationship between each of the key units before the key units are assembled to the frame structure.

53 Claims, 30 Drawing Sheets

KEYBOARD ASSEMBLY FOR FORMING KEYBOARD APPARATUS OF ELECTRONIC MUSICAL INSTRUMENT

FIELD OF THE INVENTION

The present invention relates to electronic musical instruments and, more particularly, to an keyboard assembly of an electronic musical instrument.

SUMMARY OF THE INVENTION

A keyboard assembly for an electronic musical instrument is known in which at least two key units each having a plurality of key members are assembled to a frame structure. The present invention contemplates improvement of a keyboard assembly of this type in an attempt to (1) enable the key units to be correctly positioned with respect to each other and further to the frame structure before the key units are to be securely fastened to the frame structure, (2) allow each of the key members to torsionally deform with respect to the frame structure so that each key member can be adjusted in proper position with respect to the frame structure after the key unit has been secured to the frame structure, (3) make it easier than in a known keyboard assembly to have each of the key members fitted to the frame structure after the key member has been correctly positioned with respect to the frame structure during assembling of the keyboard assembly, (4) limit the downward and upward strokes of the key member with respect to the frame structure during use of the keyboard assembly, and (5) provide a pad member switch device which features a reduced on-state resistance.

Thus, in accordance with one outstanding aspect of the present invention, there is provided a keyboard assembly for an electronic musical instrument, comprising (a) at least one combination of at least two key units consisting of first and second key units each comprising a plurality of key members and an elongated bracket portion interconnecting the key members of each key unit together, (b) a frame structure to which the key units are assembled together, (c) assembling means for disengageably fastening the key units to the frame structure while allowing each of the individual key members of the key units to rock independently of each other about an axis substantially fixed with respect to the frame structure and substantially parallel with the bracket portion, and (d) position restricting means establishing a predetermined positional relationship between the first and second key units for enabling the first and second key units to be positioned in the predetermined relationship with respect to each other before the key units are assembled to the frame structure.

In accordance with another outstanding aspect of the present invention, there is provided a keyboard assembly for an electronic musical instrument, comprising (a) at least two combinations each of at least two key units each comprising a plurality of key members and an elongated bracket portion interconnecting the key members of each key unit together, (b) a frame structure to which the key units are assembled together, (c) assembling means for disengageably fastening the key units to the frame structure while allowing each of the individual key members of the key units to rock independently of each other about an axis substantially fixed with respect to the frame structure and substantially parallel with the bracket portion, and (d) position restricting means establishing a predetermined positional relationship between each of the key units of one of the combinations and each of the key units of the other of the combinations for enabling the two combinations of key units to be positioned in the predetermined relationship with respect to each other before the key units are assembled to the frame structure.

In accordance with still another outstanding aspect of the present invention, there is provided a keyboard assembly for an electronic musical instrument, comprising (a) a key unit having a plurality of key members and a bracket portion interconnecting the key members together and elongated in parallel with a direction in which the key members of the key units are arranged in a row, (b) a frame structure to which the bracket portion of the key unit is fastened while allowing each of the individual key members of the key unit to rock independently of each other about an axis substantially fixed with respect to the frame structure and substantially parallel with the bracket portion, (c) each of the key members having an elongated key body portion and a torsional coupling portion enabling the key member to elastically deform with respect to the frame structure torsionally about an axis in a direction in which the key body portion of the key member longitudinally extends.

In accordance with still another outstanding aspect of the present invention, there is provided a keyboard assembly for an electronic musical instrument, comprising (a) a key unit having a plurality of key members and a bracket portion interconnecting the key members together and elongated in parallel with a direction in which the key members of the key units are arranged in a row, (b) a frame structure to which the bracket portion of the key unit is fastened while allowing each of the individual key members of the key unit to rock independently of each other about an axis substantially fixed with respect to the frame structure and substantially parallel with the bracket portion, (c) first stroke limiting means for limiting the distance of rocking movement of the key member in one direction with respect to the frame structure, and (d) second stroke limiting means for limiting the distance of rocking movement of the key member in the opposite direction with respect to the frame structure.

In accordance with still another outstanding aspect of the present invention, there is provided a keyboard assembly for an electronic musical instrument, comprising (a) a key unit having a plurality of key members and a bracket portion interconnecting the key members together and elongated in parallel with a direction in which the key members of the key units are arranged in a row, (b) a frame structure to which the bracket portion of the key unit is fastened while allowing each of the individual key members of the key unit to rock independently of each other about an axis substantially fixed with respect to the frame structure and substantially parallel with the bracket portion, (c) fastening means for fastening the key unit to the frame structure, the fastening means comprising an opening provided in the frame structure, a stem portion projecting from the bracket portion of the key unit and smaller in cross section than the opening and a hook portion merging out of the stem portion and larger in cross section than the opening, the hook portion being located out of the opening with the stem portion passed through the opening for securing the key member to the frame structure, the opening in the frame structure being forced to expand to allow passage of the hook portion therethrough when the hook portion is moved into the opening with the key member disengaged from the frame structure and the bracket portion moved into contact with the frame structure.

In accordance with still another outstanding aspect of the present invention, there is provided a keyboard assembly for an electronic musical instrument, comprising (a) a key unit having a plurality of key members and a bracket portion interconnecting the key members together, (b) a frame structure to which the bracket portion of the key unit is fastened while allowing each of the individual key members of the key unit to rock independently of each other about an axis substantially fixed with respect to the frame structure and substantially parallel with the bracket portion, (c) an electric circuit carrying member, (c) a plurality of switch devices arranged respectively in conjunction with the key members, the switch devices being cooperative with the circuit carrying member and comprising a unitary resilient member common to the individual switch devices, (d) stroke limiting means for limiting the distance of rocking movement of the key member in one direction with respect to the frame structure, the stroke limiting means comprising an opening provided in the circuit carrying member, a hook portion forming part of each of the key members and movable with respect to the frame structure and a portion forming part of the resilient member and projecting through the opening in the resilient member in one direction with respect to the frame structure, the portion of the resilient member being engageable with the hook portion, the hook portion being engageable with the portion of the resilient member for limiting the distance of rocking movement of the key member in the other direction with respect to the frame structure.

In accordance with still another outstanding aspect of the present invention, there is provided a combination of an electric switch device and an electric circuit carrying member, (a) the electric circuit carrying member comprising a substrate having formed thereon circuit elements including a pair of conductor strips having respective regions spaced apart from each other, a film of insulator formed on the substrate and having openings through each of which each of the regions of the conductor strips is in part exposed, and a pair of stationary contact elements each comprising a conductive layer formed partially on the exposed portion of each of the conductor strips and partially on the portion of the insulator film overlying the region of the conductor strip, and (b) the switch device comprising a resilient insulator pad member attached to the insulator film and having a contact carrying portion carrying a movable contact element located in alignment with the pair of stationary contact elements, the contact carrying portion of the resilient insulator pad member being resiliently movable into and out of a position having the movable contact element in contact with the pair of stationary contact elements.

BRIEF DESCRIPTION OF THE DRAWINGS

The drawbacks of a prior-art keyboard assembly of an electronic musical instrument and the features and advantages of a keyboard assembly according to the present invention will be more clearly understood from the following description taken in conjunction with the accompanying drawings in which like reference numerals designate similar or corresponding structures, assemblies, units, members and portions and in which.

DESCRIPTION OF THE PRIOR ART

Figure 1A:
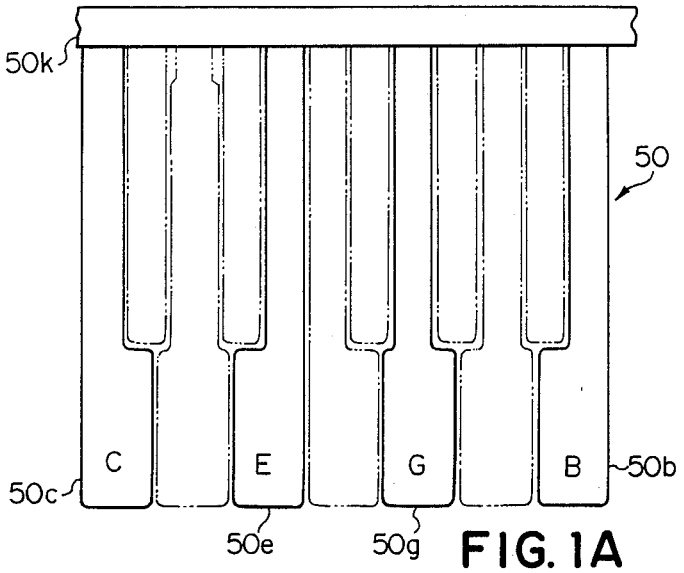
FIG. 1A PRIOR ART
FIGS. 1A, 1B and 1C are plan views showing portions of a known keyboard assembly of an electronic musical instrument.
Figure 1B:
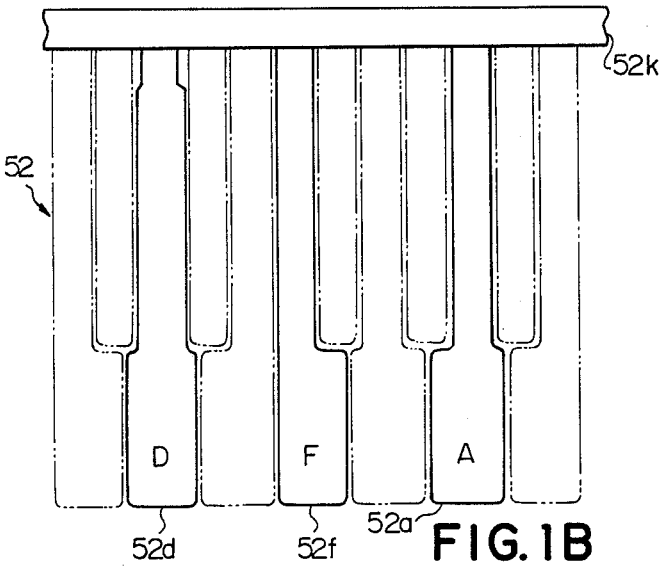
FIG. 1B PRIOR ART
Figure 1C:
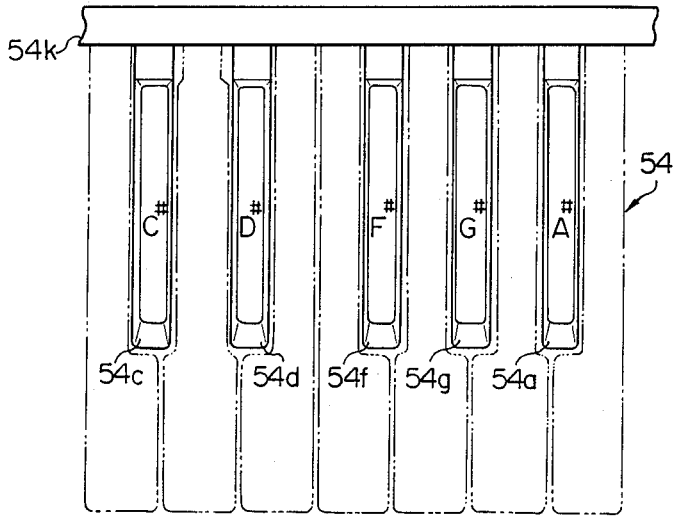
FIG. 1C PRIOR ART

In FIGS. 1A to 1C of the drawings are shown portions of a known keyboard assembly of an electronic musical instrument. The keyboard assembly herein shown is disclosed in, for example, Japanese Patent Publication No. 57-03080 and includes first and second white key units 50 and 52 indicated by full lines in FIGS. 1A and 1B, respectively, and a black key unit 54 indicated by full lines in FIG. 1C. These white key units 50 and 52 and black key unit 54 form in combination a set of keys allocated to an octave of different tones. The first white key unit 50 has four white key members 50*c*, 50*e*, 50*g* and 50*b* respectively allocated to the notes C, E, G and B, and the second key unit 52 has three white key members 52*d*, 52*f* and 52*a* respectively allocated to the notes D, F and A. The black key unit 54 has five black key members 54*c*, 54*d*, 54*f*, 54*g* and 54*a* respectively allocated to C-sharp (or D-flat), D-sharp (or E-flat), F-sharp (or G-flat), G-sharp (or A-flat) and A-sharp (or B-flat) notes. The key units 50, 52 and 54 thus providing the total of twelve key members form part of a row of key members respectively allocated to two or more octaves of tones.

Each of the white key units 50 and 52 and black key unit 54 is provided in the form of a single piece of unitary structure of a synthetic resin and further has an elongated lateral bracket portion through which the individual key members of the unit are united together. Thus, the first white key unit 50 has a lateral bracket portion 50*k* uniting the individual key members 50*c*, 50*e*, 50*g* and 50*b* of the unit 50 together as shown in FIG. 1A and, likewise, the second white key unit 52 has a lateral bracket portion 50*k* uniting the individual key members 52*d*, 52*f* and 52*a* of the unit 52 together as shown in FIG. 1B. The key members 54*c*, 54*d*, 54*f*, 54*g* and 54*a* of the black key unit 54 are also united together by means of an elongated lateral bracket portion 54*k* as shown in FIG. 1C. The respective bracket members 50*k*, 52*k* and 54*k* of the key units 50, 52 and 54 are placed on one another and are jointly fastened to the frame structure (not shown) of the keyboard assembly by means typically of screws or studs.

Figure 2:
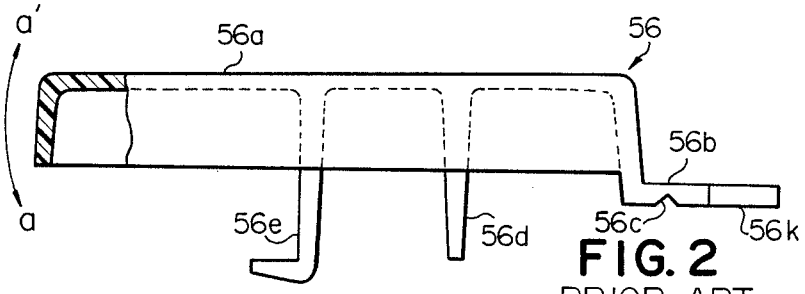
FIG. 2 PRIOR ART
FIG. 2 is a side elevation view showing partially in section one of the key members included in the keyboard assembly illustrated in FIGS. 1A and 1B.

As will be better seen from FIG. 2, each of the key members, herein represented by a key member 56, of each of the key units 50, 52 and 54 has a key body portion 56*a* to receive a player's finger touch and a torsional coupling portion 56*b* which intervenes between the key body portion 56*a* and the lateral bracket portion which is represented by a bracket portion 56*k*. In the torsional coupling portion 56*b* of the key member 56 is provided a groove 56*c* having a generally V-shaped cross section and extending laterally of the torsional coupling portion 56*b* so that the key body portion 56*a* is rockable about the groove 56*c* downwardly and upwardly as indicated by arrowheads a and a', respectively.

The key member 56 further has a switch actuator portion 56*d* extending downwardly from the key body portion 56*a* toward a switch element (not shown) located below the key member 56. When the key body portion 56*a* is driven to turn downwardly with a player's key touch received thereon, the switch actuator portion 56*d* is brought into pressing engagement with the switch element and closes a tone generator circuit section (not shown) associated with the particular key member 56. The downward and upward rocking motion of the key member 56 is limited by a stop portion 56*e* also extending downwardly from the key body portion 56*a*.

A prior-art keyboard assembly of the construction thus far described has various drawbacks. One of the drawbacks is the difficulty in assembling the individual key units 50, 52 and 54 to the frame structure of the keyboard assembly. Such a difficulty is experienced in positioning the key units 50, 52 and 54 correctly with respect to each other and further with respect to the neighboring set of key units allocated to another octave of tones. Skilled techniques are thus required for assembling the key units to the frame structure so that correct positional relationships are to be established between the individual key units of the keyboard assembly. Where the correct positional relationship fails to be established between any adjacent two of the key units of the keyboard assembly, the irregularity in the positions of, particularly, the white key members contiguous to each other throughout their lengths results in degraded external appearance of the keyboard assembly as a whole. The combinations of such adjacent key members include the combination of the key member 50*e* of the key unit 50 and the 52*f* of the key unit 52, the combination of the key member 50*c* of the key unit 50 and the note B key member of the lefthand set of key members, and the combination of the key member 50*b* of the key unit 50 and the note C key member of the righthand set of key members. In the absence of a black key member intervening between these paired key members, the irregularity in the positions of the key members is readily discernible as compared to the irregularity in the positions of other adjacent key members and is for this reason particularly objectionable from an aesthetic point of view. It may be noted that the positions of any adjacent two key members could not be adjusted in respect of the particular key members per se since the key members form only part of the key units each having other key members.

The present invention contemplates elimination of such a drawback so that the key units forming part of a keyboard assembly can be assembled to the frame structure of the keyboard assembly with correct positional relationships established between the individual key units of the keyboard assembly and accordingly between every adjacent two of the key members formed by the key units.

It is, therefore, an important object of the present invention to provide a keyboard assembly in which at least two key units each having a plurality of key members are assembled to a frame structure and are provided with means to enable the key units to be correctly positioned with respect to each other before the key units are to be securely fastened to the frame structure.

It is another important object of the present invention to provide a keyboard assembly in which at least one key unit having a plurality of key members assembled to a frame structure is provided with means associated with each of the key members to limit the downward and upward strokes of the key member with respect to the frame structure during use of the keyboard assembly.

Another drawback of a prior-art keyboard assembly of the construction hereinbefore described results from the errors which may occur in the geometries of the key units each of which is fabricated in the form of a molded plastic article. If any of the key members of the key units 50, 52 and 54 has an irregularity or inaccuracy in shape or measurement, the key member may happen to be forced against, for example, a guide member (not shown) forming part of the frame structure while the key member is moved by the player's key-in action. The key member thus caused to slide on the guide member produces a frictional force which will resist the movement of the key member and which may give rise to production of an unpleasant noise. It may be noted again that the positions of any adjacent two key members could not be adjusted in respect of the particular key members per se as above mentioned.

Accordingly, the present invention further contemplates provision of a keyboard assembly in which each of the key members forming part of a key unit is allowed to move or torsionally deform independently of the other key members so that, when a key member forced against any member with which the key member is engageable, the key member will not produce any frictional force and unpleasant noise if there is an error in the geometry of the key member.

DESCRIPTION OF THE PREFERRED EMBODIMENTS

Before entering into description of preferred embodiments of the present invention, it may be noted that a keyboard assembly according to the present invention has a first direction in which key members are arranged in row and a second direction in which each of the key members is elongated and which is thus perpendicular to the first direction. These first and second directions correspond to horizontal lateral and fore-and-aft directions, respectively, of an electronic musical instrument of the type to be operated by a player situated in front of the keyboard assembly of the instrument. A keyboard assembly according to the present invention further has a third direction which is perpendicular to these first and second directions and which thus corresponds to a vertical direction of the musical instrument of the type defined.

A preferred embodiment of a keyboard assembly according to the present invention will now be described with respect to FIGS. 3 to 10. The embodiment herein shown is characterized by key units which can be assembled to the frame structure of the keyboard assembly with correct positional relationships established between the individual key units and accordingly between every adjacent two of the key members formed by the key units. The preferred embodiment of the present invention is further characterized in that each of the key members forming part of a key unit is allowed to move or deform independently of the other key members so that, when a key member forced against any member with which the key member is engageable, the key member will not produce any frictional force and unpleasant noise if there is an error in the geometry of the key member.

Figure 3:
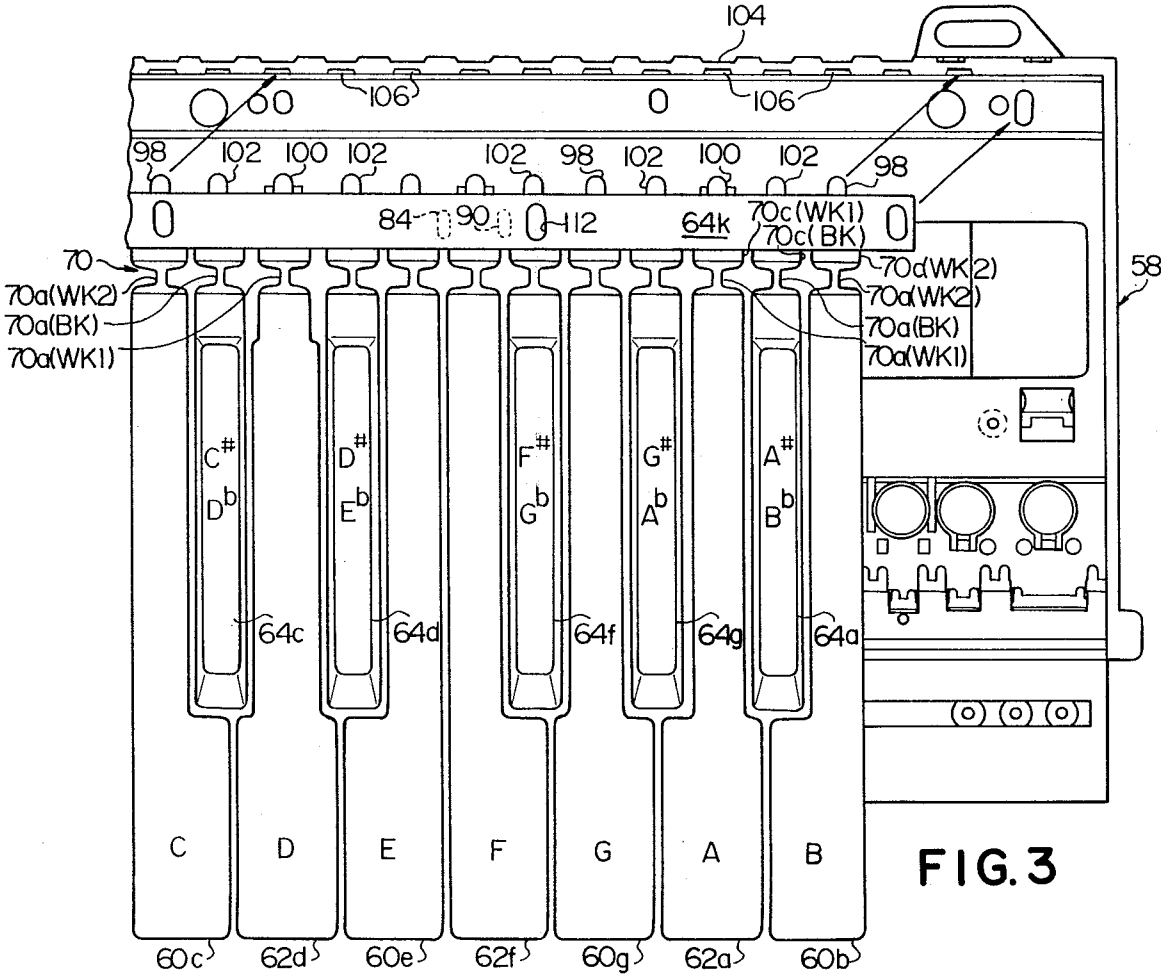
FIG. 3 is a plan views showing portions of a preferred embodiment of a keyboard assembly according to the present invention.
Figure 4:
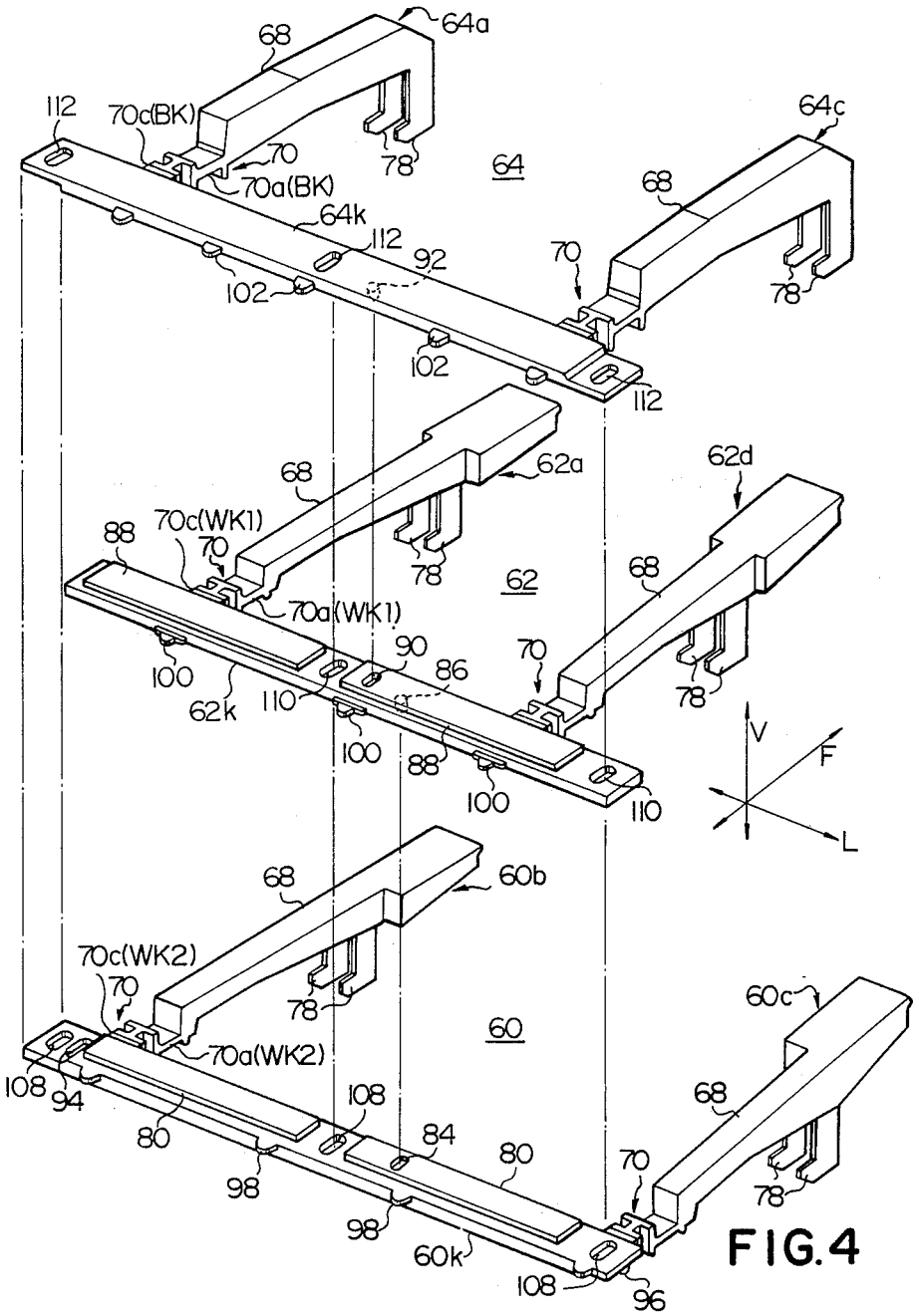
FIG. 4 is a fragmentary, exploded perspective view showing the arrangement of the key units which form part of the keyboard assembly illustrated in FIG. 3.

Referring first particularly to FIGS. 3 and 4, the keyboard assembly embodying the present invention comprises a frame structure 58 and a plurality of sets of key members arranged in a row in the first direction of the keyboard assembly and supported on the frame structure 58. These key members are elongated each in the second direction of the keyboard assembly and include those formed by first and second white key units 60 and 62 (or WK1 and WK2, respectively) and a black key unit 64 (or BK). The first white key unit 60 has four white key members 60*c*, 60*e*, 60*g* and 60*b* respectively allocated to the notes C, E, G and B, and the second key unit 62 has three white key members 62*d*, 62*f* and 62*a* respectively allocated to the notes D, F and A. The key members 60*c*, 60*e*, 60*g* and 60*b* of the first white key unit 60 and the key members 62*d*, 62*f* and 62*a* of the second white key unit 62 are arranged alternately so that the individual key members of the two key units 60 and 62 provide the standard sequential white key configuration with the keys for the notes C, D, E, F, G, A and B located in this sequence as shown. The black key unit 64 has five black key members 64*c*, 64*d*, 64*f*, 64*g* and 64*a* which are arranged in interdigital relationship to these key members of the first and second key units 60 and 62. Thus, each of the white key members which are located adjacent a black key member or black key members has a recess extending lengthwise of the key member so that each of the black key members is located within an elongated opening formed between the paired white key members on both sides of the black key member. The key members 64*c*, 64*d*, 64*f*, 64*g* and 64*a* of the black key unit 64 are allocated to C-sharp or D-flat, D-sharp or E-flat, F-sharp or G-flat, G-sharp or A-flat and A-sharp or B-flat notes, respectively and are located in this sequence with respect to the sequential white key configuration consisting of the key members 60*c*, 60*d*, 60*e*, 60*f*, 62*g*, 62*a* and 62*b*.

In FIG. 4, the above mentioned first, second and third directions of a keyboard assembly according to the present invention are indicated by arrows L, F and V, respectively. The combination of the key units 60, 62 and 64 herein shown is assumed to be one of such combinations and, thus, a plurality of combinations of key units respectively similar to the key units 60, 62, 64 are arranged in row in the first direction L of the keyboard assembly. In FIG. 3, the combination of the key units 60, 62 and 64 is assumed to be in a condition separate from the frame structure 58 and is, for convenience of illustration, shown held in a position deviated from the correct position in which the combination of the key units is to be assembled to the frame structure 58.

Each of the white key units 60 and 62 and black key unit 64 of the keyboard assembly is provided in the form of a single piece of unitary structure of a synthetic resin and further has an elongated lateral bracket portion extending in the first direction L of the keyboard assembly. The individual key members of each key unit merge into this bracket portion rearwardly of the keyboard assembly and are thus united together at their leading ends by means of the bracket portion. The first white key unit 60 has an elongated lateral bracket portion 60*k* uniting the individual key members 60*c*, 60*e*, 60*g* and 60*b* of the unit 60 together and, likewise, the second white key unit 62 has an elongated lateral bracket portion 60*k* uniting the individual key members 62*d*, 62*f* and 62*a* of the unit 62 together. The key members 64*c*, 64*d*, 64*f*, 64*g* and 64*a* of the black key unit 64 are also united together by means of an elongated lateral bracket portion 64*k*.

Figure 5:
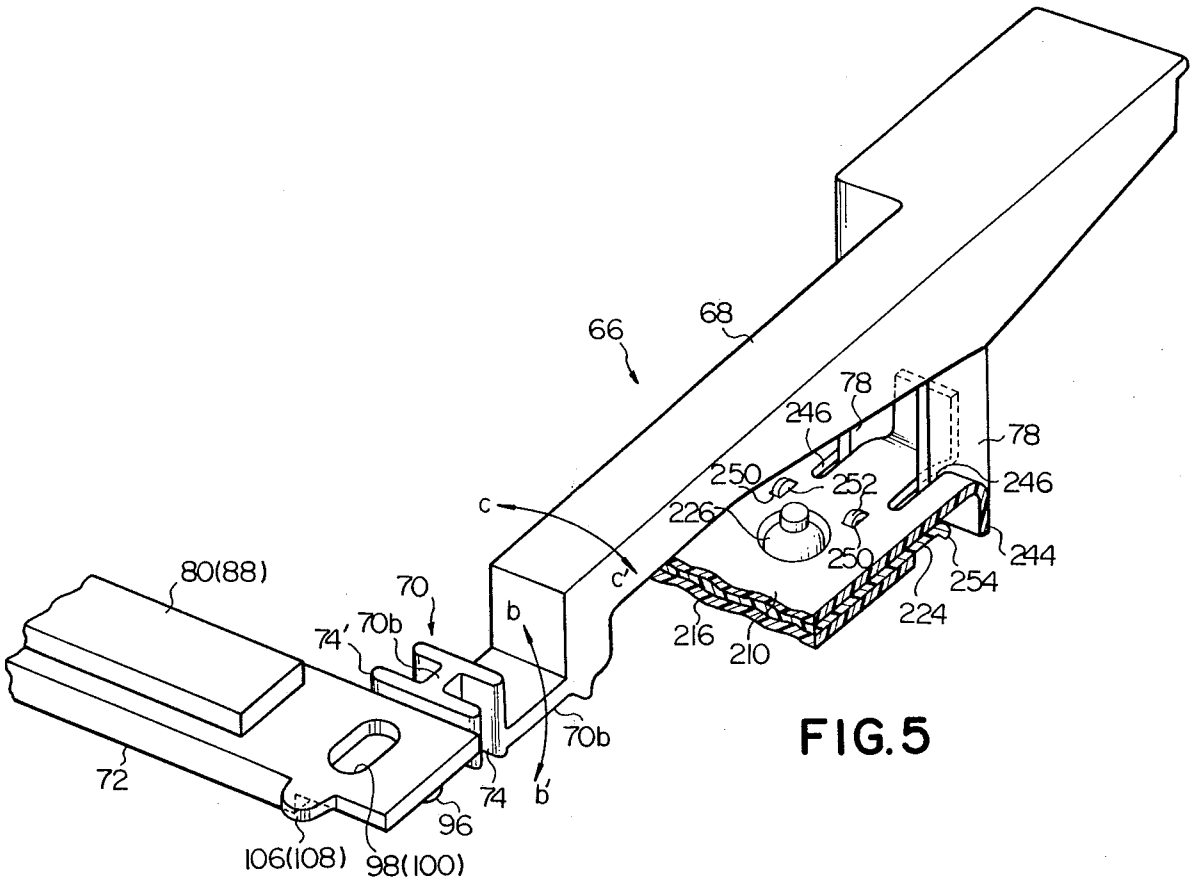
FIG. 5 is a fragmentary perspective view showing one of the key members of one of the key units illustrated in FIG. 4 and some of the members associated with key member.
Figure 6:
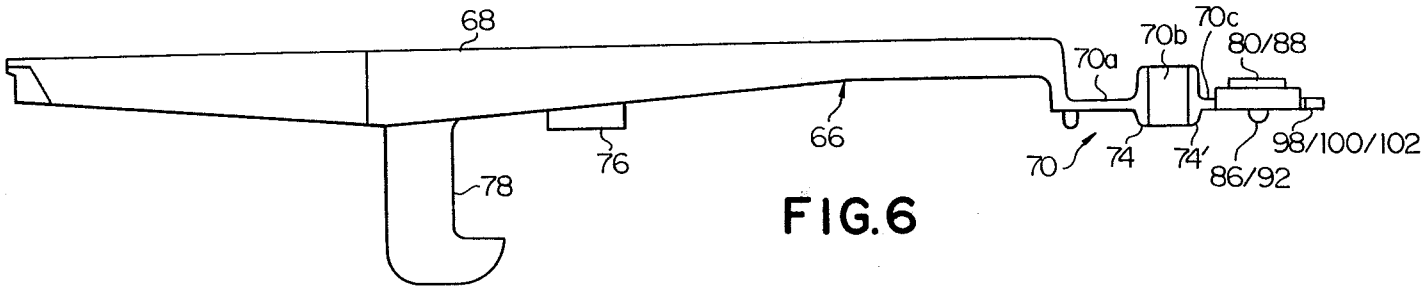
FIG. 6 is a side elevation view of the key member illustrated in FIG. 5.

As will be better seen from FIGS. 5 and 6, each of the key members, herein represented by a key member 66, of each of the key units 60, 62 and 64 has a key body portion 68 to receive a player's finger touch and a torsional coupling portion 70 which intervenes between the key body portion 68 and the lateral bracket portion which is represented by a bracket portion 72. The torsional coupling portion 70 of the key member 66 is provided in a dual-hinge or torsionally deformable joint configuration and comprises a first hinge portion 70*a* projecting rearwardly from the key body portion 68 and a second hinge portion 70*b* projecting further rearwardly from the first hinge portion 70*a* and thus intervening between the first hinge portion 70*a* and the bracket portion 72. The first hinge portion 70*a* is formed by an elastically deformable thin wall portion extending horizontally or in the first and second directions of the keyboard assembly and allows the key body portion 68 to angularly move upwardly and downwardly with respect to the bracket portion 72 as indicated by arrows b and b' about an axis passing through the hinge portion 70*a* in the first direction L of the keyboard assembly. The second hinge portion 70*b* is also formed by an elastically deformable thin wall portion extending vertically or in the second and third directions F and V of the keyboard assembly and allows the key body portion 68 to angularly move laterally as indicated by arrows c and c' about an axis passing through the hinge portion 70*b* in the third direction V of the keyboard assembly. The second hinge portion 70*b* further has a pair of reinforcing wall portions 74 and 74' one intervening between the thin wall portions of the first and second hinge portions 70*a* and 70*b* and the other intervening between the thin wall portion of the second hinge portion 70*b* and the bracket portion 72, as shown. Each of these reinforcing wall portions 74 and 74' is formed at right angles to both of the thin wallportions forming the first and second hinge portions 70*a* and 70*b*.

As shown in FIG. 6, the key member 66 further has a switch actuator portion 76 extending downwardly from the key body portion 68 toward a switch element (not shown) located below the key member 66, and a pair of spaced guide portions 78 also extending downwardly from the key body portion 68 to limit the downward and upward rocking motion of the key member 66. The arrangement cooperative with these switch actuator portion 76 and guide portions 78 will be described later.

The respective lateral bracket members 60*k*, 62*k* and 64*k* of the key units 60, 62 and 64 have equal lengths and are placed on one another with, for example, the bracket portion 62*k* of the white key unit 62 overlying the bracket portion 60*k* of the white key unit 60 and underlying the bracket portion 64*k* of the black key unit 64 as will be best seen from FIG. 4. To enable the first and second white key units 60 and 62 to be assembled together with the respective bracket members 60*k* and 62*k* of the units 60 and 62 correctly attached to each other, the keyboard assembly embodying the present invention comprises first position restricting means which restricts the positional relationship between the key units 60 and 62. Furthermore, the keyboard assembly further comprises second position restricting means to restrict the positional relationship between the second key unit 62 and black key unit 62 to enable the key units 62 and 64 to be assembled together with the respective bracket members 62*k* and 64*k* of the units 62 and 64 correctly attached to each other.

Figure 7:
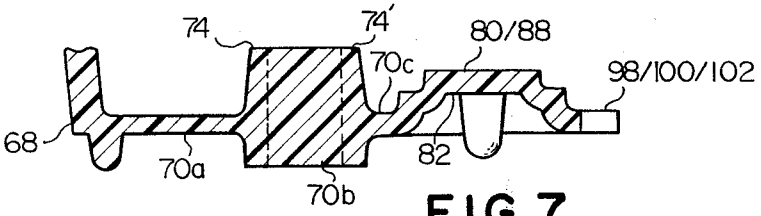
FIG. 7 is a fragmentary sectional view showing, to an enlarged scale, a portion of the key member illustrated in FIGS. 5 and 6.

In the embodiment herein shown, the first position restricting means of the keyboard assembly comprises land portions 80 which protrudes upwardly from the lateral bracket portion 60*k* of the first white key unit 60 and shallow concavities or grooves formed in the bottom wall of the lateral bracket portion 62*k* of the second white key unit 62. The land portions 80 of the first white key unit 60 are elongated longitudinally of the lateral bracket portion 60*k* of the unit 60 and are spaced apart from each other across an intermediate portion of the bracket portion 60*k*. The shallow concavities, indicated at 82 in FIG. 7, are elongated longitudinally of the lateral bracket portion 62*k* of the unit 62 and are shaped conformingly to the land portions 80. The land portions 80 are thus snugly received in the concavities 82, respectively, and allow the first and second white key units 60 and 62 to be correctly assembled together.

The first position restricting means of the keyboard assembly herein shown further comprises an opening or recess 84 formed in the lateral bracket portion 60*k* of the first white key unit 60 and located at a suitable distance from a middle portion of the bracket portion 60*k*. The opening or recess 84 may extend throughout the thickness of the lateral bracket portion 60*k* so as to be an opening or may be formed be simply open upwardly so as to be a recess and may be located in the vicinity of the E-note key member 60*e* of the first white key unit 60. In conjunction with such an opening or recess 84 provided in the first white key unit 60, the second white key unit 62 has a projection 86 directed downwardly from the lateral bracket portion 62*k* of the key unit 62. The projection 86 from the bracket portion 62*k* of the key unit 62 is vertically aligned with or otherwise located correspondingly to the opening or recess 84 in the lateral bracket portion 60*k* of the first white key unit 60 and may thus be located in the vicinity of the F-note key member 62*f* of the second white key unit 62. The projection 86 of the key unit 62 is thus closely received in the opening or recess 84 in the key unit 60 and also enables the key units 60 and 62 to be correctly assembled together.

The second position restricting means of the keyboard assembly is largely similar to the first position restricting means arranged as described above and comprises land portions 88 protruding upwardly from the lateral bracket portion 62*k* of the second white key unit 62 and shallow concavities (indicated at 82 in FIG. 7) formed in the bottom wall of the lateral bracket portion 64*k* of the black key unit 64. The land portions 86 of the second white key unit 62 are also elongated longitudinally of the lateral bracket portion 62*k* of the unit 62 and are spaced apart from each other across an intermediate portion of the bracket portion 62*k*. The shallow concavities in the lateral bracket portion 62*k* of the key unit 62 are shaped conformingly to the land portions 86 and have the land portions 86 snugly received therein to allow the white and black key units 62 and 64 to be correctly assembled together.

The second position restricting means of the keyboard assembly further comprises an opening or recess 90 formed in the lateral bracket portion 62*k* of the second white key unit 62 and located in the vicinity of a middle portion of the bracket portion 62*k*. The opening or recess 90 may also extend throughout the thickness of the lateral bracket portion 62*k* so as to be an opening or may be formed be simply open upwardly so as to be a recess and may be located in the vicinity of the F-note key member 60*f* of the key unit 62. In conjunction with such an opening or recess 90 provided in the white key unit 62, the black key unit 64 has a projection 92 directed downwardly from the lateral bracket portion 64*k* of the key unit 64. The projection 92 from the lateral bracket portion 64*k* of the key unit 64 is vertically aligned with or otherwise located correspondingly to the opening or recess 90 in the lateral bracket portion 62*k* of the white key unit 62 and may thus be located in the vicinity of the F-sharp or G-flat key member 64*f* of the black key unit 64. The projection 92 of the key unit 64 is thus also closely received in the opening or recess 90 in the key unit 62 and enables the key units 62 and 64 to be correctly assembled together.

As has been described, the combination of the opening 84 and projection 86 forming the first position restricting means and the combination of the opening 90 and projection 92 forming the second position restricting means are located in the vicinity of the middle portions of the bracket members of the key units. This will prove advantageous for the correct positioning of the key units with respect to each other because the bracket portion of each of the key units formed by a molded plastic article is less subject to error in geometry in its intermediate portion than in opposite end portions of the article.

The above described arrangements of each of the first and second position restricting means may be modified so that the lateral bracket portion 60*k* of the first white key unit 60 is formed with concavities and the lateral bracket portion 62*k* of the second white key unit 62 formed with land portions or, likewise, the lateral bracket portion 62*k* of the second white key unit 62 is formed with concavities and the bracket portion 64*k* of the black key unit 64 formed with land portions. Furthermore, the lateral bracket portion 60*k* of the first white key unit 60 may be formed with projections and the lateral bracket portion 62*k* of the second white key unit 62 formed with openings or recesses or, likewise, the lateral bracket portion 62*k* of the second white key unit 62 may be formed with projections and the lateral bracket portion 64*k* of the black key unit 64 formed with openings or recesses.

The keyboard assembly embodying the present invention further comprises third position restricting means which is effective to restrict the positional relationship between the combination of the key units 60, 62 and 64 herein shown and the combination of similar key units arranged on one side of the former. The combination of the key units 60, 62 and 64 herein shown is assumed to intervene between the combinations each of similar key units and, thus, the third position restricting means is operative to restrict the positional relationship between the combination of the key units 60, 62 and 64 and the combination of similar key units arranged on each side of the former as represented by bracket members 60*k*', 62*k*' and 64*k*' in FIG. 8.

In the embodiment herein shown, such third position restricting means comprises an opening or recess 94 formed in one end portion of the lateral bracket portion 60*k* of the first white key unit 60 and a projection 96 directed downwardly from the other end portion of the bracket portion 60*k* of the key unit 60. The opening or recess 94 may extend throughout the thickness of the lateral bracket portion 60*k* so as to be an opening or may be formed be simply open upwardly so as to be a recess. The lateral bracket portion 60*k* ' (FIG. 8) of the first white key unit of the combination of the similar key units arranged on each side of the combination of the key units 60, 62 and 64 is also formed a projection on one end portion and an opening or recess 94 (FIG. 8) in the other end portion thereof. Thus, the projection 96 from the lateral bracket portion 60*k* of the key unit 60 is received in the opening or recess 94 in the bracket portion 60*k*' of the first white key unit of the adjacent combination of the key units and enables the two combinations of the key units to be correctly assembled together. It may be herein noted that the opening or recess forming part of each of the first, second and third position restricting means may be herein referred to commonly as "concavity" in view of the opening, as well as the recess, is open and concave at at least one of its upper and lower ends.

The key units 60, 62 and 64 of the keyboard assembly embodying the present invention are thus temporarily assembled and correctly positioned with respect to each other in the first, second and third directions L, F and V (FIG. 4) of the keyboard assembly by the aid of the first and second position restricting means. Furthermore, the resultant combination of the key units 60, 62 and 64 is temporarily assembled to and correctly positioned with respect to the similar combinations on both sides thereof by the aid of the third position restricting means. The key structure composed of the plurality of combinations of the key units is then fitted to the frame structure 58 with use of assembling means before the key structure is to be finally assembled to the frame structure 58.

Figure 9:
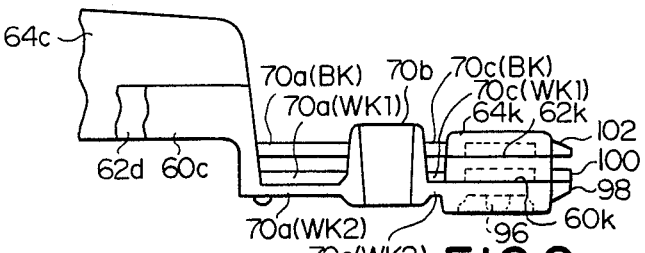
FIG. 9 is a side elevation view of a portion of the key member illustrated in FIGS. 5, 6 and 7.

In the embodiment herein shown, such assembling means comprises a plurality of lug portions 98 directed rearwardly from the lateral bracket portion 60*k* of the first white key unit 60, a plurality of lug portions 100 directed rearwardly from the lateral bracket portion 62*k* of the second white key unit 62, and a plurality of lug portions 102 directed rearwardly from the lateral bracket portion 64*k* of the black key unit 64 as will be seen from FIGS. 4 and 9. The lug portions thus formed on the bracket portion of each of the key units 60, 62 and 64 are spaced apart from each other longitudinally of the bracket portion and are vertically not aligned with the lug portions of another key unit, as will be seen from FIG. 4. Correspondingly to these lug portions 98, 100 and 102 of the key units 60, 62 and 64, respectively, the frame structure 58 has openings formed in an upstanding wall portion 104 as shown in FIG. 3 in which the openings are represented by the openings 106 provided in conjunction with the lug portions 98 of the first white key unit 60. The individual key units 60, 62 and 64 are thus fitted to the frame structure 58 with the lug portions 98, 100 and 102 thus received in such openings 106 provided in the frame structure 58.

The key units 60, 62 and 64 of each of the combinations of the key units thus temporarily attached to the frame structure 58 are then fastened together with use of suitable fastening means. In the embodiment herein shown, such fastening means comprises three openings 108 provided in the lateral bracket portion 60*k* of the first white key unit 60, two openings 110 provided in the lateral bracket portion 62*k* of the second white key unit 62, and three openings 112 provided in the lateral bracket portion 64*k* of the black key unit 64. Of the three openings 108 provided in the lateral bracket portion 60*k* of the first white key unit 60, one is located in a middle portion and the others in opposite end portions, respectively, of the bracket portion 60*k*. Of the two openings 110 provided in the lateral bracket portion 62*k* of the second white key unit 62, one is located in one end portion and the other in a middle portion of the bracket portion 62*k*. Of the openings 112 provided in the lateral bracket portion 64*k* of the black key unit 64, one is located in a middle portion and the others in opposite end portions, respectively, of the bracket portion 64*k*. The key units 60, 62 and 64 are thus held together and securely fastened to the frame structure 58 by means of screws or studs passed through the openings 108, 110 and 112 located each in one end portion of each of the lateral bracket members 60*k*, 62*k* and 64*k* of the key units 60, 62 and 64 as will be seen from FIG. 8 in which the screws or studs are represented by the stud 114. Furthermore, when any of the key members of any of the key units 60, 62 and 64 is forced against any member with which the key member is engageable such as a guide member (not shown) forming part of the frame structure 58, the key member will not produce any frictional force and unpleasant noise because each of the key members forming part of each key unit is allowed to move or deform independently of the other key members through deformation of the first and/or second hinge portions 70*a* and 70*b* of the torsional coupling portion 70 of the key member.

Figure 10:
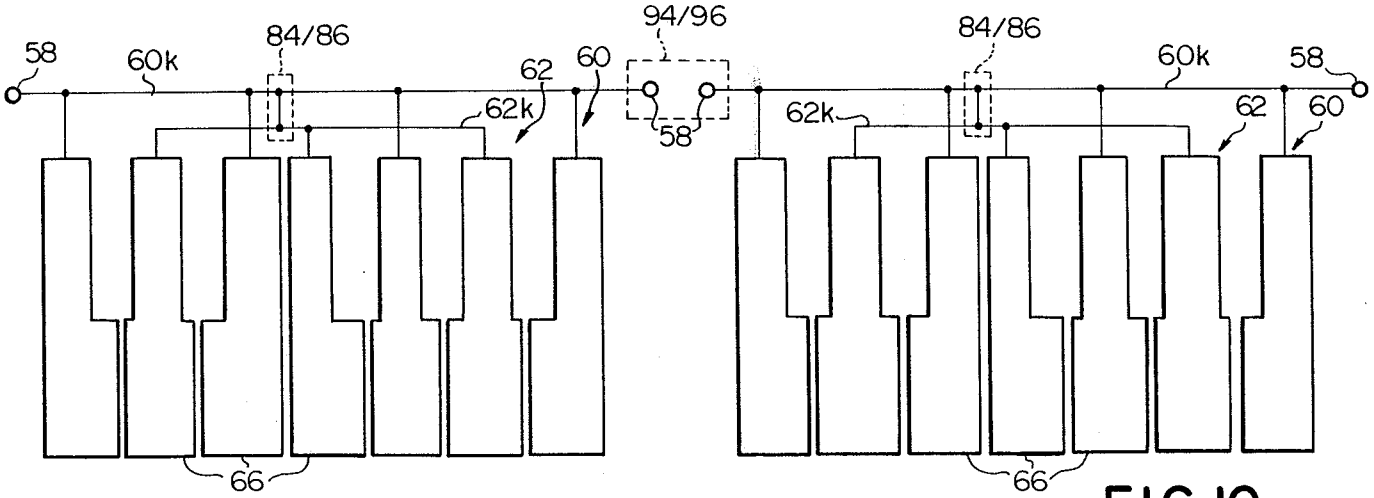
FIG. 10 is a schematic view showing the general construction and arrangement of the preferred embodiment of a keyboard assembly according to the present invention.

FIG. 10 schematically shows the construction and arrangement of the preferred embodiment of a keyboard assembly according to the present invention. As will be seen from this schematic illustration, the preferred embodiment of a keyboard assembly according to the present invention has been hereinbefore described essentially comprises at least two combinations C1 and C2 each of at least two key units such as the key units 60 and 62 each comprising a plurality of key members 66 and an elongated bracket portion such as the bracket portion 60*k* or 62*k* interconnecting the key members 66 of each key unit together, a frame structure 58 to which the key units 60 and 62 are assembled together in such a manner that each of the individual key members of the key units is allowed to rock independently of each other about an axis substantially fixed with respect to the frame structure 58 and substantially parallel with bracket portion 60*k* or 62*k*, and position restricting means such as the combination of the concavity 84 and projection 86 establishing a first predetermined positional relationship between each of the key units of each of the combinations of key units for enabling the key units of each combination to be positioned in the first predetermined relationship with respect to each other before the key units 60, 62 and 64 are assembled to the frame structure 58, and position restricting means such as the combination of the concavity 94 and projection 96 establishing a second predetermined positional relationship between each of the key units 60, 62 and 64 of one of the combinations and each of the key units 60, 62 and 64 of the other of the combinations for enabling the two combinations of key units to be positioned in the second predetermined relationship with respect to each other before the key units 60, 62 and 64 are assembled to the frame structure 58.

While the respective lateral bracket members **60*k*, 62*k* and 64*k* of the key units 60, 62 and 64** are vertically placed on one another in the embodiment hereinbefore described, at least two of the bracket members of the key units forming part of a keyboard assembly embodying the present invention may be shaped so that the bracket members of the individual key units are arranged in a single line and endwise connected together to form in combination an elongated strip. In this instance, the bracket portion of each of the key units may have an end edge meanderingly or zigzag curved or otherwise appropriately contoured to closely fit to the edge of the bracket portion of the key unit to which the former is to be conjoined. Such edges formed at the ends of the bracket members of the key units form each of the first and second position restricting means of the keyboard assembly and may be provided in addition to a portion or portions formed on the bracket portion of each of the key units along one or more of the key members of the key unit, though not shown in the drawings.

Furthermore, the first and second white key units 60 and 62 of the keyboard assembly hereinbefore described may be modified so that each of the key units is composed of a combination of key members different from the described combination of the key members of each of the key units 60 and 62. For example, one of the white key units may have four white key members respectively allocated to the notes F, A, C and E, and the other key unit has three white key members respectively allocated to the notes G, B and D. The key members of these white key units are also arranged alternately so that the individual key members of the two key units provide the standard sequential key configuration with the keys for the notes F, G, A, B, C, D and E located in this sequence. Where such key units are in use in a keyboard assembly according to the present invention, the first position restricting means dictating the relative positions of the two white key units with respect to each other may be provided in the vicinity of the note A key member of one key unit and the note B key member of the other so that the position restricting means is located close to intermediate portions of the bracket members of the key units. The second position restricting means dictating the relative positions of the three-key white key unit and black key unit with respect to each other may be provided in the vicinity of the note B key member of the three-key white key unit and the A-sharp or B-flat key member of the black key unit so that the second position restricting means is located close to intermediate portions of the bracket members of the key units. On the other hand, the third position restricting means dictating the relative position of the combination of the key units including such white key units with respect to another combination of key units may be provided in the vicinity of the note A and E key members, respectively, of one key unit so that the second position restricting means is also located close to intermediate portions of the bracket members of the key units.

While it has thus far been assumed that, of the two white key units forming part of the keyboard assembly, one has four key members and the other has two key members, such key units may be substituted by key units one of which has five key members and the other has two key members. FIGS. 11A to 11C and FIGS. 12A to 12C show different examples of such five-key and two-key key units.

Figure 11A:
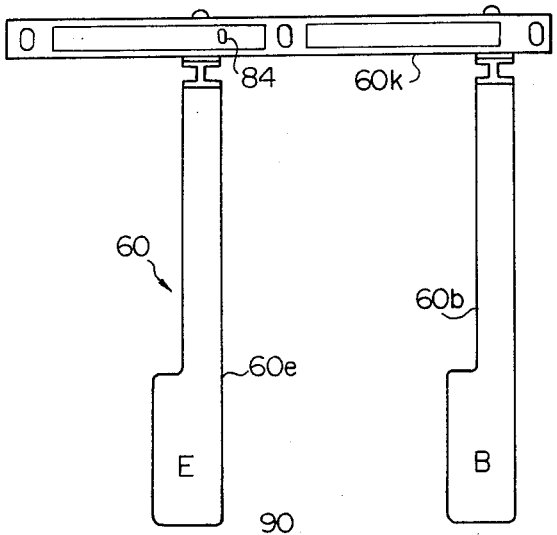
FIGS. 11A, 11B and 11C are plan views showing white and black key units which may be used alternatively to those used in the preferred embodiment of a keyboard assembly according to the present invention.
Figure 11B:
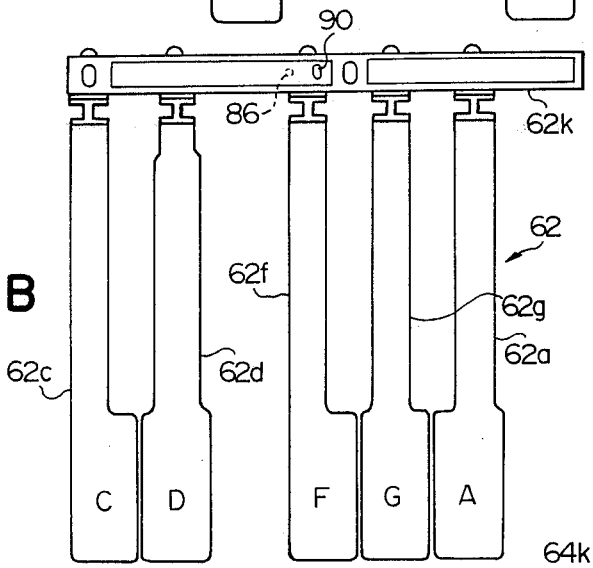
Figure 11C:
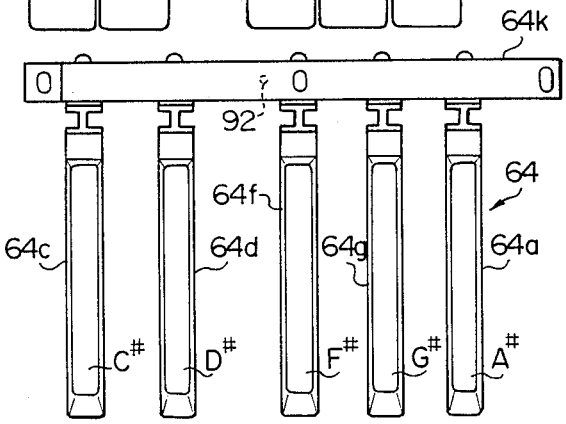

In the key unit configurations illustrated in FIGS. 11A to 11C, the first white key unit 60 to have its lateral bracket portion **60*k* located at the bottom of the combination of the bracket members of the three key units has two white key members 60*e* and 60*b* respectively allocated to the notes E and B, and the second white key unit 62 to have its lateral bracket portion 62*k* placed on the bracket portion 60*k* of the key unit 60 has five white key members 60*c*, 60*d*, 60*f*, 62*g* and 60*a* respectively allocated to the notes C, D, F, G and A. The key members of these white key units 60 and 62 are arranged alternately so that the individual key members of the key units 60 and 62 provide the standard sequential key configuration with the keys for the notes C, D, E, F, G, A and B located in this sequence. The key configuration of the black key unit 64 is similar to that of the key unit 64 in the described preferred embodiment of the present invention. Thus, the key members 64*c*, 64*d*, 64*f*, 64*g* and 64*a* allocated to C-sharp or D-flat, D-sharp or E-flat, F-sharp or G-flat, G-sharp or A-flat and A-sharp or B-flat notes, respectively, of the black key unit 64 are located in this sequence with respect to the sequential white key configuration consisting of the key members 60*c*, 60*d*, 60*e*, 60*f*, 62*g*, 62*a* and 62*b***.

In the keyboard assembly incorporating the first and second white key units 60 and 62 configured as described above, the opening 84 forming part of the first position restricting means dictating the relative positions of the key units 60 and 62 with respect to each other is preferably provided in the vicinity of the note E key member **60*e* of the first white key unit 60 as shown in FIG. 11A and the projection 86 of the first position restricting means is preferably provided in the vicinity of the note F key member 62*f* of the second white key unit 62 as shown in FIG. 11B. Through such arrangement of the opening 84 and projection 86, the first position restricting means is located close to respective middle portions of the lateral bracket members 60*k* and 62*k* of the key units 60 and 62. On the other hand, the opening 90 forming part of the second position restricting means dictating the relative positions of the second white key unit 62 and black key unit with respect to each other may be provided in the vicinity of the note F key member 62*f* of the white key unit 62 as shown in FIG. 11B and the projection 92 of the second position restricting means is preferably provided in the vicinity of the F-sharp or G-flat key member 64*f* of the black key unit 64 as shown in FIG. 11C. Through this arrangement of the opening 90 and projection 92, the second position restricting means is also located close to respective middle portions of the lateral bracket members 62*k* and 64*k* of the key units 62 and 64**.

Figures 12A, 12B, 12C:
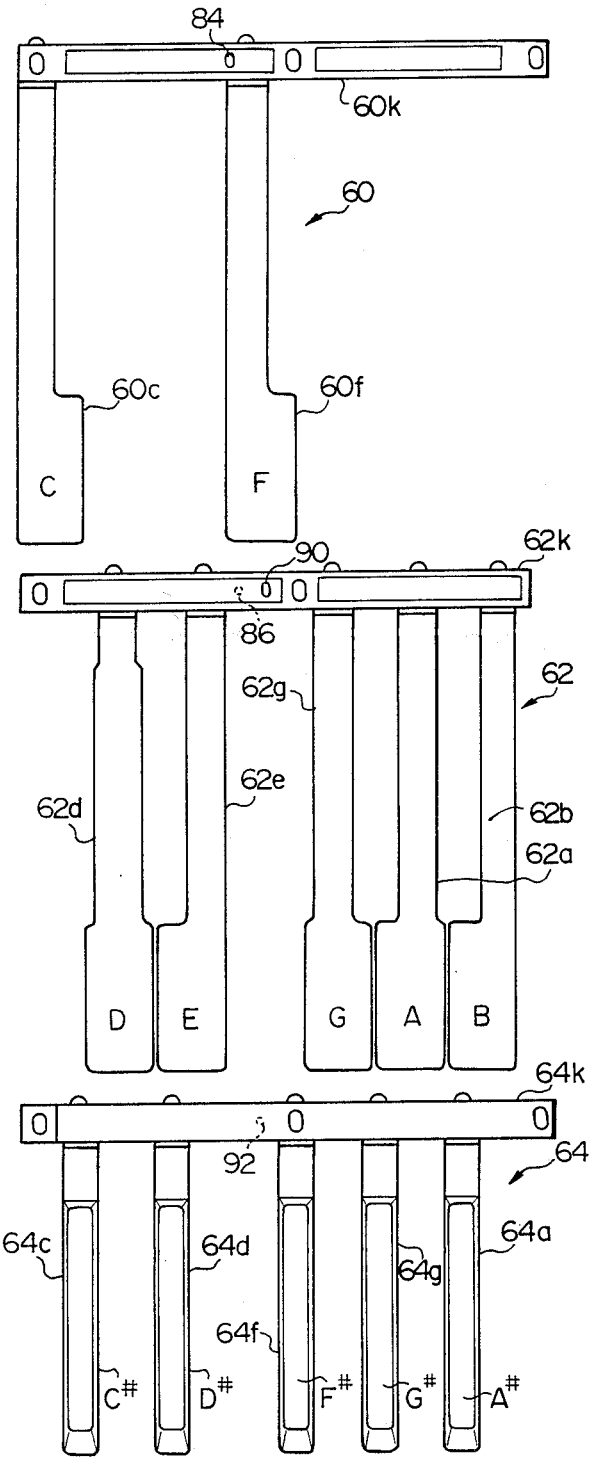
FIGS. 12A, 12B and 12C are similar to FIGS. 11A, 11B and 11C, respectively, but show other forms of white and black key units which may also be used alternatively to those used in the preferred embodiment of a keyboard assembly according to the present invention.

In the key unit configurations illustrated in FIGS. 12A to 12C, the first white key unit 60 has two white key members **60*c* and 60*f* respectively allocated to the notes C and F, and the second white key unit 62 has five white key members 60*d*, 60*e*, 60*g*, 62*a* and 60*b* respectively allocated to the notes D, E, G, A and B. The key members of these white key units 60 and 62 are arranged alternately so that the individual key members of the key units 60 and 62 also provide the standard sequential key configuration with the keys for the notes C, D, E, F, G, A and B located in this sequence. The key configuration of the black key unit 64 is also similar to that of the key unit 64** in the described preferred embodiment of the present invention.

In the keyboard assembly incorporating the first and second white key units 60 and 62 configured as described above, the opening 84 forming part of the first position restricting means is preferably provided in the vicinity of the note F key member 60*f* of the first white key unit 60 as shown in FIG. 12A and the projection 86 of the first position restricting means is preferably provided in the vicinity of the note E key member 62*e* of the second white key unit 62 as shown in FIG. 12B. The first position restricting means comprising the opening 84 and projection 86 thus arranged is located close to respective middle portions of the lateral bracket members 60*k* and 62*k* of the key units 60 and 62. On the other hand, the opening 90 forming part of the second position restricting means dictating the relative positions of the second white key unit 62 and black key unit with respect to each other may be provided between the note E and G key members 62*e* and 62*g* of the white key unit 62 as shown in FIG. 12B and the projection 92 of the second position restricting means is preferably provided in the vicinity of the F-sharp or G-flat key member 64*f* of the black key unit 64 as shown in FIG. 12C. It will be seen that the second position restricting means having this arrangement of the opening 90 and projection 92 is also located close to respective middle portions of the lateral bracket members 62*k* and 64*k* of the key units 62 and 64.

FIGS. 13 to 19 show various modifications of the torsional coupling portion 70 which forms part of each of the key members of the key units of the keyboard assembly embodying the present invention has to provide a dual-hinge or torsionally deformable joint feature for the key member.

Figure 13:
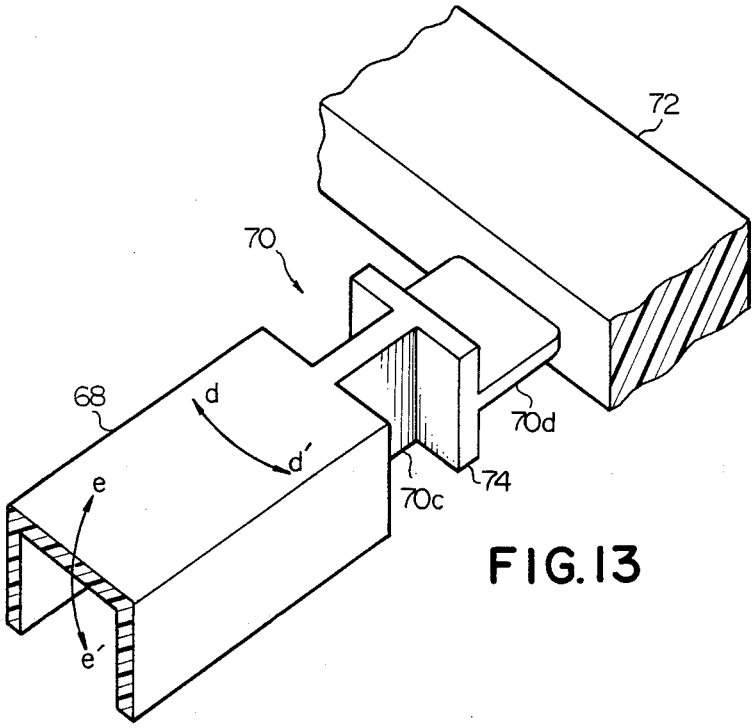
FIGS. 13 to 19 are fragmentary perspective views showing various modifications of the torsional coupling portion which forms part of each of the key members of the key units of the keyboard assembly embodying the present invention.

Referring to FIG. 13, the torsional coupling portion 70 comprises a first hinge portion 70*c* projecting rearwardly from the key body portion 68 of the key member and a second hinge portion 70*d* projecting further rearwardly from the first hinge portion 70*c* and thus intervening between the first hinge portion 70*c* and the bracket portion 72 of a key unit. The first hinge portion 70*c* is formed by an elastically deformable thin wall portion extending vertically or in the second and third directions F and V (FIG. 4) of the keyboard assembly and allows the key body portion 68 to angularly move laterally with respect to the bracket portion 72 as indicated by arrows d and d' about an axis passing through the hinge portion 70*a* in the third direction V (FIG. 4) of the keyboard assembly. The second hinge portion 70*d* i also formed by an elastically deformable thin wall portion extending horizontally or in the first and second directions of the keyboard assembly and allows the key body portion 68 to angularly move upwardly and downwardly as indicated by arrows e and e' about an axis passing through the hinge portion 70*b* in the first direction L (FIG. 4) of the keyboard assembly. Between the first an second hinge portions 70*c* and 70*d* is provided a reinforcing wall portion 74 intervening between the thin wall portions of the first and second hinge portions 70*c* and 70*d* and formed at right angles to both of the thin wall portions forming the first and second hinge portions 70*c* and 70*d*, as shown.

Figure 14:
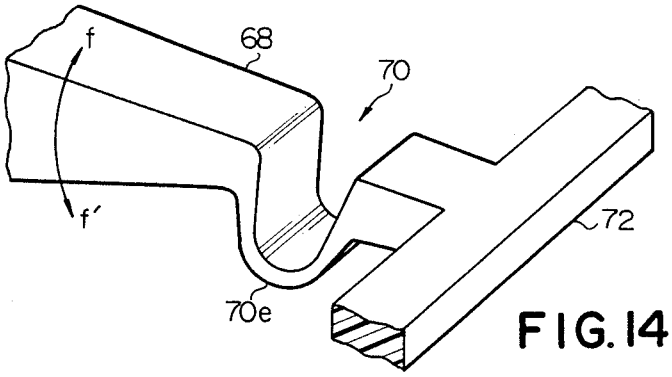

The torsional coupling portion 70 shown in FIG. 14 comprises a generally semicylindrical hinge portion 70*e* intervening between the key body portion 68 of the key member and the bracket portion 72 of a key unit. The hinge portion 70*e* is formed by a generally U-shaped elastically deformable thin wall portion downwardly curved arcuately between the key body portion 68 of the key member and the bracket portion 72 of the key unit about an axis in the first direction L (FIG. 4) of the keyboard assembly. The hinge portion 70*e* thus shaped allows the key body portion 68 to angularly move upwardly and downwardly as indicated by arrows f and f' about the axis of curvature of the hinge portion 70*e* and to slightly move laterally with respect to the bracket portion 72 about an axis in the third direction V (FIG. 4) and further about an axis in the second direction F (FIG. 4) of the keyboard assembly through torsional deformation of the hinge portion 70*e*. The key member having the torsional coupling portion 70 provided by the hinge portion 70*e* herein shown features simple construction and ease of formation by molding and is useful particular for a small-sized keyboard assembly in which a set of keys for a single octave of notes has a 110 mm or 140 mm span.

Figure 15:
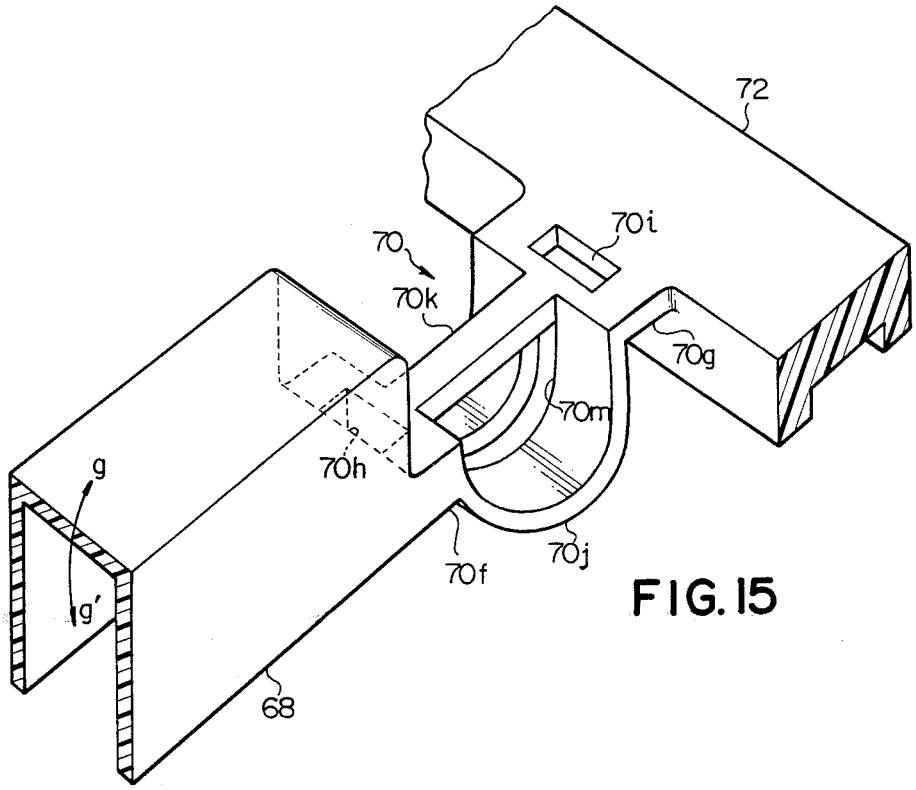

On the other hand, the torsional coupling portion 70 shown in FIG. 15 comprises a pair of lug portions 70*f* and 70*g* respectively projecting toward each other from the key body portion 68 of the key member and the bracket portion 72 and formed with vertically open openings 70*h* and 70*i*, respectively. Connected between these lug portions 70*f* and 70*g* are a generally semicylindrical or U-shaped elastically deformable hinge portion 70*j* downwardly curved arcuately between the lug portions 70*f* and 70*g* and an elongated bridge portion 70*k* extending straight between the lug portions 70*f* and 70*g* and straddling over the curved hinge portion 70*j*. The curved hinge portion 70*j* has formed in its inner wall a groove 70*m* extending between the opposite ends of the bridge portion 70*k* as shown. The groove 70*m* is located centrally of the width of the curved hinge portion 70*j* and prevents the hinge portion 70*j* from being undercut. The elongated bridge portion 70*k* maintains the spacing between the lug portions 70*f* and 70*g* and thus prevents the key body portion 68 of the key member from being longitudinally move toward or away from the bracket portion 72 in the first direction L (FIG. 4) of the keyboard assembly. The openings 70*h* and 70*i* provided in the lug portions 70*f* and 70*g*, respectively, are useful for controlling the tension to be produced in the bridge portion 70*k* when the key member is depressed by an operator's finger touch.

The torsional coupling portion 70 thus shaped also allows the key body portion 68 to angularly move upwardly and downwardly as indicated by arrows g and g' about the axis of curvature of the hinge portion 70*e* through deformation of both of the curved hinge portion 70*j* and elongated bridge portion 70*k*. The torsional coupling portion 70 herein shown further allows the key body portion 68 to slightly move laterally with respect to the bracket portion 72 about an axis in the third direction V (FIG. 4) and further about an axis in the second direction F (FIG. 4) of the keyboard assembly through torsional deformation of each of the hinge portion 70*j* and bridge portion 70*k*.

The key member having the torsional coupling portion 70 of the type above described is also useful for a small-sized keyboard assembly but is applicable to a larger standard-size keyboard assembly in which a set of keys for a single octave of notes has a 160 mm or 140 mm span.

Figure 16:
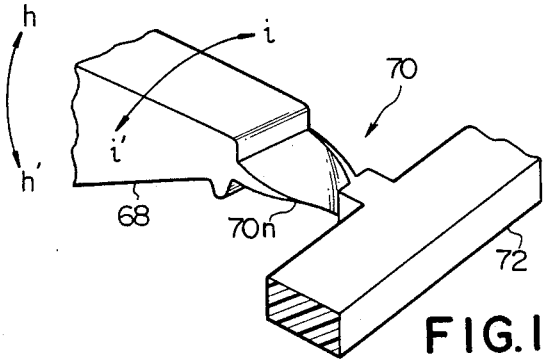

Referring to FIG. 16, the torsional coupling portion 70 comprises an elastically deformable strip portion 70*n* intervening between the key body portion 68 of the key member and the bracket portion 72 of a key unit. The elastically deformable strip portion 70*n* of the torsional coupling portion 70 herein shown is twisted from a first plane to a second plane turned through about 90 degrees from the first plane about an axis in the second direction F (FIG. 4) of the keyboard assembly. Thus, the strip portion 70*n* extends horizontally or first and second directions of the keyboard assembly in the vicinity of the leading end of the 68 and vertically or in the second and third direction F and V (FIG. 4) of the keyboard assembly in the vicinity of the bracket portion 72. Thus, the key body portion 68 connected by this twisted strip portion 70*n* to the bracket portion 72 of the key unit is allowed to angularly move upwardly and downwardly as indicated by arrows h and h' about an axis in the first direction L (FIG. 4) of the keyboard assembly and laterally with respect to the bracket portion 72 about an axis in the third direction V of the keyboard assembly as indicated by arrows i and i' through torsional deformation of the twisted strip portion 70*n*. The torsional coupling portion 70 of this type is useful particularly for a standard-size keyboard assembly inbut may be used advantageous in a small-sized keyboard assembly.

Figure 17:
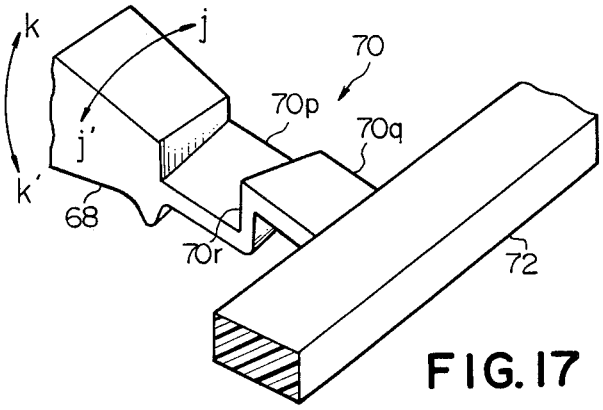

On the other hand, the torsional coupling portion 70 shown in FIG. 17 comprises a first hinge portion 70*p* projecting rearwardly from the key body portion 68 of the key member and a second hinge portion 70*q* projecting further rearwardly from the first hinge portion 70*p* through an intermediate wall portion 70*r* and thus intervening between the first hinge portion 70*p* and the bracket portion 72 of a key unit. The first hinge portion 70*p* is formed by an elastically deformable thin wall portion inclined in one direction from a horizontal plane, viz., about an axis in the second direction F (FIG. 4) of the keyboard assembly, and the second hinge portion 70*q* is formed by an elastically deformable thin wall portion inclined in the other direction also about an axis in the second direction F (FIG. 4) of the keyboard assembly. The intermediate wall portion 70*r* through which the two hinge portions 70*p* and 70*q* extends vertically or in the first and third direction L and V (FIG. 4) of the keyboard assembly. The combination of the two hinge portions 70*p* and 70*q* inclined in opposite directions allows the key body portion 68 to angularly move laterally with respect to the bracket portion 72 as indicated by arrows j and j' about axes passing through the hinge portions 70*p* and 70*q* each in the third direction V of the keyboard assembly and upwardly and downwardly as indicated by arrows k and k' about axes passing through the hinge portions 70*p* and 70*q* each in the first direction L (FIG. 4) of the keyboard assembly.

The torsional coupling portion 70 of the type above described also features simple construction and ease of formation by molding and is useful not only for a standard size keyboard assembly but also for a small-sized keyboard assembly.

Figure 18:
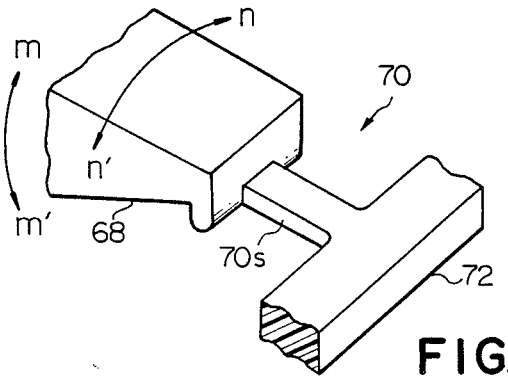

On the other hand, the torsional coupling portion 70 shown in FIG. 18 comprises an elongated stem portion 70*s* extending straight between the key body portion 68 of the key member and the bracket portion 72 of a key unit. The stem portion 70*s* has a generally square-shaped cross section so that the key body portion 68 connected by this stem portion 70*s* to the bracket portion 72 of the key unit is allowed to angularly move upwardly and downwardly as indicated by arrows m and m' about an axis in the first direction L (FIG. 4) of the keyboard assembly and laterally with respect to the bracket portion 72 about an axis in the third direction V (FIG. 4) of the keyboard assembly as indicated by arrows n and n' through torsional deformation of the stem portion 70*s*. The torsional coupling portion 70 of the type above described also features simple construction and ease of formation by molding and is useful especially for a small-sized keyboard assembly but may be used advantageously for a standard-size keyboard assembly.

Figure 19:
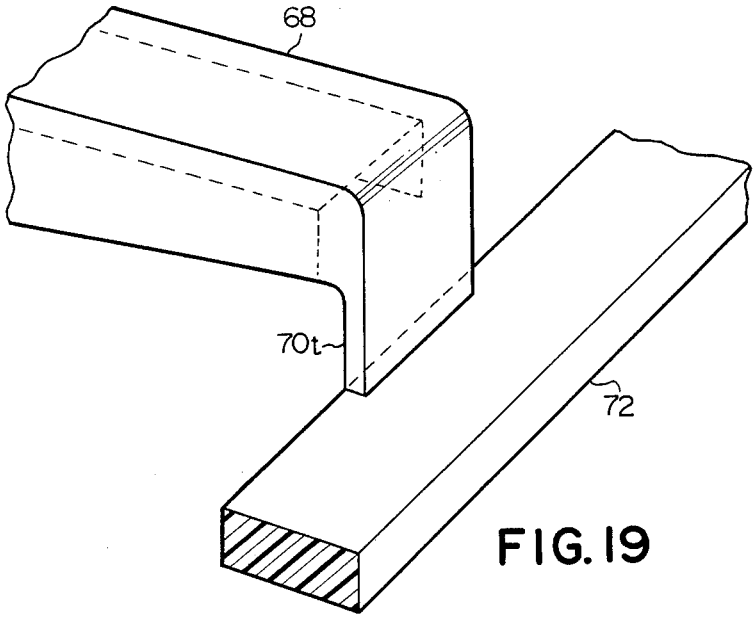

Turning to FIG. 19, the torsional coupling portion 70 herein shown is provided in the form of a thin wall portion 70*t* depending downwardly from the leading end of the 68 of the key member and terminating at its lower end to the bracket portion 72 of the hinge portion. While the thin wall portion 70*t* of this torsional coupling portion 70 is shown extending vertically or in the third direction V (FIG. 4) of the keyboard assembly, the wall portion 70*t* may be inclined downwardly from the leading end of the key body portion 68 to the bracket portion 72 if desired. The key body portion 68 connected by this thin wall portion 70*t* to the bracket portion 72 of the key unit is thus also allowed to angularly move upwardly and downwardly as indicated by arrows p and p' about an axis in the first direction L (FIG. 4) of the keyboard assembly and laterally with respect to the bracket portion 72 about an axis in the third direction V (FIG. 4) of the keyboard assembly as indicated by arrows q and q' through torsional deformation of the wall portion 70*t*. The torsional coupling portion 70 of the type above described also features simple construction and ease of formation by molding and is useful especially for a small-sized keyboard assembly but may be used for a standard-size keyboard assembly.

Figure 20:
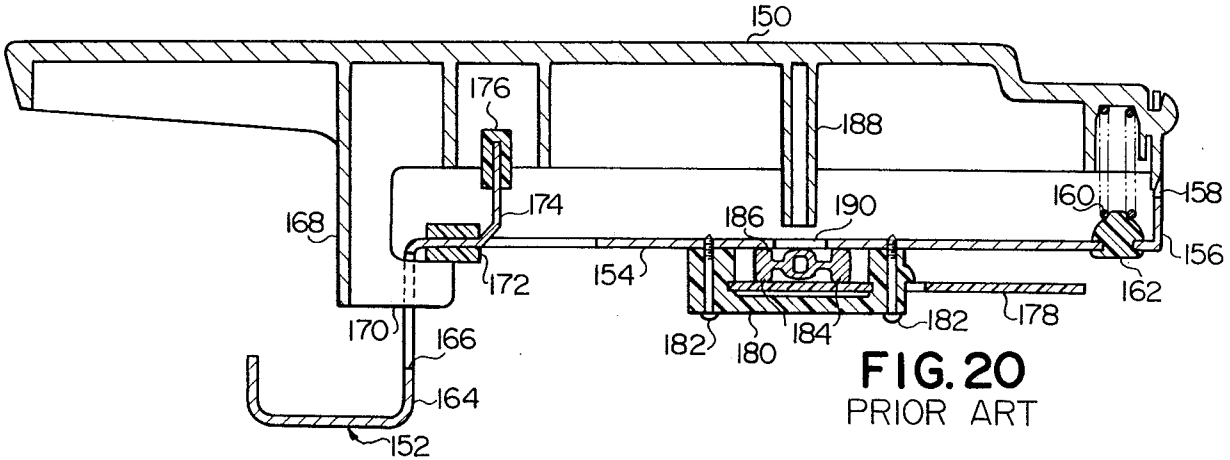
FIG. 20 PRIOR ART
FIG. 20 is a sectional view showing the arrangement in which a key member is mounted on a frame structure in a known keyboard unit of an electronic musical instrument.

FIG. 20 shows the arrangement in which a key member 150 is mounted on a frame structure 152 in a known keyboard unit of an electronic musical instrument. The arrangement of the nature herein shown is taught in, for example, Japanese Utility Model Publication No. 60-28024.

In the prior-art keyboard unit herein shown, the frame structure 152 has a horizontal flat panel portion 154 and a vertical rear panel portion 156 upstanding from the rear end of the flat panel portion 154 and formed with a slot 158. The key member 150 is rockably engaged by the vertical rear panel portion 156 through the slot 158 by means of a spring 150 which is seated at one end on a rear end portion of the key member 150 and at the other on a spring retainer element 162 secured to the flat panel portion 154 of the frame structure 152. The spring 150 serves not only for retaining the key member 150 to the frame structure 152 through the slot 158 but for urging the key member 150 to turn upwardly about its rear end with respect to the frame structure 152.

The frame structure 152 further has a vertical front panel portion 164 depending from the front end of the flat panel portion 154 and formed with a vertically extending slot 166. The key member 150 has a guide portion 168 depending from an intermediate portion thereof and merging downwardly into a lower end portion 170. The lower end portion 170 is directed rearwardly from the lower end of the guide portion 168 and is passed through the slot 166 in the panel portion 164. A strip 172 of rubber is fixedly attached to the underside of the flat panel portion 154 of the frame structure 152 and is located to be engageable with the rearwardly directed lower end portion 170 of the key member 150. The key member 150 urged to turn upwardly about its rear end by means of the spring 160 is thus enabled to normally stay in a rest position having the end portion 170 of the member 150 held in upwardly pressing contact with the rubber strip 172. Thus, the rubber strip 172 provides means to limit the upward turn of the key member 150 about the rear end thereof with respect to the frame structure 152.

The frame structure 152 further has an upstanding front panel portion 174 having a strip 176 of rubber attached thereto. The rubber strip 176 on this upstanding front panel portion 174 is located to be engageable with an intermediate portion of the key member 150 so that the key member 150 is brought into contact with the rubber strip 176 when depressed to downwardly turn by a player's finger touch. Thus, the rubber strip 176 provides means to limit the downward turn of the key member 150 about the rear end thereof with respect to the frame structure 152.

Below the flat panel portion 154 of the frame structure 152 is provided a switch device for a printed circuit board 178 on which is formed a circuitry to dictate the operation of the keyboard unit. The printed circuit board 178 is supported on an insulator member 180 secured to the flat panel portion 154 of the frame structure 150 by means of screws 182 and is held in position slightly below the flat panel portion 154. The printed circuit board 132 has an upper wired surface on which is provided a pair of spaced stationary contact elements 184. Above these stationary contact elements 184 is provided a movable contact element 186 which is movable into and out of contact with the stationary contact elements 184. The movable contact element 186 is attached to a movable contact carrier member vertically movable between the printed circuit board 178 and the horizontal panel portion 154 of the frame structure 152.

The movable contact element 186 is vertically aligned with a switch actuator portion 188 of the key member 150 through an opening 190 provided in the flat panel portion 154 of the frame structure 152. The switch actuator portion 188 of the key member 150 projects toward and engageable with the movable contact carrier member through the opening 190 in the panel portion 154 so that, when the key member 150 is depressed, the switch actuator portion 188 of the key member 150 is downwardly brought into pressing engagement with the movable contact carrier member and forces the movable contact element 186 into contact with the associated pair of stationary contact elements 184 and causes the switch device including the contact elements 184 to close.

In order to have the key member 150 assembled to the frame structure 152 thus arranged in the prior-art keyboard unit, the end portion 170 of the key member 152 is first fitted to the frame structure 152 through the slot 166 in the vertical front panel portion 164 of the frame structure 152. Thereupon, the rear end portion of the key member 150 is passed through the opening 158 in the vertical rear end panel portion 156 of the frame structure 152 with the spring 160 located between the key member 150 and the flat panel portion 154 of the frame structure 152. At least three steps are thus required for the assembling of the key member 150 to the frame structure 152 and, for this reason, extremely large amounts of time and labor are necessitated for the assemblage of the keyboard unit which has a number of key members.

The present invention further contemplates elimination of this drawback of a prior-art keyboard unit through provision of a keyboard assembly in which the key members can be assembled to the frame structure of the keyboard assembly with a significantly reduced number of steps which will permit automatic assemblage of the keyboard assembly.

Figure 21:
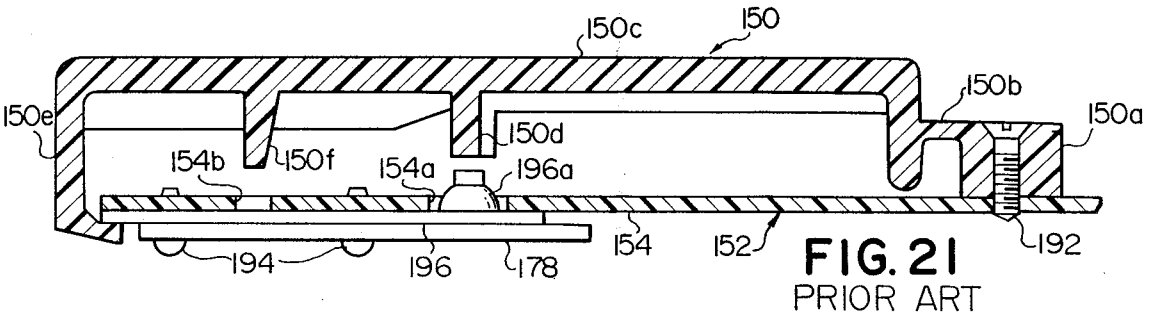
FIG. 21 PRIOR ART
FIG. 21 is a sectional view showing the arrangement in which a key member is mounted on a frame structure in a variant of the known keyboard unit illustrated in FIG. 20.

FIG. 21 shows a variant of the known keyboard unit of the type hereinbefore described with reference to FIG. 20. The keyboard unit herein shown is taught in, for example, Japanese Utility Model Publication No. 59-60694.

In the prior-art keyboard unit herein shown, a frame structure 152 has a horizontal flat panel portion 154 and a key member 150 having a rear end portion **150*a* merging through a hinge portion 150*b* out of a key body portion 150*c* is rockably assembled to the frame structure 152 with the rear end portion secured to the flat panel portion 154 by means of a screw 192. A printed circuit board 178 is securely attached to the underside of the flat panel portion 154 by means of screws 194 with a resilient insulator pad member 196 of rubber closely interposed between the panel portion 154 and the printed circuit board 178. The resilient insulator pad member 196 has a hollow protrusion 196*a* upwardly bulged toward a switch actuator portion 150*d* of the key member 150 through an opening 154*a* formed in the flat panel portion 154 of the frame structure 152. Within the hollow protrusion 196*a* of the insulator pad member 196 is located a movable contact element arranged in conjunction with a pair of stationary contact elements formed on the printed circuit board 178**, though not seen in the drawing.

The key member 150 further has a first stop portion **150*e* depending from the front end of the key body portion 150*c* and a second stop portion 150*f* located intermediate between the first stop portion 150*e* and the switch actuator portion 150*d* of the key member 150. The first stop portion 150*e* is at its lower end directed rearwardly of the key member 150 and is engageable with the lower face of the resilient insulator pad member 196 fixedly attached to the underside of the flat panel portion 154 of the frame structure 152. Thus, the first stop portion 150*e* of the key member 150 provides means to limit the upward stroke of the key member 150 with respect to the frame structure 152. On the other hand, the second stop portion 150*f* of the key member 150 is permitted to each the upper face of the resilient insulator pad member 196 through an aperture 154*b* formed in the flat panel portion 154 of the frame structure 152 as shown. Thus, the second stop portion 150*f* of the key member 150 provides means to limit the downward stroke of the key member 150 with respect to the frame structure 152**.

A drawback of the prior-art keyboard unit of the construction above described results from the lack of position restricting means by the aid of which the resilient insulator pad member 196 is to be correctly positioned with respect to the frame structure 152. If the insulator pad member 196 has failed to be correctly positioned with respect to the frame structure 152, the movable contact element accommodated within the hollow protrusion 196*a* thereof may be located out of alignment with the set of stationary contact elements on the printed circuit board 178 fastened to the pad member 196 and to the frame structure 152 by means of the screws 194. It may even happen that the hollow protrusion 196*a* of the insulator pad member 196 fails to be aligned with the switch actuator portion 150*d* of the key member 150 so that the actuator portion 150*d* could not actuate the movable contact element for movement into the position to contact the stationary contact elements on the printed circuit board 178. If this occurs when the key member 150 is depressed by a player of the electronic musical instrument into which the keyboard unit is incorporated, the musical instrument could not generate a sound of the note assigned to the particular key member 150. If the actuator portion 150*d* of the key member 150 is enabled to actuate the movable contact element but the movable contact element, which is not correctly located with respect to the stationary contact elements, may be brought into only limited portions of the stationary contact elements. This may lead to early wear or even to damage of the movable contact element during use of the musical instrument.

The present invention further contemplates elimination of these drawback of a prior-art keyboard unit through provision of a keyboard assembly in which the resilient insulator pad member forming part of the switch arrangement of the assembly can be correctly attached to the frame structure of the keyboard assembly easily and with a minimum number of steps.

It, accordingly, still another important object of the present invention to provide in a keyboard assembly of the type in which at least two key units each having a plurality of key members are assembled to a frame structure, there are provided means to make it easier than in a known keyboard assembly to have each of the key members fitted to the frame structure after the key member has been correctly positioned with respect to the frame structure during assembling of the keyboard assembly.

It is still another important object of the present invention to provide in a keyboard assembly of the type in which at least two key units each having a plurality of key members are assembled to a frame structure, there are provided means to enable the key units to be correctly positioned with respect not only to each other but also to the frame structure before the key units are to be securely fastened to the frame structure.

Description will be hereinafter made with reference to FIGS. 22 to 24 in respect of the construction of the frame structure 58 on which the key units 60, 62 and 64 constructed and arranged as hereinbefore described are mounted to accomplish such an object of the present invention.

Figure 22:
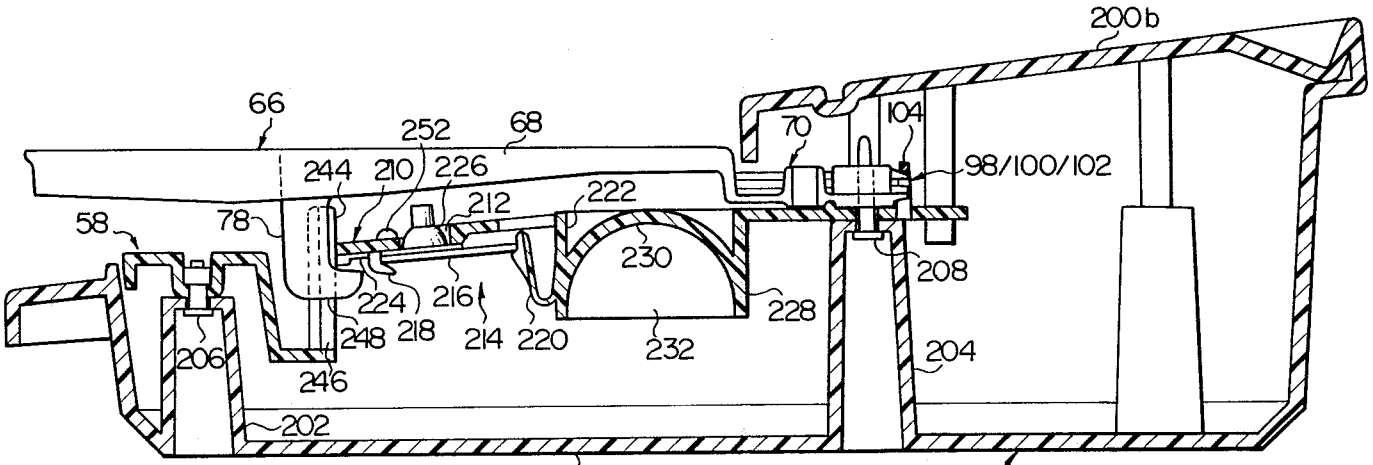
FIG. 22 is a vertical and fore-and-aft sectional view of the preferred embodiment of a keyboard assembly according to the present invention as adapted to overcome the drawback inherent in prior-art keyboard units of the types illustrated in FIGS. 20 and 21.

As illustrated in FIG. 22, the frame structure 58 is supported on a casing structure 200 and has its front and rear end portions secured to upstanding wall portions 202 and 204 of the casing structure 200 by suitable fastening means such as screws 206 and 208, respectively, as shown. The casing structure 200 is constructed of a molded unitary plastic article and has a lower portion 200*a* underlying the frame structure 58 and an upper portion 200*b* overlying a rear portion of the frame structure 58. The upstanding wall portion 104 formed with the openings 106 through which the lug portions 98, 100 and 102 of the key units 60, 62 and 64, respectively, are secured to the frame structure 58 as previously described is located in the vicinity of the rear end of the frame structure 58. The key units 60, 62 and 64 thus mounted on the frame structure 58 are arranged so that the individual key members 66 of the key units longitudinally extend over the frame structure 58.

Figure 23:
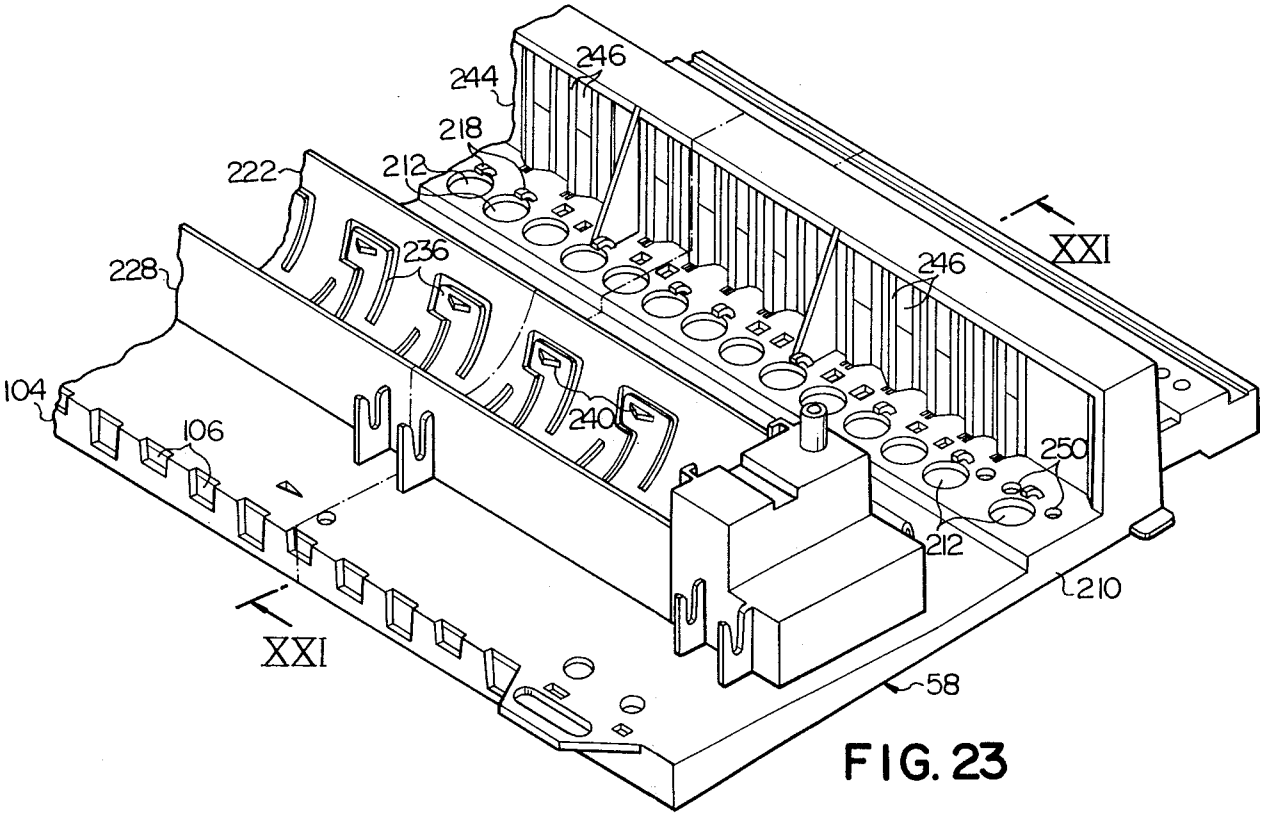
FIG. 23 is a perspective view of the frame structure, positioned upside down, which forms part of the keyboard assembly illustrated in FIGS. 22 to 24.
Figure 24:
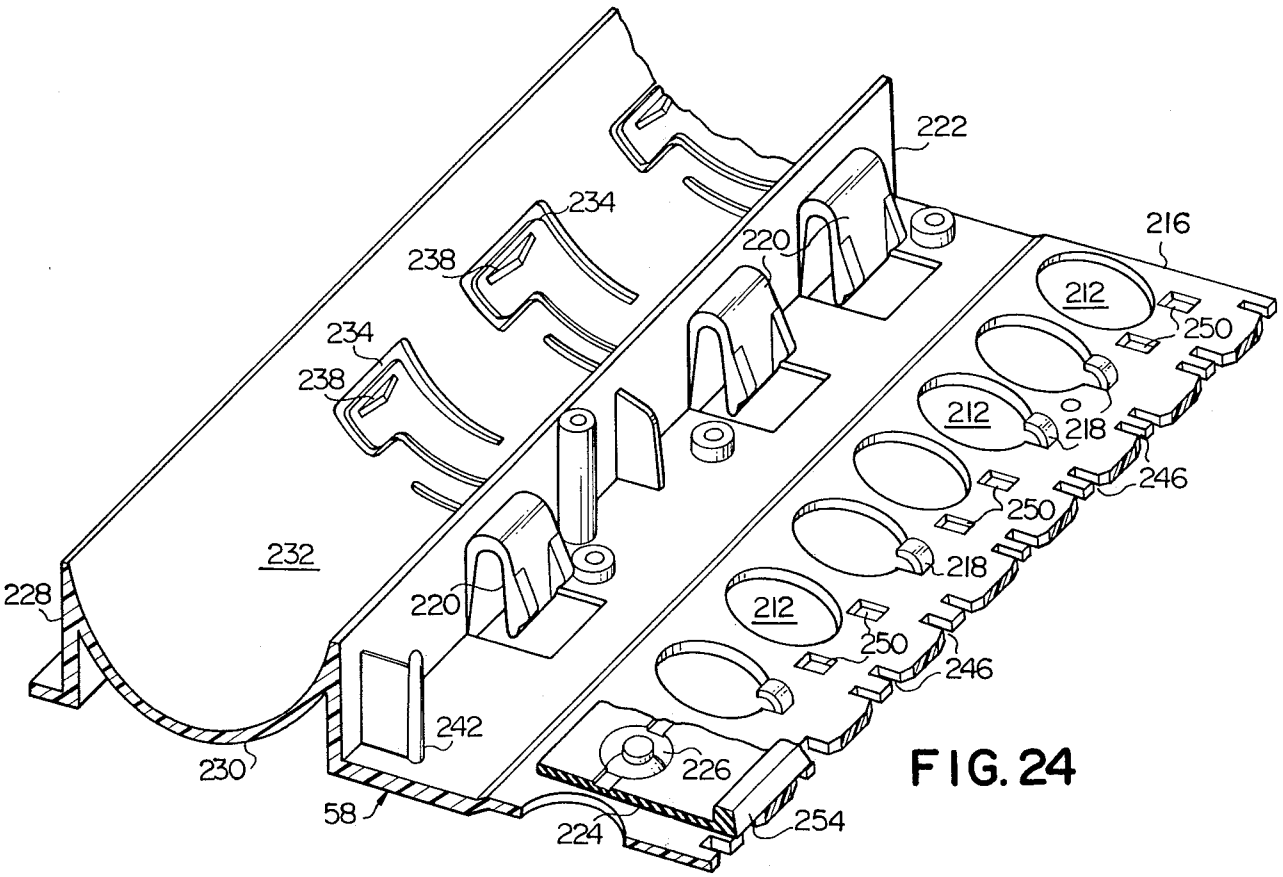
FIG. 24 is a fragmentary perspective view similar to FIG. 23 but shows a portion of the frame structure viewed in another direction with respect to the frame structure, the sectional view of FIG. 22 being taken along line XXI—XXI of FIG. 24.

The frame structure 58 has, in the second direction F (FIG. 4) of the keyboard assembly, a generally horizontal horizontal panel portion 210 elongated laterally of the frame structure 58, viz., in the first direction L (FIG. 4) of the keyboard assembly as will be also seen from FIGS. 23 and 24. In this horizontal panel portion 210 of the frame structure 58 are formed a plurality of circular openings 212 which are arranged in a single row in the first direction L (FIG. 4) of the keyboard assembly. These openings 212 are located vertically in alignment with the switch actuator portions 76 (FIG. 6) of the individual key members 66, respectively, of the key units 60, 62 and 64 to enable the switch actuator portions 76 to respectively engage and actuate pad member switch devices 214 also supported by the frame structure 58. These pad member switch devices 214 are provided in conjunction with a printed circuit board 216 which is held in generally horizontal position by means of hook portions 218 and leaf spring portions 220 of the frame structure 58. The hook portions 218 of the frame structure 58 project downwardly from the lower face of the horizontal panel portion 210 of the frame structure 58 and are arcuately curved toward below selected ones of the openings 212. The leaf spring portions 220 of the frame structure 58 are located in alignment with the hook portions 218 each in the second direction F (FIG. 4) of the keyboard assembly and protrude upwardly from a vertical wall portion 222 depending from the rear end of the horizontal panel portion 210. Each of the hook portions 218 is engageable with the printed circuit board 216 at the front end of the board 216 and each of the leaf spring portions 220 is engageable with the printed circuit board 216 at the rear end of the board 216. The printed circuit board 216 is thus held in position slightly below the horizontal panel portion 210 of the frame structure 58 by means of the hook portions 218 engaging the circuit board 216 at the front end of the board 216 and the leaf spring portions 220 which engage the circuit board 216 at the rear end of the board 216.

The printed circuit board 216 has an upper wired surface carrying printed patterns of various circuit elements and conductor lines and covered with an insulator coating (not shown) formed with openings through which some of the circuit elements and conductors applied to the upper surface of the circuit board 216 are in part exposed upwardly. On these exposed portions of the conductors are provided pairs of spaced stationary contact elements which are located to underly the openings 212 in the horizontal panel portion 210, though not seen in FIGS. 22 to 24 but as will be described in more detail. In association with each of these pairs of stationary contact elements is provided a movable contact element which is one of such elements commonly carried by a resilient insulator pad member 224 which is formed of, for example, rubber. The insulator pad member 224 is attached through the insulator coating to the printed circuit board 216 and, as will be seen particularly in FIG. 22, has a flat sheet portion and a generally bell-shaped hollow protuberant portion 226 bulging upwardly from the sheet portion. The hollow protuberant portion 226 of the insulator pad member 224 projects upwardly through one of the openings 212 in the horizontal panel portion 210 toward the switch actuator portion 76 of the key member 66. The insulator pad member 224 has its sheet portion closely but detachably forced against the underside of the horizontal panel portion 210 of the frame structure 58 by means of the printed circuit board 216 which has its rear portion forced toward the panel portion 210 by the leaf spring portions 220 of the frame structure 58.

Within the hollow protuberant portion 226 of the insulator pad member 224 is provided a movable contact element which is movable into and out of contact with the pair of stationary contact elements which underly the particular movable contact element. The resilient insulator pad member 224 is formed with a plurality of hollow protuberant portions each carrying such a movable contact element. The switch actuator portion 76 of each of the key members 66 of the key units 60, 62 and 64 projects toward each of these movable contact elements. When the key member 66 associated with the particular switch device 214 is depressed downwardly, the switch actuator portion 76 of the key member forces the protuberant portion 226 of the insulator pad member 224 to deform downwardly and thereby brings the movable contact element into contact with the associated pair of stationary contact elements.

The vertical wall portion 222 of the frame structure 58 is provided in association with another vertical wall portion 228 spaced apart in parallel from the wall portion 222. These parallel vertical wall portions 222 and 228 of the frame structure 58 are connected together by a semicylindrical wall portion 230 which is open downwardly to form a battery cell holder space 232 at the rear of the series arrangement of the pad member switch devices 214. Within the battery cell holder space 232 thus formed by the wall portions 222 are to be accommodated battery cells to provide a d.c. power source of the keyboard assembly, though not shown in the drawings. As will be seen from FIGS. 23 and 24, the semicylindrical wall portion 230 has strip portions 234 and 236 arranged in two parallel rows and having cell retainer elements 238 and 240, respectively, projecting into the battery cell holder space 232 to hold in position the battery cells accommodated in the space 232. Integral with the vertical wall portion 222 are locating pins one of which is indicated at 242. The locating pins 242 project downwardly from the underside of the horizontal panel portion 210 of the frame structure 58 and are arranged in conjunction with the switch arrangement including the printed circuit board 216. These locating pins 242 are used for holding the printed circuit board 216 in a correct position with respect to the frame structure 58 during assembling of the printed circuit board 216 to the frame structure 58, as will be described in more detail.

The frame structure 58 further has a vertical panel portion 244 located in front of the horizontal panel portion 210 and merging downwardly out of the panel portion 210. In this vertical panel portion 244 of the frame structure 58 are located portions of pairs of parallel slots 246 formed in the frame structure 58. Each of the slots extends in part vertically in the panel portion 244 and in part horizontally in the horizontal panel portion 210 as will be seen from FIG. 5. Each pair of slots 246 is provided in association with each of the openings 212 in the horizontal panel portion 210 and has the previously mentioned pair of spaced guide portions 78 of the key member 66 received therein in a manner to allow the guide portions 78 to move upwardly and downwardly through the slots 246. When the key member 66 is depressed to turn downwardly about the torsional coupling portion 70 thereof under the pressure exerted by a player's finger touch, the guide portions 78 of the key member 66 will be brought into contact with the edges forming the lower ends of the slots 246 and are restricted from further moving downwardly. The slots 246 are thus sized so that the lower ends thereof are located to bring the key member 66 to a stop when the key member 66 has been turned downwardly through a predetermined length of stroke from the initial position of the key member 66 with respect to the frame structure 58. Thus, the guide portions 78 of the key member 66 and the slots 246 in the frame structure 58 provide means to limit the downward stroke of the key member 66 about the torsional coupling portion 70 thereof. The resilient insulator pad member 224 which forms part of the switch arrangement as above described has its front edge located close to the inner, or rear, face of the vertical front panel portion 244 of the frame structure 58 as will be seen in FIGS. 5 and 22.

The key member 66 further has a pair of rearwardly directed lower hook portions 248 merging downwardly out of the guide portions 78, respectively, of the key member 66 and extending underneath the horizontal panel portion 210 of the frame structure 58 within the length of the horizontal portions of the slots 246 in the panel portion 210. When the key member 66 once depressed to turn downwardly is released from the player's finger touch and is thus allowed to return upwardly toward the initial position thereof, the rearwardly directed lower hook portions 248 will be brought into engagement with a front end portion of the insulator pad member 224 attached to the underside of the horizontal panel portion 210 of the frame structure 58 and is restricted from further moving upwardly. Thus, the guide portions 78 of the key member 66, the slots 246 in the frame structure 58 and the front end portion of the insulator pad member 224 provide means to limit the upward stroke of the key member 66 with respect to the frame structure 58.

In the horizontal panel portion 210 of the frame structure 58 are further formed a plurality of pairs of apertures 250 which are arranged in a row between and parallel with the row of the openings 212 and the row of the slots 246 in the frame structure 58. Each pair of apertures 250 is located in association with a selected one of the openings 212. The resilient insulator pad member 224 forming part of the above described switch arrangement including the pad member switch devices 214 has a plurality of pairs of upward projections 252 (FIGS. 5 and 22) which are arranged in a row located in registry with the row of the apertures 250. These upward projections 252 of the insulator pad member 224 are respectively aligned with and project upwardly into the apertures 250 in the frame structure 58 as will be seen from FIG. 5 so as to be engageable with the key body portion 68 of the key member 66 when the key member 66 is downwardly turned toward the frame structure 58. Thus, the apertures 250 in the frame structure 58 and the projections 252 of the insulator pad member 224 also provide means to limit the downward stroke of the key member 66 about the torsional coupling portion 70 thereof. The apertures 250 and projections 252 further provide means to enable the insulator pad member 224 to be positioned correctly with respect to the frame structure 58 during assemblage of the keyboard assembly.

Figure 25:
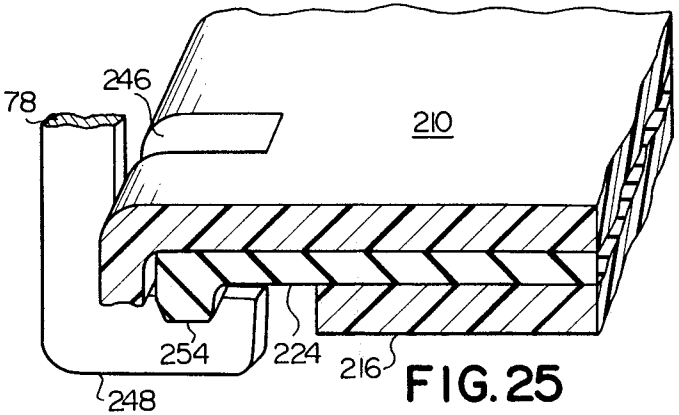
FIG. 25 is a fragmentary perspective view showing, to an enlarged scale, portions of the arrangement illustrated in FIG. 22.

The resilient insulator pad member 224 forming part of the switch arrangement has a bead or elongated rib portion 254 continuously extending along its front edge as illustrated in part in FIG. 24. The front edge of the insulator pad member 224 being located close to the inner or rear face of the vertical front panel portion 244 of the frame structure 58, the elongated rib portion 254 of the insulator pad member 224 extends along the inner or rear face of the vertical front panel portion 244 of the frame structure 58. As described previously, the insulator pad member 224 has its front end portion closely but detachably forced against the lower face of the horizontal panel portion 210 of the frame structure 58 with the rear portion of the printed circuit board 216 forced toward the panel portion 210 by means of the leaf spring portions 220 of the frame structure 58. Thus, the rib-fringed front end portion of the insulator pad member 224 closes the horizontally extending portions of the slots 246 located in the horizontal panel portion 210 of the frame structure 58, as will be seen from FIG. 25.

When the key member 66 once depressed to turn downwardly is released from the player's finger touch and is allowed to return upwardly toward the initial position thereof, the rearwardly directed lower hook portions 248 of the key member 66 are brought into contact with the rib portion 254 of the insulator pad member 224 forced against the underside of the horizontal panel portion 210 of the frame structure 58 and is restricted from further moving upwardly. Accordingly, the previously mentioned means to limit the upward stroke of the key member 66 about the torsional coupling portion 70 thereof is, more exactly, comprised of not only the guide portions 78 of the key member 66 and the slots 246 in the frame structure 58 but also the rib portion 254 of the insulator pad member 224.

The resilient insulator pad member 224 is forced against the underside of the horizontal panel portion 210 of the frame structure 58 but has its front end portion resiliently deformable away from the lower face of the panel portion 210 of the frame structure 58. This nature of the resilient insulator pad member 224 is useful during assemblage of the key member 66 to the frame structure 58.

Description will be hereinafter made regarding the manners in which the casing structure 200, frame structure 58 and key units 60, 62 and 64 each having the key members 66 are to be assembled together. Prior to the assembling of the key units 60, 62 and 64 to the frame structure 58, the switch devices 214 forming the switch arrangement are attached to the frame structure 58. For this purpose, the frame structure 58, which at this stage is separate from the casing structure 200, is positioned upside down and the resilient insulator pad member 224 is placed on the inner, or now upper, face of the horizontal panel portion 210 of the frame structure 58. The insulator pad member 224 is positioned so that the individual projections 252 formed thereon are correctly received in the respectively assigned apertures 250 in the horizontal panel portion 210 of the frame structure 58. With the pad member 224 thus positioned on and with respect to the horizontal panel portion 210 of the frame structure 58, the protuberant portions 226 of the pad member 226 carrying the movable contact elements accurately project now downwardly through the circular openings 212, respectively, in the horizontal panel portion 210. In addition, the elongated rib portion 254 of the pad member 224 extends along the corner between the horizontal panel portion 210 and vertical front panel portion 224 of the frame structure 58.

Figure 26:
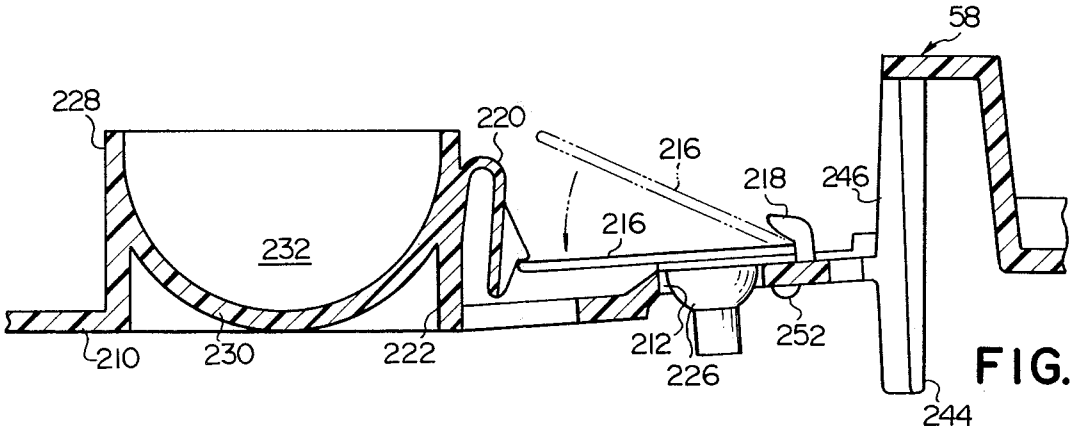
FIG. 26 is a fragmentary sectional view showing the arrangement in which a printed circuit board and an associated switch device forming part of the keyboard assembly illustrated in FIGS. 22 to 24 are being assembled to the frame structure of the keyboard assembly.

The printed circuit board 216 is then attached to the insulator pad member 224 and is positioned correctly with respect to the frame structure 58 with use of the locating pins 242 upstanding from the panel portion 210 of the frame structure 58 which is now assumed to be positioned upside down. For this purpose, the printed circuit board 216 is first fitted at its front edge to the hook 218 of the frame structure 58 as indicated by phantom lines in FIG. 26 and then turned about the front edge thereof toward the inner or not upper face of the panel portion 210 of the frame structure 58. While the printed circuit board 216 is thus turned toward the panel portion 210 of the frame structure 58, the rear edge of the circuit board 216 will be forced against slanting surfaces of the leaf spring portions 220 of the frame structure 58 and will cause the spring portions 220 to slightly deform toward the vertical wall portion 222 of the frame structure 58. The printed circuit board 216 will in the result be assuredly engaged at its rear edge by the leaf spring portions 220 and, engaged by the locking pins 242, will be held in a correct position with respect to the frame structure 58.

The printed circuit board 216 having thus been held in position with respect to the frame structure 58, the resilient insulator pad member 224 is closely interposed between the horizontal panel portion 210 of the frame structure 58 and the printed circuit board 216. The movable contact elements carried by the protuberant portions 226 of the pad member 224 are now correctly located in alignment with the respectively associated pairs of stationary contact elements on the printed circuit board 216. After the insulator pad member 224 and printed circuit board 216 have thus been attached to the frame structure 58, the frame structure 58 may be inverted to have its inside directed downward.

Figure 8:
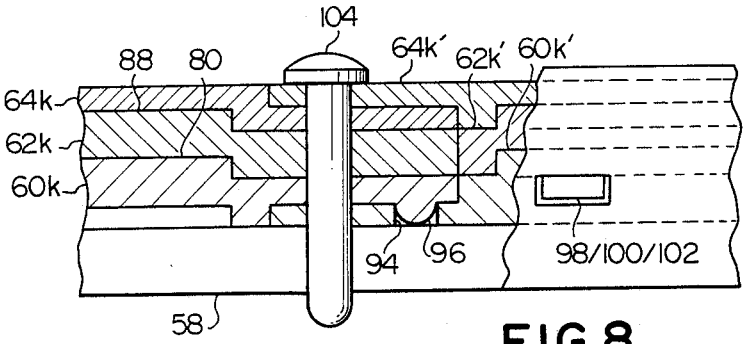
FIG. 8 is a fragmentary sectional view showing the configuration of end portions of the bracket members of the key units of two combinations of key units securely combined together.

Each of the key units 60, 62 and 64 each having a plurality of key members 66 as hereinbefore described is then assembled to the frame structure 58. For this purpose, the individual key units 60, 62 and 64 are positioned correctly with respect to each other by the aid of the first, second and third position restricting means described with reference particularly to FIGS. 3 and 4. Any of the key members 66 of the key units 60, 62 and 64 thus positioned with respect to the frame structure 58 may be at this point of time adjusted for proper position with respect to the other key members 66 with the key body portion 68 (FIG. 5) of the key member 66 manually moved with respect to the lateral bracket portion **60*k*, 62*k* or 64*k* common to the key members 66 of each key unit through deformation of the torsional coupling portion 70 of the particular key member 60. The key units 60, 62 and 64 thus positioned correctly with respect to each other are then positioned with respect to the frame structure 58 with the aid of the lug portions 98, 100 and 102 providing the assembling means of the key units as previously described. The resultant assembly of the key units 60, 62 and 64 is then securely fastened to the frame structure 58 with use of the screws or studs such as the studs 114 as shown in FIG. 8**.

Figure 27:
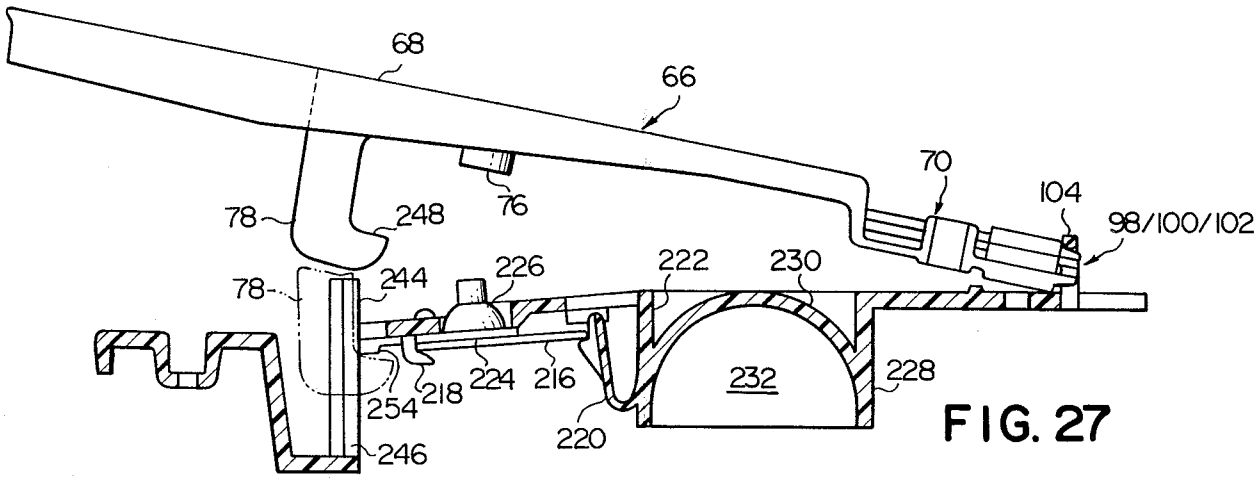
FIG. 27 is a fragmentary sectional view showing the arrangement in which one of the key members of a key unit also forming part of the keyboard assembly illustrated in FIGS. 22 to 24 is being assembled to the frame structure of the keyboard assembly.
Figure 28:
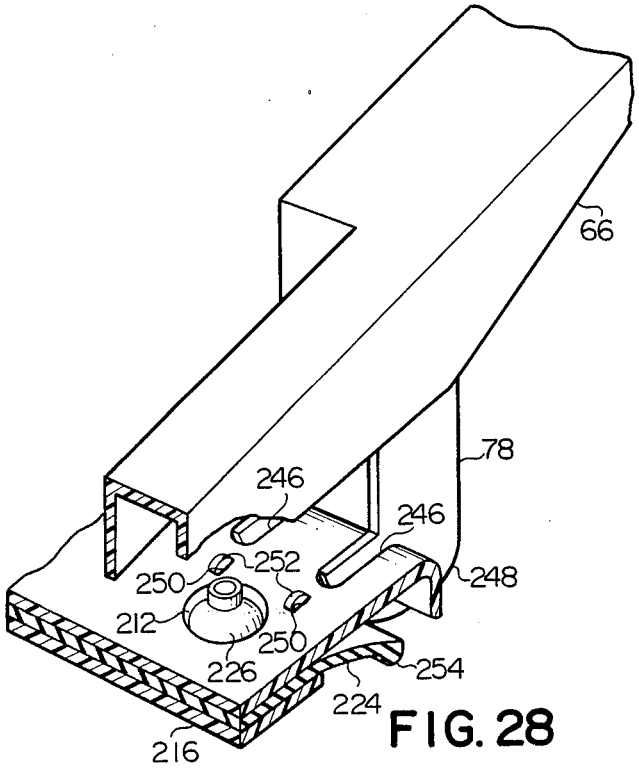
FIG. 28 is a fragmentary perspective view also showing the arrangement in which one of the key members of the key unit is being assembled to the frame structure of the keyboard assembly.

When the key units 60, 62 and 64 are thus assembled to the frame structure 58, the portions which the slots 246 in the frame structure 58 have in the horizontal panel portion 210 of the frame structure 58 are closed by the rib-fringed front end portion of the resilient insulator pad member 224, as previously described. After the key units 60, 62 and 64 are assembled to the frame structure 58, the guide portion 78 of each of the key members 66 of the key units 60, 62 and 64 is fitted to the frame structure 58 through the slots 246 in the frame structure 58. For this purpose, each key unit is turned with respect to the frame structure 58 about the lug portions 98, 100 or 102 of the key unit from an angular position indicated by full lines in FIG. 27 toward an angular position having the guide portion 78 located as indicated by phantom lines in FIG. 27. As the key unit is thus turned downwardly, the rearwardly directed lower hook portions 248 of each key member 66 are forced downwardly against the rib-fringed front end portion of the pad member 224 through the horizontal portions of the slots 246 in the horizontal panel portion 210 and cause the front end portion of the pad member 224 to resiliently warp away from the inner or lower face of the panel portion 210 of the frame structure 58 as will be seen from FIG. 28. The hook portions 248 of the key member 66, moving into the vertical portions of the slots 246 in the panel portion 244 of the frame structure 58, has its lower edge portion and thereafter its rear edge portion forced to slide on the front edge of the insulator pad member 224 until the hook portions 248 of the key member 66 slips off the pad member 224. The resilient insulator pad member 224 thus liberated from the portions 248 of the key member 66 is allowed to have its rib-fringed front end portion deformed back into contact with the lower face of the horizontal panel portion 210 of the frame structure 58. The hook portions 248 of the key member 66 are now held in contact with the rib portion 254 of the insulator pad member 224 and is accordingly prevented from being moved out of the slots 246 upwardly beyond the insulator pad member 224. After the key members 66 of all the key units 60, 62 and 64 have been fitted to the frame structure 58 in these manners, the frame structure 58 is secured to the upstanding wall portions 202 and 204 of the casing structure 200 with use of the screws 206 and 208, respectively, as shown in FIG. 22.

As will have been understood from the foregoing description, the resilient insulator pad member 224 included in the switch arrangement of the keyboard assembly provides part of means to limit the downward and upward strokes of the key members 66 with respect to the frame structure 58. The means to limit the downward stroke of the key members 66 is implemented in part by the projections 252 of the insulator pad member 224 and the means to limit the downward stroke of the key members 66 is in part implemented by the rib-fringed front end portion of the insulator pad member. The projections 252 of the insulator pad member 224 further provide means to enable the insulator pad member 224 positioned correctly with respect to the frame structure 58 during assemblage of the keyboard assembly.

It will thus been understood that the use of the resilient insulator pad member 224 providing such means in addition to the role which the pad member 224 plays in the switch arrangement significantly contributes to reduction of the number of component part of the keyboard assembly and will accordingly make it to easy and simple to assemble the keyboard assembly. In addition, the provision of the rib portion 254 on the insulator pad member 224 makes it simpler to have the key members 66 of the key units 60, 62 and 64 assembled to the frame structure 58 of the keyboard assembly as compared to the prior-art arrangement described with reference to FIG. 20. It will be further understood that the apertures 250 and projections 252 provided in the embodiment of a keyboard assembly hereinbefore described are adapted to enable the insulator pad member 224 to be positioned correctly with respect to the frame structure 58 during assemblage of the keyboard assembly and thus overcomes the drawback inherent in a prior-art keyboard unit of the type hereinbefore described with reference to FIG. 21.

Figure 29:
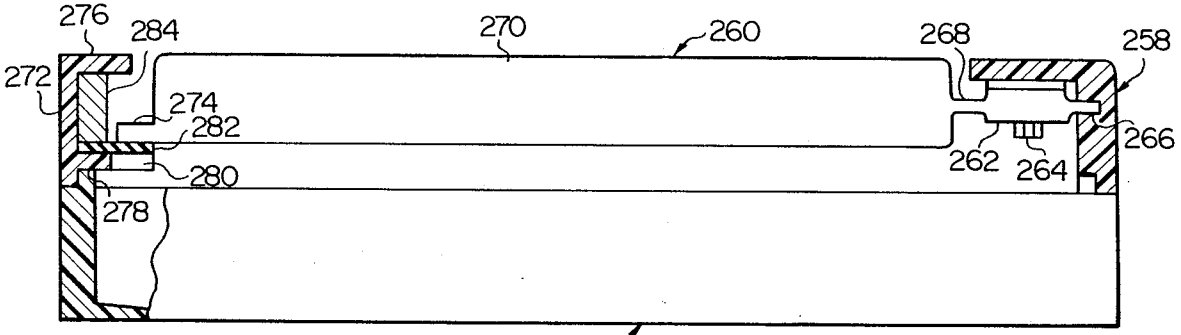
FIG. 29 is a fragmentary side elevation view schematically showing a key unit forming part of still another modification of the keyboard assembly illustrated in FIGS. 22 to 24.

FIG. 29 shows a modification of the keyboard assembly hereinbefore described with reference to FIGS. 22 to 24. The keyboard assembly herein shown particularly features the provision of means similar in effect to the additional means provided by the insulator pad member 224 of the switch arrangement of the keyboard assembly described with reference to FIGS. 22 to 24.

As shown, the modified keyboard assembly comprises a lower casing structure 256 and an upper frame structure 258 positioned on the casing structure 256. Within the lower casing structure 256 is housed a set of switch devices arranged in conjunction with a printed circuit board, though not shown. The upper frame structure 258 is open upwardly and has accommodated therein a plurality of key members 260 which may be similar to those of the key units used in the keyboard assembly embodying the present invention as has been hereinbefore described or may be provided as separate members as in an ordinary keyboard assembly. Each of the key members 260 has a rear end portion 262 securely fastened to the frame structure 258 by means of, for example, a screw 264 and is positioned correctly with respect to the frame structure 258 by the aid of a projection 266 projecting rearwardly from the rear end portion 262 thereof. The projection 266 of the key member 260 is fitted into a recess formed a vertical rear end wall portion of the frame structure 258 as in the case of the key members 66 of the hereinbefore described embodiment. Each of the key member 262 is assumed to further has a hinge portion 268 through which the rear end portion 262 of the key member 260 forwardly merges into a key body portion 270. The hinge portion 268 is elastically deformable so that the key body portion 270 of the key member 260 is rockable about an axis parallel with the row of the key members 260, viz., in the first direction L (FIG. 4) of the keyboard assembly embodying the present invention.

The key body portion 270 of each of the key members 260 forwardly extends in the frame structure 258 and has a front projection 274 projecting toward and located immediately at the rear of a vertical front end wall portion 272 of the frame structure 258. The frame structure 258 further has an upper rim portion 276 projecting rearwardly from the upper end of the vertical front end wall portion 272 and extending along the end wall portion 272 laterally of the frame structure 258, and a lower rib portion 278 also projecting rearwardly from the front end wall portion 272 and extending below and in parallel with the upper rim portion 276. The rib portion 278 of the frame structure 258 is formed with a number of parallel slots 280 arranged in a row laterally of the frame structure 258. A resilient pad member 282 in the form of, for example, an elongated strip of rubber has a front portion attached to the upper face of the lower rib portion 278 and a rear portion overlying one of the slots 280 thus formed in the rib portion 278. The front portion of the resilient pad member 282 is forced against the upper face of the rib portion 278 by means of a retaining element 284 which is closely interposed between the upper rim portion 276 of the frame structure 258 and the front portion of the resilient pad member 278 as shown. When the key member 260 is depressed to turn downwardly about the hinge portion 268 thereof, the front projection 274 of each of the key members 260 is brought into contact with the rear portion of the resilient pad member 282 and is thus prevented from being moved downwardly beyond the resilient pad member 282. Thus, the resilient pad member 282 provides means to limit the downward stroke of the key member 260 with respect to the frame structure 258.

To have the key members 260 assembled to the frame structure 258, each of the key members 260 is positioned correctly with respect to the frame structure 258 by the aid of the rear projection 266 of the key member 260 and is thereafter secured to the frame structure 258 by means of the screw 264. The frame structure 258 at this stage of assembly is separate from the casing structure 256 but has the resilient pad member 282 already fitted thereto with the aid of the retaining element 284. It may be noted that the key members 260 now extending forwardly from the rear end wall portion could not clear over the upper rim portion 276 of the frame structure 258 and accordingly could not be moved into position from the upper side of the frame structure 258. In securing the key members 260 to the frame structure 258 by means of the screws 264, it is thus important that each of the key members 260 has its key body portion 270 located below the frame structure 258 which is separate from the casing structure 256.

After the individual key members 260 are secured to the frame structure 258 at their rear ends, each key member is turned with respect to the frame structure 258 to an angular position having the front projection 274 brought into contact with the lower face of the rear portion of the resilient pad member 282 through one of the slots 280 in the rib portion 278 of the frame structure 258. The projection 274 of the key member 260 is then pressed upwardly against the rear portion of the resilient pad member 282 to cause the pad member 282 to resiliently warp away from the rib portion 278 until the projection 274 of the key member 260 slips off the resilient pad member 282. The resilient pad member 282 is thus liberated from the projection 274 of the key member 260 and is allowed to have its rib-fringed front end portion deformed back into the position closing the slot 280 through which the projection 274 of the key member 260 has passed. After all the key members 260 have been fitted into the frame structure 258 in these manners, the frame structure 258 is secured to the casing structure 256 with use of, for example, screws.

As will have been understood from the foregoing description, the resilient pad member 282 included in the described arrangement provides part of means to limit the downward stroke of the key members 260 with respect to the frame structure 258. Furthermore, the provision of the deformable resilient pad member 282 makes it simpler to have the key members 260 assembled to the frame structure 258 of the keyboard assembly as compared to the prior-art arrangement described with reference to FIG. 20.

Figure 30:
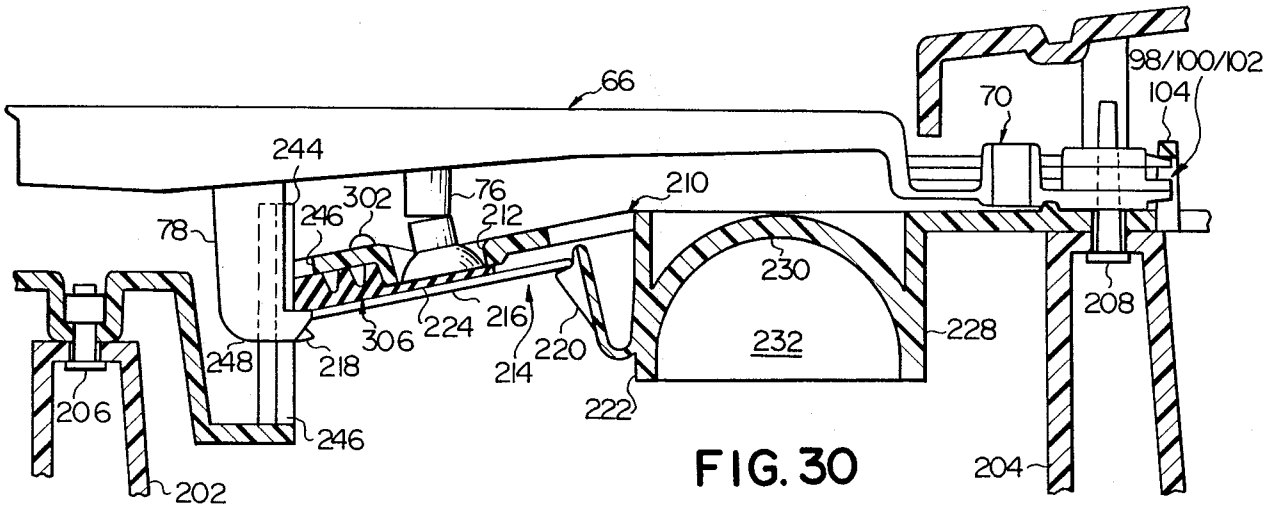
FIG. 30 is a fragmentary sectional view of another modification of the keyboard assembly illustrated in FIGS. 22 to 24.

FIG. 30 shows another modification of the keyboard assembly described with reference to FIGS. 22 to 24, FIG. 31 being a fragmentary sectional view showing, to an enlarged scale, portions of the keyboard assembly illustrated in FIG. 30. It may be noted that the members partially shown in FIG. 31 are at a stage of being assembled together to provide the arrangement illustrated in FIG. 30.

Figure 31:
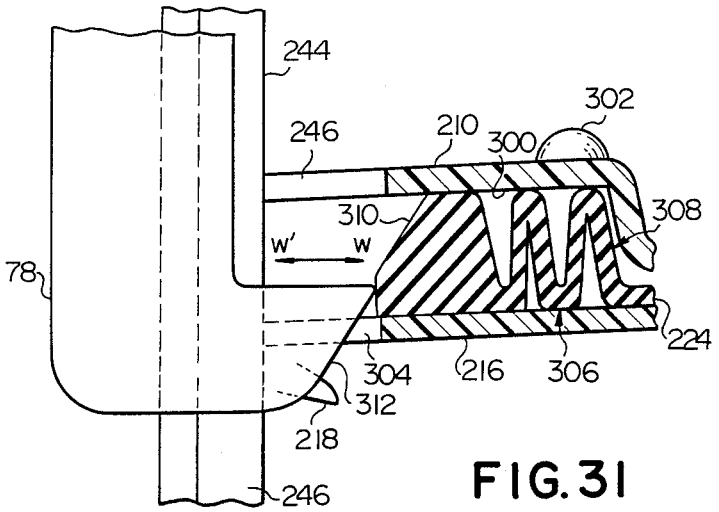
FIG. 31 is a fragmentary sectional view showing, to an enlarged scale, portions of the keyboard assembly illustrated in FIG. 30.

In the embodiment shown in these FIGS. 30 and 31, the horizontal panel portion 210 of the frame structure 58 is slightly raised over a front end portion of the resilient insulator pad member 224 to form a cavity 300 (FIG. 31) between the raised portion of the frame structure 58 and the front end portion of the insulator pad member 224. Projections 302 to provide the means to limit the downward stroke of the key member 66 are formed on the upper surface of the raised portion of the frame structure 58. Furthermore, the hook portions 218 to have the printed circuit board 216 retained to the frame structure 58 at the front end of the board 216 project not from the horizontal panel portion 210 but from the vertical panel portion 244 of the frame structure 58 as indicated by broken lines in FIG. 31. The printed circuit board 216 for use in the keyboard assembly herein shown has a front end portion formed with a row of slots 304 which are respectively aligned with the slots 246 in the frame structure 58. Accordingly, the rearwardly directed hook portions 248 of the key member 66 are passable not only through the slots 246 in the frame structure 58 but through these slots 304 in the printed circuit board 216.

The resilient insulator pad member, now represented by numeral 306, used in the keyboard assembly herein shown has a rear portion partially in the form of a flat sheet closely interposed between the printed circuit board 216 and the horizontal panel portion 210 of the frame structure 58 and partially in the form of a protuberance providing the protuberant portion 226 carrying the movable contact element therein. The insulator pad member 306 further has a bellows-shaped front end portion 308 formed with ridges and furrows each extending in the first direction L (FIG. 4) of the keyboard assembly and alternately arranged in the second direction F of the keyboard assembly. As will be better seen from FIG. 31, the bellows-shaped rear end portion 308 of the insulator pad member 306 has a guide surface 310 slanting downwardly and forwardly from the upper surface of the portion 308. In conjunction with this slanting guide surface 310 of the insulator pad member 306, each of the rearwardly directed hook portions 248 of the key member 66 has a slanting surface 312 inclined conformingly to the guide surface 310 of pad member 306.

During assembling of the key members 66 to the frame structure 58, each of the key members 66 is positioned correctly with respect to the frame structure 58 by the aid of the rear lug portion 98, 100 or 102 of the key member 66 and is thereafter secured to the frame structure 258 by means of a screw which is not herein shown. The frame structure 58 at this stage of assembly has the resilient pad member 306 already fitted thereto with the printed circuit board 216 retained by the hook portions 218 and leaf spring portions 220 of the frame structure 58. At an initial stage of assembly, the bellows-shaped front end portion 308 of the resilient insulator pad member 306 is allowed to stay in a position having its front end face held i contact with the inner face of the vertical panel portion 244 of the frame structure 58 and has its guide surface 310 located below the horizontal portions of the slots 246 in the frame structure 58.

After the individual key members 66 are secured to the frame structure 58 at their rear ends, each key member 66 is turned with respect to the frame structure 58 counterclockwise in FIGS. 30 and 31 so that the hook portions 248 of the key member are admitted downwardly into the slots 246 in the frame structure 58 and have their slanting surfaces 312 brought into pressing and sliding contact with the guide surface 310 of the insulator pad member 306. It therefore follows that the below-shaped front end portion 308 of the insulator pad member 306 has its guide surface 310 pressed upon rearwardly and is forced to collapse or shrink rearwardly with respect to the frame structure 58 as indicated by arrowhead w. As the key member 66 is turned and its hook portions 248 moved downwardly through the slots 246 in the frame structure 58, the bellows-shaped portion 308 of the insulator pad member 306 is resiliently compressed and spaced apart farther from the vertical panel portion 244 of the frame structure 58 until the hook portions 248 of the key member 66 slip off the insulator pad member 306 and allowed to pass through the slots 304 in the printed circuit board 216. The resilient pad member 306 being thus liberated from the lower hook portions 248 of the key member 66, the bellows-shaped front end portion 306 of the pad member 306 is allowed to expand and move in the direction of arrow w' into contact with the inner face of the vertical panel portion 244 of the frame structure 58. The hook portions 248 of the key member 66 are now held in contact with the underside of the bellows-shaped portion 308 of the insulator pad member 306 and is accordingly prevented from being moved upwardly out of the slots 246 beyond the insulator pad member 306.

Figure 32:
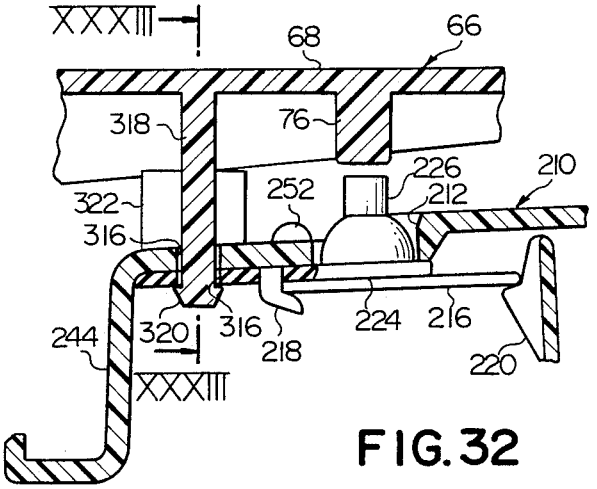
FIG. 32 is a fragmentary sectional view showing still another modification of the keyboard assembly illustrated in FIGS. 22 to 24.
Figure 33:
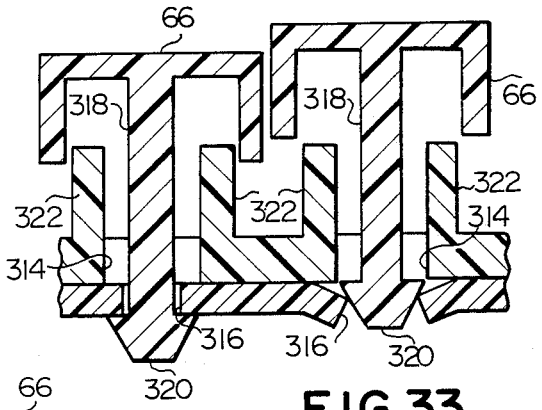
FIG. 33 is a sectional view taken along line XXXIII—XXXIII of FIGS. 31.

FIGS. 32 and 33 show portions of still another modification of the keyboard assembly described with reference to FIGS. 22 to 24. In the arrangement herein shown, the frame structure 58 has a plurality of apertures 314 formed in its horizontal panel portion 210 and, likewise, the resilient insulator pad member 224 has a plurality of apertures 316 formed in its front end portion. The apertures thus formed in each of the frame structure 58 and insulator pad member 224 are arranged in a row parallel with the row of the key members 66 and are located to be respectively associated with the individual key members 66 as will be seen from FIG. 32. The row of apertures 314 provided in the frame structure 58 and the row of apertures 316 provided in the insulator pad member 224 are vertically aligned with each other and the apertures 314 and 316 are sized so that each of the apertures 316 in the insulator pad member 224 is slightly smaller in diameter than each of the apertures 314 in the frame structure 58.

The key member 66 has a stem portion 318 projecting downwardly from the key body portion 68 thereof in alignment with one of the apertures 314 in the frame structure 58 and the aperture 316 in the insulator pad member 224 aligned with the former aperture 314. The stem portion 318 of the key member 66 is smaller in diameter than the apertures 314 and 316 and loosely extends through these aligned apertures 314 and 316 in the frame structure 58 and insulator pad member 224, projecting downwardly from the insulator pad member 224. The stem portion 318 merges downwardly into an enlarged, generally frusto-conical tip portion 320 which is continuously reduced in diameter toward its lower end. The tip portion 320 has at its upper end a diameter which is approximately equal to the diameter of the aperture 314 in the frame structure 58 and significantly larger than the diameter of the aperture 316 in the insulator pad member 224.

The frame structure 58 further has a pair of spaced parallel guide portions 322 upstanding from the horizontal panel portion 210 of the frame structure 58 and located in diametrically opposite relationship across each of the apertures 134 provided in the panel portion 210. The spacing between the guide portions 322 of each pair is equal to the diameter of the aperture 314 located between the guide portions 322 as will be seen from FIG. 32.

As each of the key members 66 is turned downwardly with respect to the frame structure 58 after the key members 66 are secured to the frame structure 58 at their rear ends during assembling of the key members 66 to the frame structure 58, the enlarged end portion 320 of each of the stem portions 318 of each key member 66 is passed through the space between the guide portions 322 of the frame structure 58 and is then admitted into the aperture 314 in the 58. As the key member 66 is further turned downwardly with respect to the frame structure 58, the enlarged frusto-conical end portion 320 of the key member 66 is admitted at its leading end into the aperture 316 in the resilient insulator pad member 224 and is brought into pressing contact with the edge defining the aperture 316. The edge portion of the resilient insulator pad member 224 around the aperture 316 is accordingly forced deform downwardly with consequent enlargement in the aperture 316 as will be seen from part of FIG. 32. As the stem portion 318 of the key member 66 is moved downwardly, the aperture 316 in the insulator pad member 224 is thus progressively enlarged by the frusto-conical end portion 320 of the stem portion 318 until the hook portions 248 of the key member 66 finally slip off the insulator pad member 224 and allowed to pass through the aperture 316 in the pad member 224. The resilient pad member 224 being thus liberated from the lower hook portions 248 of the key member 66, the edge portion of the resilient insulator pad member 306 around the aperture 316 is allowed to resume its initial position flush with the surrounding portion of the pad member 224. The enlarged frusto-conical end portion 320 of the stem portion 318 of the key member 66 now has its upper end face held in contact with the underside of the insulator pad member 224 and is accordingly prevented from being moved upwardly out of the aperture 316 beyond the insulator pad member 224.

Figure 34:
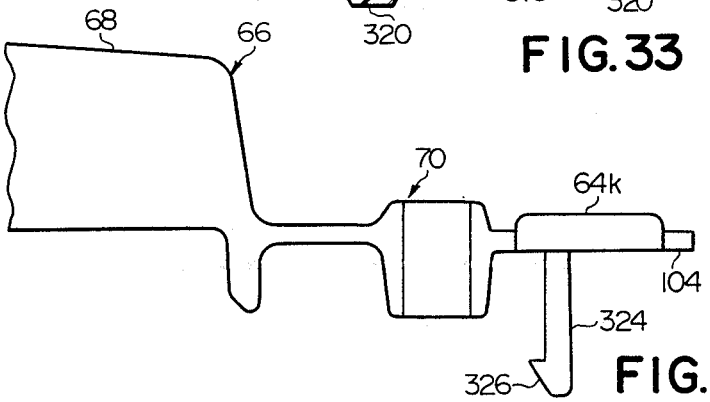
FIG. 34 is a fragmentary side elevation view showing a key unit forming part of still another modification of the keyboard assembly illustrated in FIGS. 22 to 24.

FIG. 34 shows a key unit which forms part of still another modification of the keyboard assembly described with reference to FIGS. 22 to 24. The key unit herein shown is similar to any one of the key units 60, 62 and 64 but is assumed by way example to be similar to the black key unit 64, thus having a lateral bracket portion **64*k* merging rearwardly out of the coupling portion 70 of the individual key members 66 and a plurality of rear projections 102 projecting rearwardly from the bracket portion 102*k***.

In the key unit 64 illustrated in FIG. 34, the lateral bracket portion **64*k* has in addition to the rear projections 102 a plurality of stem portions 324 each extending downwardly from the bracket portion 64*k* and forwardly directed at its lower end. As illustrated to an enlarged scale in FIG. 35, each of the stem portions 324 has a front face slightly slanting forwardly and downwardly and downwardly merges into a lower hook portion 326. The lower hook portion 326 protrudes forwardly and downwardly from the stem portion 324 and has a front guide surface 328 slanting forwardly and upwardly from the lower end of the hook portion 326. The length of the stem portion 324 is approximately equal to or slightly larger than the thickness of the horizontal panel portion 210 of the frame structure 58** which is indicated by phantom lines.

Figure 35:
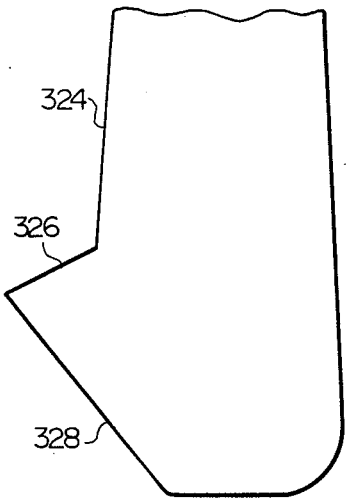
FIG. 35 is a fragmentary side view showing, to an enlarged scale, part of a hook portion of the key unit illustrated in FIG. 34.
Figure 36:
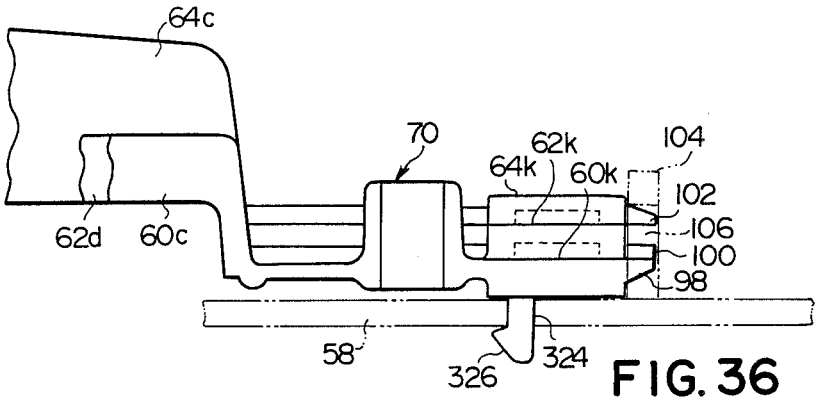
FIG. 36 is a fragmentary side elevation view showing a combination of a plurality of key units each essentially similar to the key unit illustrated in FIG. 34.
Figure 37:
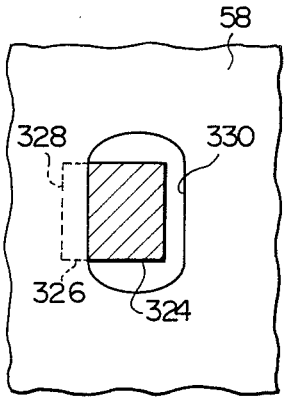
FIG. 37 is a fragmentary plan view showing a portion of the frame structure provided in association with the key unit illustrated in FIG. 34.

FIG. 36 show the combination of the key units 60, 62 and 64 each of which has portions similar to the stem and hook portions 324 and 326 of the key unit 64 as hereinbefore described with reference to FIGS. 34 and 35. The respective lateral bracket members 60*k*, 62*k* and 64*k* of the key units 60, 62 and 64 are placed on one another and have their respective rear lug portions 98, 100 and 102 fitted into the openings 106 provided in the vertical rear wall portion 104 of the frame structure 58 as previously described with reference to FIG. 22. As further illustrated in FIG. 37, the horizontal panel portion 210 of the frame structure 58 to which the individual key units 60, 62 and 64 are thus fitted is formed with a plurality of openings 330 arranged in a row in parallel with the rows of the key members 66, viz., in the previously defined first direction L (FIG. 4) of the keyboard assembly. Each of the openings 330 thus provided in the horizontal panel portion 210 of the frame structure 58 has, in the second direction F of the keyboard assembly, a measurement slightly larger than the measurement of the stem portion 324 of the bracket portion of each of the key units 60, 62 and 64 in the second direction F (FIG. 4) of the keyboard assembly.

After the individual key units 60, 62 and 64 are temporarily fitted to the frame structure 58 by the aid of their respective rear lug portions 98, 100 and 102 providing the assembling means, each of the key units 60, 62 and 64 is turned with respect to the frame structure 58 counterclockwise in FIG. 36 so that each of the hook portions 326 of each bracket portion is admitted downwardly into one of the openings 330 in the frame structure 58 and has its front guide surface 328 brought into pressing and sliding contact with the edge defining the opening 330 into which the hook portion 326 is currently located. As the key unit 60, 62 or 64 is turned and its hook portions 328 moved downwardly through the openings 330 in the frame structure 58, each of the hook portions 328 is pressed upon rearwardly at its front guide surface 328 and is elastically deformed rearwardly while being passed downwardly through the opening 330 until the hook portion 326 slips off the frame structure 58 and allowed out of the opening 330. The hook portion 326 thus liberated from the frame structure 58 is now fixedly held in place with respect to the frame structure 58 with the stem portion 324 extending through the opening 330 and is accordingly prevented from being moved upwardly out of the opening 330 in the frame structure 58. In the embodiment of the keyboard assembly under consideration, the key units 60, 62 and 64 are thus secured to the frame structure 58 by the aid of the hook portions 326 integral with the respective bracket members 60*k*, 62*k* and 64*k* of the key units in substitution of the screws 208 used in the keyboard assembly described with reference to FIG. 22.

Figure 38:
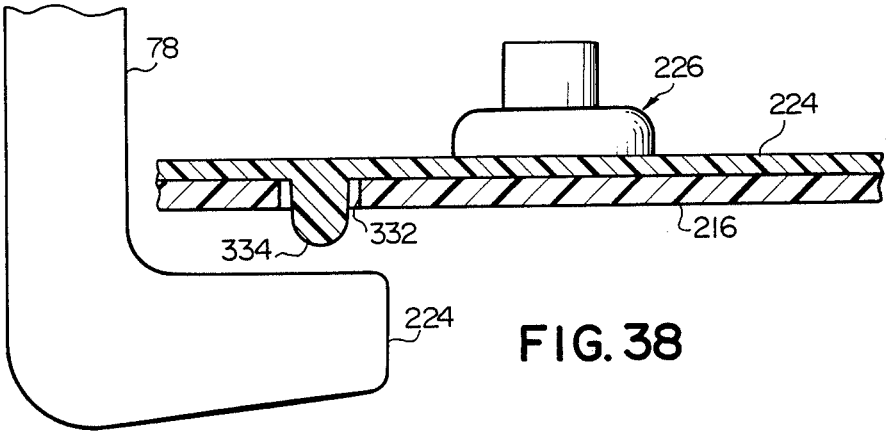
FIG. 38 is a fragmentary sectional view of a modification of the preferred embodiment of a keyboard assembly according to the present invention as adapted to overcome the drawback inherent in a prior-art keyboard unit of the type illustrated in FIG. 21.
Figure 39:
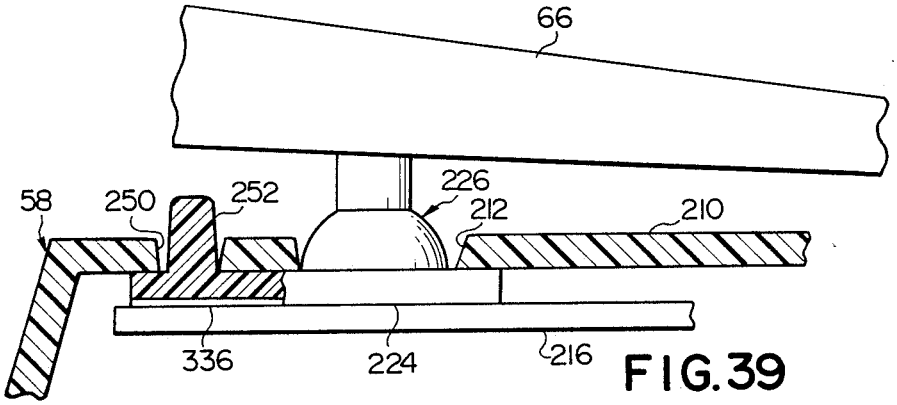
FIG. 39 is a view similar to FIG. 38 but shows another modification of the preferred embodiment of a keyboard assembly according to the present invention as adapted to overcome the drawback inherent in a prior-art keyboard unit of the type illustrated in FIG. 21.

FIGS. 38 and 39 show modifications of the arrangement of the apertures 250 and projections 252 provided in the keyboard assembly hereinbefore described with reference to FIGS. 22 to 24. The arrangements illustrated in FIGS. 38 and 39 are thus also adapted to enable the insulator pad member 224 of the keyboard assembly to be positioned correctly with respect to the frame structure 58 during assemblage of the keyboard assembly and are useful for overcoming the drawback inherent in a prior-art keyboard unit of the type hereinbefore described with reference to FIG. 21.

In the arrangement shown in FIG. 38, the printed circuit board 216 forms part of the frame structure and is provided formed with a plurality of apertures 332 which are arranged in a row between and parallel with the row of the openings 212 and the row of the slots 246 in the frame structure 58 (FIGS. 22 to 24). The apertures 332 may be arranged in pairs each located in association with a selected one of the openings 212. The resilient insulator pad member 224 forming part of the switch arrangement in conjunction with the printed circuit board 216 has a plurality of downward projections 334 which are arranged in a row located in registry with the row of the apertures 332. These downward projections 334 of the insulator pad member 224 are respectively aligned with and project downwardly into the apertures 332 in the circuit board 216 so as to be engageable with the rearwardly directed lower end portion 224 of the key member when the key member is upwardly turned toward the frame structure 58. Thus, the apertures 332 in the printed circuit board 216 and the projections 334 of the insulator pad member 224 also means to limit the upward stroke of the key member with respect to the printed circuit board 216 and accordingly to the frame structure which is in part formed by the printed circuit board 216. As will be readily seen, the apertures 332 and projections 334 further provide means to enable the insulator pad member 224 to be positioned correctly with respect to the frame structure 58 during assemblage of the keyboard assembly.

The arrangement shown in FIG. 39 is largely similar to its counterpart of the keyboard assembly described with reference to FIGS. 22 to 24 in that the horizontal panel portion 210 of the frame structure 58 are further formed a plurality of apertures 250 and the resilient insulator pad member 224 has a plurality of upward projections 252. The upward projections 252 of the insulator pad member 224 are respectively aligned with and project upwardly into the apertures 250 in the frame structure 58 so as to be engageable with the key body portion 68 of the key member 66 when the key member 66 is downwardly turned toward the frame structure 58. Thus, the apertures 250 in the frame structure 58 and the projections 252 of the insulator pad member 224 also provide means to limit the downward stroke of the key member 66 about the torsional coupling portion 70 thereof and means to enable the insulator pad member 224 to be positioned correctly with respect to the frame structure 58 during assemblage of the keyboard assembly.

Between the insulator pad member 224 and the printed circuit board 216 attached to the lower face of the pad member 224 is interposed a pressure-sensitive transducer element 336 in the form of thin film located in alignment with the projection 252 of the insulator pad member 224. The transducer element 336 is responsive to a pressure transmitted through the projection 252 of the insulator pad member 224 when the key member 66 depressed by a player's finger touch is brought into pressing contact with the projection. The size, particularly the height, of the projection 252 is selected in relation to he height of the protuberant portion 226 of the insulator pad member 224 carrying the movable contact element so that the former is contacted later than the latter by the key member 66 when the key member 66 is depressed for downward stroke. The pressure-sensitive transducer element 336 arranged in combination with such an insulator pad member 224 may form part of an after-touch control circuit to produce a signal after the key member 66 is depressed and the switch device associated with the printed circuit board 216 is closed. If desired, any thin-film switch element of, for example, the two position type may be used in substitution for the pressure-sensitive transducer element 336.

Figure 40:
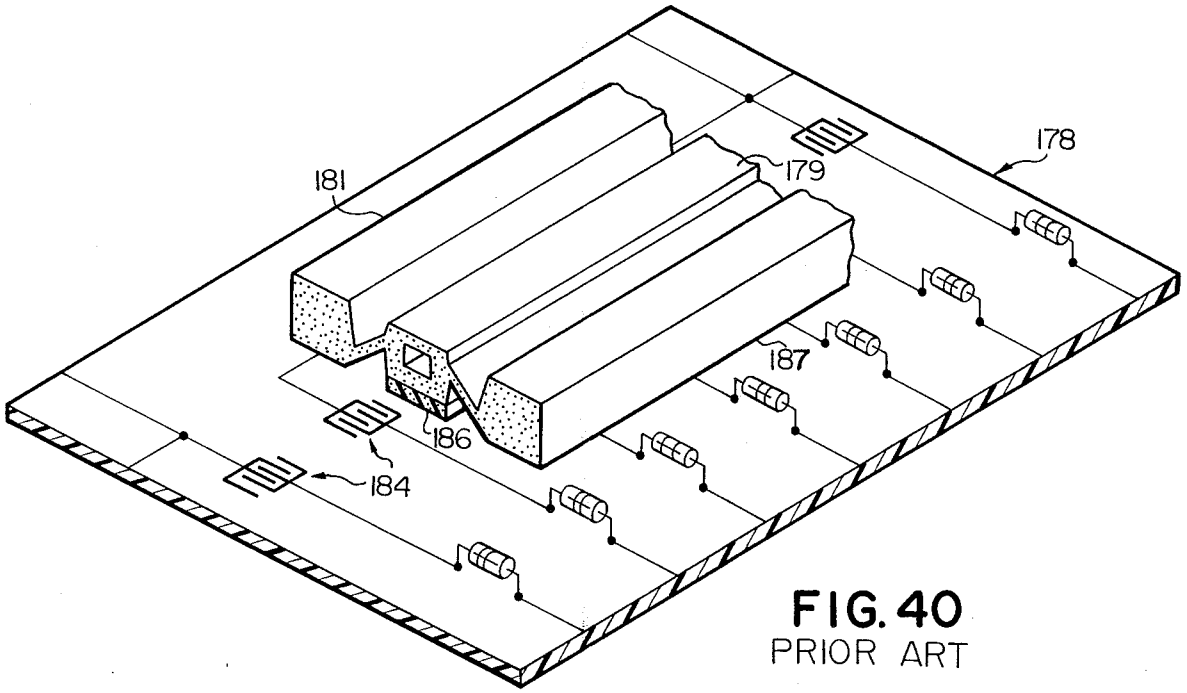
FIG. 40 PRIOR ART
FIG. 40 is a perspective view showing, partly in section, the arrangement of stationary and movable contact elements of a known pad member switch device used in the keyboard assembly of an electronic musical instrument such as the key member and frame arrangement illustrated in FIG. 20.

FIG. 40 shows an example of a known pad member switch device used in the keyboard assembly of an electronic musical instrument. The construction of the prior-art switch device herein shown is disclosed in Japanese Utility Model Publication No. 58-29514.

The known pad member switch device herein shown may be disposed in combination with a frame structure and a key member in a keyboard assembly of the type hereinbefore described with reference to FIG. 20 and includes a plurality of pairs of stationary contact elements 184 printed on the wired surface of a printed circuit board 178. In conjunction with these stationary contact elements 184 on the printed circuit board 178 is provided a movable contact carrier member 179 of rubber having a movable contact element 186 of, for example, conductive rubber securely attached to the underside thereof. The movable contact carrier member 179 is located between and resiliently supported by a pair of support members 181 integral with the carrier member 179. The support members 181 is securely attached to the lower face of the horizontal panel portion 154 of the frame structure 152 of the arrangement shown in FIG. 20. When the key member 150 associated with any pair of stationary contact elements 184 is depressed, the switch actuator portion 188 of the key member 150 is downwardly brought into pressing engagement with the movable contact carrier member 179 and forces the movable contact element 186 into contact with the associated pair of stationary contact elements 184 and causes the switch device to close.

Figure 41:
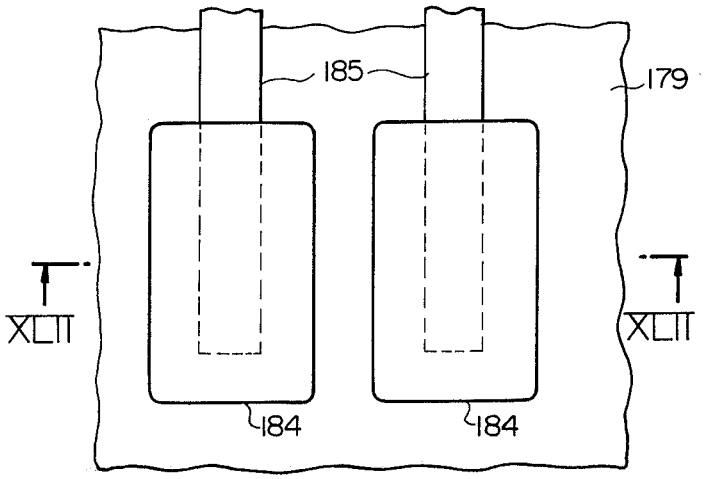
FIG.41 PRIOR ART
FIG. 41 is a fragmentary plan view showing the configuration of a pair of stationary contact elements in the prior-art pad member switch device illustrated in FIG. 40.
Figure 42:
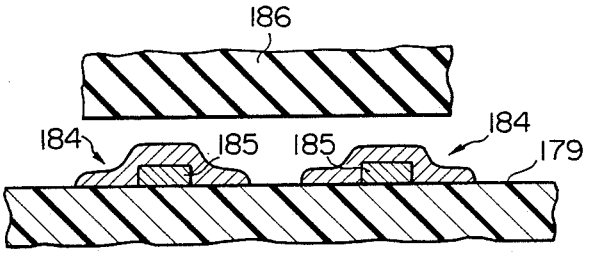
FIG.42 PRIOR ART
FIG. 42 is a sectional view taken along XVII—XVII in FIG. 41 and further showing a portion of a movable contact element provided in association with the stationary contact elements in the switch device illustrated in FIG. 42.

As illustrated to enlarged scales in FIGS. 41 and 42, the stationary contact elements 184 are applied to conductor strips 185 each formed by a film of silver deposited on the substrate 183 of the printed circuit board 178. Each of the stationary contact elements 184 is formed by a conductive layer of carbon applied to the conductor strip 185 in such a manner as to have the conductor strip 185 totally covered therewith. The stationary contact elements 184 of carbon protect the conductor strips 185 from being oxidized at their surfaces for preventing an increase in the on-state resistance through each of the conductor strips 185. The movable contact element 186 associated with the shown pair of stationary contact elements 184 is normally positioned above the stationary contact elements 184 thus formed on the insulator substrate 179 and is brought into pressing contact with both of the stationary contact elements 184 of carbon when actuated by the switch actuator portion 188 of the key member 150 (FIG. 20).

In this type of prior-art pad member switch device, the stationary contact elements 184 of carbon are formed each in a generally rectangular pattern and must be spaced apart from each other a distance of more than 0.5 mm by reason of the accuracy of pattern formation available by the printing techniques of today. In order, furthermore, that each of the conductor strips 185 of silver be covered reliably with the stationary contact element 184 of carbon applied by printing, it is required that each stationary contact element 184 extend a distance of more than 0.5 mm from the underlying conductor strip 185 toward the other stationary contact element 184. This means that the conductor strips 185 of silver must be formed in a manner to be spaced apart at least 1.5 mm from each other. This in turn means that the movable contact element 186 of carbon-impregnated conductive rubber must be sized to have a coverage of more than 1.5 mm plus the widths of the conductor strips 185. Such a long coverage required of the movable contact element 186 results in a proportionately large on-state resistance through the path of current between the stationary contact elements 184.

Accordingly, another important object of the present invention is to provide, either in a keyboard assembly for an electronic musical instrument or independently of such a keyboard assembly, an improved pad member switch device which features a reduced on-state resistance through a current path between the stationary contact elements of the switch device.

Figure 43:
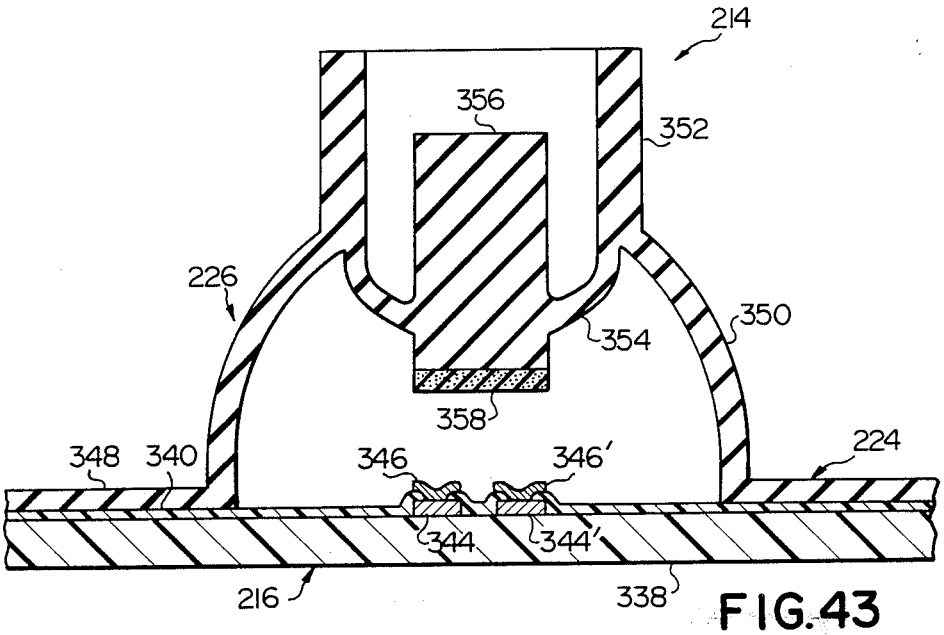
FIG. 43 is a vertical sectional view showing the construction of a preferred form of pad member switch device embodying the present invention or incorporated in any of the embodiments of a keyboard assembly according to the present invention.
Figure 44:
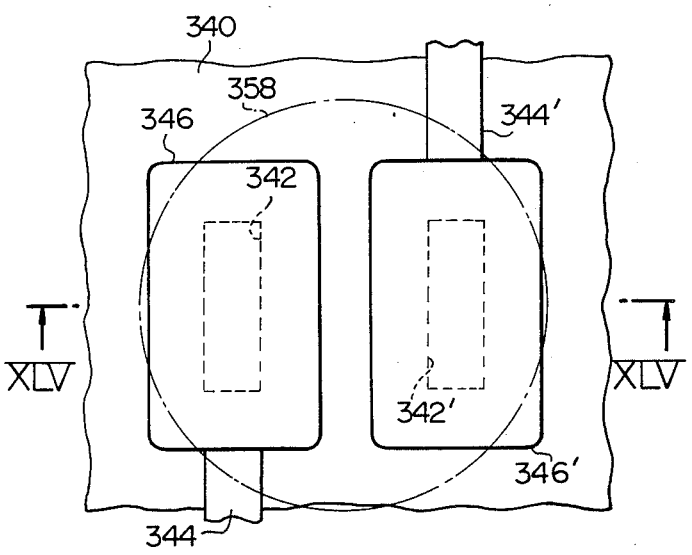
FIG. 44 is a fragmentary plan view showing the configuration of a pair of stationary contact elements in the pad member switch device illustrated in FIG. 43.
Figure 45:
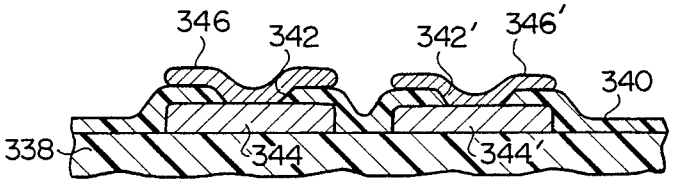
FIG. 45 is a sectional view taken along XLV—XLV in FIG. 41 and further showing a portion of a movable contact element provided in association with the stationary contact elements in the switch device illustrated in FIG. 43.

FIGS. 43 to 45 show a preferred form of pad member switch device embodying the present invention or incorporated in any of the embodiments of a keyboard assembly according to the present invention as hereinbefore described. As previously described with reference to FIG. 22, the pad member switch device 214 is provided in conjunction with a printed circuit board 216 which is held in generally horizontal position by means of the hook portions 218 and leaf spring portions 220 of the frame structure 58. The printed circuit board 216 is thus held in position slightly below the horizontal panel portion 210 of the frame structure 58.

The printed circuit board 216 comprises a substrate 338 having a wired upper surface to which a variety of electric circuit elements and conductor lines are applied by printing. Such a wired upper surface of the substrate 338 is covered with an insulator coating 340 of, for example, a photoresist material formed with openings including generally rectangular openings 342 and 342' (FIGS. 44 and 45) through which some of the circuit elements and conductor lines applied to the upper surface of the circuit board 216 are in part exposed upwardly. In the arrangement herein shown, these circuit elements and conductor lines are represented by conductor strips 344 and 344' each formed by a film of copper deposited on the surface of the substrate 338 of the printed circuit board 216. As illustrated to enlarged scales in FIGS. 44 and 45, the conductor strips 344 and 344' are each in part exposed through the openings 342 and 342', respectively, in the insulator coating 340 and in part contacted by stationary contact elements 346' and 346'. Each of the stationary contact elements 344 and 344' is formed by a conductive layer of carbon applied typically by screen printing techniques to each of the conductor strips 344 and 344' of copper in such a manner as to have the exposed area of each conductor strip 344 covered therewith.

The conductor strips 344 and 344' are not only spaced apart from each other but are separated by a portion of the insulator coating 340. The conductor strips 344 and 344' are thus reliably isolated from each other and can therefore be located on the substrate 340 with a significantly reduced spacing of typically 0.5 mm or within a range of from about 0.3 mm to about 1.5 mm. The conductive layer of carbon to form each of the stationary contact elements 346 and 346' applied to the conductor strips 344 and 344', respectively, is preferably patterned to have a width equal to that of each of the conductor strips 344 and 344' as shown in FIG. 45. In this instance, the stationary contact elements 346 and 346' may also be spaced apart a distance of 0.5 mm or within a range of from about 0.3 mm to about 1.5 mm.

Turning back to FIG. 43, the switch device 214 further comprises a resilient insulator pad member 224 which has a flat sheet portion 348 attached to the insulator coating 224 and a hollow, generally semispherical skirt portion 350 upstanding from the surface of the insulator coating 340. The stationary contact elements 346 and 346' are located at the bottom of the cavity defined by the semispherical skirt portion 350 of the insulator pad member 224. The resilient insulator pad member 224 further has a hollow tubular portion 352 merging upwardly out of the semispherical skirt portion 350 and an annular web portion 354 extending downwardly and radially inwardly from the junction between the skirt and tubular portions 350 and 352. The semispherical skirt portion 350 and the hollow tubular portion 352 form in combination the previously mentioned protuberant portion 226 of the resilient insulator pad member 224.

The annular web portion 354 merges radially inwardly into a cylindrical contact support portion 356 axially extending vertically in part within the skirt portion 350 and in part within the tubular portion 352. The contact support portion 356 has a lower end face directed to and vertically aligned with the pair of stationary contact elements 346 and 346' and carries a movable contact element 358 fixedly attached to its lower end face. The contact support portion 356 thus carrying the movable contact element 358 is vertically movable within the protuberant portion 226 through elastic deformation of the annular web portion 354 and is normally positioned above the shown pair of stationary contact elements 346 and 346'. The support portion 356 is upwardly aligned with the switch actuator portion 76 of the key member 66 (FIG. 22) and, when the key member 66 is depressed to turn downwardly, moved downwardly with the semispherical skirt portion 350 of the pad member 224 elastically deformed downwardly and radially inwardly. The contact carrying portion 356 of the insulator pad member 224 being thus moved downwardly, the movable contact element 358 carried by the portion 356 is brought into pressing contact with both of the stationary contact elements 346 and 346' to cause the switch device 214 to close through the movable contact element 358. When the key member 66 is thereafter liberated and accordingly the contact carrier portion 356 is released from the switch actuator portion 76 of the key member 66, the skirt portion 350 of the insulator pad member 224 is allowed to elastically deform upwardly and radially outwardly. Thus, the contact carrier portion 356 of the pad member 224 is moved upwardly within the protuberant portion 226 of the pad member 224 and as a consequence the movable contact element 358 is detached from the stationary contact elements 346 and 346' to make the switch device 214 to open.

The conductor strips 344 and 344' can be located on the substrate 340 with a spacing within a range of less than 1.5 mm and, in addition, the stationary contact elements 346 and 346' can also be spaced apart a distance within an equal range. This means that the movable contact element 358 of carbon-impregnated conductive rubber can be sized to have a coverage of less than 1.5 mm. Such a reduced coverage of the movable contact element 358 results in a proportionately small on-state resistance through the path of current between the stationary contact elements 364 and 364'.

While it has been assumed that a pad member switch device embodying the present invention is used in combination with a printed circuit board using a rigid substrate, this is merely by way of example and, as such, a switch device according to the present invention may be provided for use with a printed circuit board using a substrate of any other type such as for example a flexible tape of polyester having circuit elements and conductor lines printed thereon. While, furthermore, the contact carrier portion 356 of the resilient insulator pad member 224 is supported throughout its circumference, a contact carrier portion forming part of a resilient insulator pad member may be shaped to cantilever from any vertically extending portion of the insulator pad member, though not shown in the drawings.

What is claimed is:

1. A keyboard assembly for forming a keyboard apparatus of an electronic musical instrument, comprising (a) at least one combination of at least two unitary key unit consisting of first and second key units each comprising a plurality of key members and an elongated bracket portion integrally interconnecting the key members of each key unit together, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, and (d) position restricting means establishing a predetermined positional relationship between said first and second key units for enabling the first and second key units to be positioned in said predetermined relationship with respect to each other before the key units are assembled to said frame structure.

2. A keyboard assembly as set forth in claim 1, in which said position restricting means comprises a projection formed on the bracket portion of one of said first and second key units and a concavity formed in the bracket portion of the other of the first and second key units and having said projection received therein.

3. A keyboard assembly as set forth in claim 2, in which said projection is located on the bracket portion of on one of said first and second key units and said concavity is located in the bracket portion of the other of the first and second key units.

4. A keyboard assembly as set forth in claim 3, in which said bracket portion of each of said key units is elongated in parallel with a direction in which said key members of said key units are arranged in a row, said projection being located substantially centrally of the bracket portion of on one of said first and second key units in said direction and said concavity being located substantially centrally of the bracket portion of the other of the first and second key units in said direction.

5. A keyboard assembly for forming a keyboard apparatus of an electronic musical instrument, comprising (a) at least one combination of at least three unitary key units consisting of a first key unit having four white key members respectively allocated to the notes C, E, G and B and an elongated bracket portion integrally interconnecting the key members together, a second key unit having three white key members respectively allocated to the notes D, F and A and an elongated bracket portion integrally interconnecting the key members of the second key unit together, and a third key unit having five black key members respectively allocated to the C-sharp or D-flat, D-sharp or E-flat, F-sharp or G-flat, G-sharp or A-flat and A-sharp or B-flat notes and an elongated bracket portion integrally interconnecting the key members of the third key unit together, the key members of said first key unit and the key members of said second key unit being arranged alternately so that the individual key members of the first and second key units provide the standard sequential white key configuration, the key members of said third key unit being arranged in interdigital relationship to the key members of the first and second key units, the bracket portion of each of said first, second and third key units being elongated in parallel with a direction in which said key members of said key units are arranged in a row, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, (d) first position restricting means establishing a first predetermined positional relationship between said first and second key units for enabling the first and second key units to be positioned in said first predetermined relationship with respect to each other before the key units are assembled to said frame structure, said first position restricting means comprising a projection formed on the bracket portion of one of said first and second key units and a concavity formed in the bracket portion of the other of the first and second key units and having said projection received therein, said projection on or said concavity in the bracket portion of one of said first and second key units being located in the vicinity of the key member allocated to the note E of said firsts key unit and said concavity in or said projection on the bracket portion of the other of said first and second key units being located in the vicinity of the key member allocated to the note F of said second key unit, and (e) second position restricting means establishing a second predetermined positional relationship between said second and third key units for enabling the second and third key units to be positioned in said second predetermined relationship with respect to each other before the key units are assembled to said frame structure, said second position restricting means comprising a projection formed on the bracket portion of one of said second and third key units and a concavity formed in the bracket portion of the other of the second and third key units and having said projection of the second position restricting means received therein, said projection on or said concavity in the bracket portion of one of said second and third key units being located in the vicinity of the key member allocated to the note F of said second key unit and said concavity in or said projection on the bracket portion of the other of said second and third key units being located in the vicinity of the key member allocated to the note F-sharp or G-flat of said third key unit.

6. A keyboard assembly for forming a keyboard apparatus of an electronic musical instrument, comprising (a) at least one combination of at least three unitary key units consisting of a first key unit having four white key members respectively allocated to the notes F, A, C and E and an elongated bracket portion integrally interconnecting the key members together, a second key unit having three white key members respectively allocated to the notes G, B and D and an elongated bracket portion integrally interconnecting the key members of the second key unit together, a third key unit having five black key members respectively allocated to the C-sharp or D-flat, D-sharp or E-flat, F-sharp or G-flat, G-sharp or A-flat and A-sharp or B-flat notes and an elongated bracket portion integrally interconnecting the key members of the third key unit together, the key members of said first key unit and the key members of said second key unit being arranged alternately so that the individual key members of the first and second key units provide the standard sequential white key configuration, the key members of said third key unit being arranged in interdigital relationship to the key members of the first and second key units, the bracket portion of each of said first, second and third key units being elongated in parallel with a direction in which said key members of said key units are arranged in a row, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, (d) first position restricting means establishing a first predetermined positional relationship between said first and second key units for enabling the first and second key units to be positioned in said first predetermined relationship with respect to each other before the key units are assembled to said frame structure, and (e) second position restricting means establishing a second predetermined positional relationship between said second and third key units for enabling the second and third key units to be positioned in said second predetermined relationship with respect to each other before the key units are assembled to said frame structure.

7. A keyboard assembly as set forth in claim 6, in which said first position restricting means comprises a projection formed on the bracket portion of one of said first and second key units and a concavity formed in the bracket portion of the other of the first and second key units and having said projection received therein, said projection on or said concavity in the bracket portion of one of said first and second key units being located in the vicinity of the key member allocated to the note A of said first key unit and said concavity in or said projection on the bracket portion of the other of said first and second key units being located in the vicinity of the key member allocated to the note B of said second key unit, said second position restricting means comprising a projection formed on the bracket portion of one of said second and third key units and a concavity formed in the bracket portion of the other of the second and third key units and having said projection of the second position restricting means received therein, said projection on or said concavity in the bracket portion of one of said second and third key units being located in the vicinity of the key member allocated to the note F of said second key unit and said concavity in or said projection on the bracket portion of the other of said second and third key units being located in the vicinity of the key member allocated to the note A-sharp or B-flat of said third key unit.

8. A keyboard assembly for forming a keyboard apparatus of an electronic musical instrument, comprising (a) at least one combination of at least three unitary key units consisting of a first key unit having two white key members respectively allocated to the notes E and B and an elongated bracket portion integrally interconnecting the key members together, a second key unit having five white key members respectively allocated to the notes C, D, F, G and A and an elongated bracket portion integrally interconnecting the key members of the second key unit together, a third key unit having five black key members respectively allocated to the C-sharp or D-flat, D-sharp or E-flat, F-sharp or G-flat, G-sharp or A-flat and A-sharp or B-flat notes and an elongated bracket portion integrally interconnecting the key members of the third key unit together, the key members of said first key unit and the key members of said second key unit being arranged alternately so that the individual key members of the first and second key units provide the standard sequential white key configuration, the key members of said third key unit being arranged in interdigital relationship to the key members of the first and second key units, the bracket portion of each of said first, second and third key units being elongated in parallel with a direction in which said key members of said key units are arranged in a row, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, (d) first position restricting means establishing a first predetermined positional relationship between said first and second key units for enabling the first and second key units to be positioned in said first predetermined relationship with respect to each other before the key units are assembled to said frame structure, and (e) second position restricting means establishing a second predetermined positional relationship between said second and third key units for enabling the second and third key units to be positioned in said second predetermined relationship with respect to each other before the key units are assembled to said frame structure.

9. A keyboard assembly as set forth in claim 8, in which said first position restricting means comprises a projection formed on the bracket portion of one of said first and second key units and a concavity formed in the bracket portion of the other of the first and second key units and having said projection received therein, said projection on or said concavity in the bracket portion of one of said first and second key units being located in the vicinity of the key member allocated to the note E of said first key unit and said concavity in or said projection on the bracket portion of the other of said first and second key units being located in the vicinity of the key member allocated to the note F of said second key unit, said second position restricting means comprising a projection formed on the bracket portion of one of said second and third key units and a concavity formed in the bracket portion of the other of the second and third key units and having said projection of the second position restricting means received therein, said projection on or said concavity in the bracket portion of one of said second and third key units being located in the vicinity of the key member allocated to the note F of said second key unit and said concavity in or said projection on the bracket portion of the other of said second and third key units being located in the vicinity of the key member allocated to the note F-sharp or G-flat of said third key unit.

10. A keyboard assembly for forming a keyboard apparatus of an electronic musical instrument, comprising (a) at least one combination of at least three unitary key units consisting of a first key unit having two white key members respectively allocated to the notes C an F and an elongated bracket portion integrally interconnecting the key members together, a second key unit having five white key members respectively allocated to the notes D, E, G, A and B and an elongated bracket portion integrally interconnecting the key members of the second key unit together, a third key unit having five black key members respectively allocated to the C-sharp or D-flat, D-sharp or E-flat, F-sharp or G-flat, G-sharp or A-flat and A-sharp or B-flat notes and an elongated bracket portion integrally interconnecting the key members of the third key unit together, the key members of said first key unit and the key members of said second key unit being arranged alternately so that the individual key members of the first and second key units provide the standard sequential white key configuration, the key members of said third key unit being arranged in interdigital relationship to the key members of the first and second key units, the bracket portion of each of said first, second and third key units being elongated in parallel with a direction in which said key members of said key units are arranged in a row, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, (d) first position restricting means establishing a first predetermined positional relationship between said first and second key units for enabling the first and second key units to be positioned in said first predetermined relationship with respect to each other before the key units are assembled to said frame structure, (e) second position restricting means establishing a second predetermined positional relationship between said second and third key units for enabling the second and third key units to be positioned in said second predetermined relationship with respect to each other before the key units are assembled to said frame structure.

11. A keyboard assembly as set forth in claim 10, in which said first position restricting means comprises a projection formed on the bracket portion of one of said first and second key units and a concavity formed in the bracket portion of the other of the first and second key units and having said projection received therein, said projection on or said concavity in the bracket portion of one of said first and second key units being located in the vicinity of the key member allocated to the note F of said first key unit and said concavity in or said projection on the bracket portion of the other of said first and second key units being located in the vicinity of the key member allocated to the note E of said second key unit, said second position restricting means comprising a projection formed on the bracket portion of one of said second and third key units and a concavity formed in the bracket portion of the other of the second and third key units and having said projection of the second position restricting means received therein, said projection on or said concavity in the bracket portion of one of said second and third key units being located in the vicinity of a location between the key members respectively allocated to the notes E and G of said second key unit and said concavity in or said projection on the bracket portion of the other of said second and third key units being located in the vicinity of the key member allocated to the note F-sharp or G-flat of said third key unit.

12. A keyboard assembly as set forth in claim 11, in which said assembling means comprises a portion of said frame structure, said portion of the frame structure extending substantially in parallel with the bracket portion of each of said key units and formed with openings, and a plurality of lug portions projecting from the bracket portion of each of said key units and engaging said portion of said frame structure through said openings, respectively.

13. A keyboard assembly for forming a keyboard apparatus of an electronic musical instrument, comprising (a) at least two combinations each of at least two unitary key units each comprising a plurality of key members and an elongated bracket portion integrally interconnecting the key members of each key unit together, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, and (d) position restricting means establishing a predetermined positional relationship between each of the key units of one of said combinations and each of the key units of the other of said combinations for enabling the key units of the two combinations of key units to be positioned in said predetermined relationship with respect to each other before the key units are assembled to said frame structure.

14. A keyboard assembly as set forth in claim 13, in which said position restricting means comprises a projection formed on each of the key units of one of said combinations and a concavity formed in each of the key units of the other of the other of said combinations and having said projection received therein.

15. A keyboard assembly as set forth in claim 14, in which said projection is formed on the bracket portion of each of said key units of one of said combinations and said concavity is located in the bracket portion of each of the key units of the other of said combinations.

16. A keyboard assembly as set forth in claim 15, in which said bracket portion of each of said key units is elongated in parallel with a direction in which said key members of said key units are arranged in a row, said projection being located in the vicinity of one longitudinal end of the bracket portion of on one of said first and second key units in said direction and said concavity being located in the vicinity of one longitudinal end of the bracket portion of the other of the first and second key units in said direction.

17. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key unit are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, (c) each of said key members having an elongated key body portion and a torsional coupling portion intervening between the key body portion and the bracket portion of said key unit, the torsional coupling portion enabling the key member to elastically deform with respect to said frame structure torsionally about a first axis substantially perpendicular to a direction in which the key body portion of the key member longitudinally extends and about a second axis substantially perpendicular to said first axis.

18. A keyboard assembly as set forth in claim 17, in which said torsional coupling portion of each of said key members comprises a first hinge portion merging out of said key body portion and a second hinge portion merging in said direction out of the first hinge portion into said bracket portion, the first hinge portion comprising an elastically deformable thin wall portion extending on a first plane for allowing the key member to angularly move about said first axis passing through the first plane, the second hinge portion comprising an elastically deformable thin wall portion extending on a second plane normal to said first plane for allowing the key member to angularly move about said second axis passing through the second plane.

19. A keyboard assembly as set forth in claim 17, in which said torsional coupling portion of each of said key members comprises a substantially semicylindrical hinge portion intervening and curved arcuately between the key body portion of the key member and said bracket portion, said hinge portion being elastically deformable angularly about an axis in said direction in which said key members are arranged in a row.

20. A keyboard assembly as set forth in claim 17, in which said torsional coupling portion of each of said key members comprises a generally semicylindrical elastically deformable hinge portion curved arcuately between the key body portion of the key member and said bracket portion, and an elongated bridge portion extending substantially straight between the key body portion of the key member and said bracket portion and straddling over said curved hinge portion.

21. A keyboard assembly as set forth in claim 20, in which said hinge portion has formed in its inner wall a groove extending between the opposite ends of said bridge portion.

22. A keyboard assembly as set forth in claim 20, in which said torsional coupling portion of each of said key members further comprises a pair of lug portions respectively projecting toward each other from the key body portion of the key member and said bracket portion, each of said hinge portion and said bridge portion extending between said lug portions.

23. A keyboard assembly as set forth in claim 22, in which each of said lug portions is formed with an opening.

24. A keyboard assembly as set forth in claim 17, in which said torsional coupling portion of each of said key members comprises an elastically deformable strip portion intervening between the key body portion of the key member and said bracket portion, the strip portion being twisted from a first plane to a second plane turned through about 90 degrees from the first plane about an axis in the direction in which the key member is elongated.

25. A keyboard assembly as set forth in claim 17, in which said torsional coupling portion of each of said key members comprises a first hinge portion projecting from the key body portion of the key member and a second hinge portion projecting from the first hinge portion through an intermediate wall portion and terminating in said bracket portion, the first hinge portion comprising an elastically deformable thin wall portion inclined in one direction about an axis in the key member is elongated, the second hinge portion comprising an elastically deformable thin wall portion inclined in the other direction about said axis.

26. A keyboard assembly as set forth in claim 17, in which said torsional coupling portion of each of said key members comprises an elastically deformable elongated stem portion extending substantially straight between the key body portion of the key member and said bracket portion and having a generally square-shaped cross.

27. A keyboard assembly as set forth in claim 17, in which said torsional coupling portion of each of said key members comprises an elastically deformable thin wall portion merging out of the key body portion of the key member into said bracket portion in a direction perpendicular to the direction in which the key member is elongated and the direction in which said key members are arranged in a row.

28. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key units are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, (c) first stroke limiting means for limiting the distance of rocking movement of each of said key members in one direction with respect to said frame structure, (d) second stroke limiting means for limiting the distance of rocking movement of each of said key members in the opposite direction with respect to said frame structure, (e) said frame structure having a first panel portion extending generally in parallel with a direction in which each of said key members is elongated and a second panel portion which is bent substantially perpendicularly to said first panel portion, said first stroke limiting means being fixedly located on said firsts panel portion and said second stroke limiting means being movable with respect to said second panel portion, (f) an electric circuit carrying member, and (g) a plurality of switch devices arranged respectively in conjunction with said key members, said switch devices being cooperative with said circuit carrying member and comprising a unitary resilient member common to the individual switch devices, (h) said first stroke limiting means comprising an opening provided in said first panel portion of said frame structure, a portion forming part of said resilient member and engaging said first panel portion of said frame structure through said opening provided in the first panel portion of the frame structure.

29. A keyboard assembly as set forth in claim 28, in which said frame structure further has portions retaining said circuit carrying member to said first panel portion of said frame structure with said resilient member interposed between the first panel portion of the frame structure and said circuit carrying member, said second stroke limiting means comprising a slot formed partly in said first panel portion and partly in said second panel portion of said frame structure, a hook portion forming part of each of said key members and movable with respect to said frame structure through said slot, and a portion of said resilient member, said portion of said resilient member being located close to each of said first and second panel portions of said frame structure and engageable with said hook portion, said hook portion being engageable with said portion of said resilient member for limiting the distance of rocking movement of said key member in said opposite direction with respect to said frame structure.

30. A keyboard assembly as set forth in claim 29, in which said slot in said frame structure has a first portion in said first panel portion and a second portion in said second panel portion of said frame structure, said portion of said resilient member being biased to contact said first panel portion of the frame structure and close said first portion of said slot and being resiliently deformable away from said first panel portion of the frame structure for allowing said first portion of said slot to open and said hook portion to pass through said first portion of the slot for movement in said one direction with respect to said frame structure, said portion of the resilient member being forced away from said first panel portion of said frame structure by said hook portion of the key member when the key member is in a condition disengaged from the first panel portion of the frame structure and is moved in said one direction with respect to said frame structure from a position having said hook portion located between said key member and said frame structure.

31. A keyboard assembly as set forth in claim 29, in which said first panel portion of said frame structure is in part spaced apart from said resilient member for forming a cavity therebetween and in which said slot in said frame structure has a first portion in said first panel portion and a second portion in said second panel portion of said frame structure, said portion of said resilient member being in the form of a bellows having alternate furrows and ridges arranged in a direction substantially parallel with the direction in which said key member is elongated, said portion of the resilient member being biased to have an end face held in contact with said second panel portion of the frame structure and close said first portion of said slot and being resiliently deformable away from said second panel portion of the frame structure for allowing said first portion of said slot to open and said hook portion to pass through said first portion of the slot for movement in said one direction with respect to said frame structure, said portion of the resilient member being forced away from said second panel portion of said frame structure by said hook portion of the key member when the key member is in a condition disengaged from the first panel portion of the frame structure and is moved in said one direction with respect to said frame structure from a position having said hook portion located between said key member and said frame structure.

32. A keyboard assembly as set forth in claim 28, in which said frame structure further has portions retaining said circuit carrying member to said first panel portion of said frame structure with said resilient member interposed between the first panel portion of the frame structure and said circuit carrying member, said second stroke limiting means comprising an opening formed in said first panel portion of said frame structure, an opening in said resilient member and aligned with the opening in said first panel portion of said frame structure, a stem portion forming part of each of said key members and movable with respect to said frame structure through said opening in said first panel portion and said opening in said resilient member in a direction in which the key member is rockable with respect to the frame structure, and an enlarged end portion merging out of said stem portion, said enlarged end portion being substantially conforming in cross section to the opening in said first panel portion of said frame structure and larger in cross section than the opening in said resilient member, said enlarged end portion of being engageable with said hook portion, said enlarged end portion being located out of said openings in said frame structure and said resilient member with said stem portion passed through said openings for limiting the distance of rocking movement of said key member in said opposite direction with respect to said frame structure, said opening in said resilient member being forced to expand to allow passage of said enlarged end portion therethrough when the enlarged end portion is moved from said opening in said frame structure into the opening in said resilient member with the key member disengaged from the first panel portion of the frame structure and moved in said one direction with respect to said frame structure from a position having said enlarged end portion located between said key member and said frame structure.

33. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key units are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, (c) fastening means for fastening said key unit to said frame structure, said fastening means comprising an opening provided in said frame structure, a stem portion projection from said bracket portion of said key unit and smaller in cross section than said opening and a hook portion merging out of said stem portion and larger in cross section than said opening, said hook portion being located out of said opening with said stem portion passed through said opening for securing said key member to said frame structure, said opening in said frame structure being forced to expand to allow passage of said hook portion therethrough when the hook portion is moved into the opening with the key member disengaged from the frame structure and said bracket portion moved into contact with said frame structure.

34. A keyboard assembly for forming a keyboard apparatus of an electronic musical instrument, comprising (a) a unitary key unit having a plurality of key members and a bracket portion integrally interconnecting the key members together, (b) a frame structure to which the bracket portion of said key unit is fastened while allowing each of the individual key members of the key unit to rock independently of each other about an axis substantially fixed with respect to said frame structure and substantially parallel with said bracket portion, (c) an electric circuit carrying member, (d) a plurality of switch devices arranged respectively in conjunction with said key members, said switch devices being cooperative with said circuit carrying member and comprising a unitary resilient member common to the individual switch devices, (e) stroke limiting means for limiting the distance of rocking movement of each of said key members in one direction with respect to said frame structure, said stroke limiting means comprising an opening provided in said circuit carrying member, a hook portion forming part of each of said key members and movable with respect to said frame structure and a portion forming part of said resilient member and projecting through said opening in said resilient member in one direction with respect to said frame structure, said portion of said resilient member being engageable with said hook portion, said hook portion being engageable with said portion of said resilient member for limiting the distance of rocking movement of said key member in the other direction with respect to said frame structure.

35. A keyboard assembly as set forth in claim 34, further comprising a pressure-sensitive transducer element in the form of thin film interposed between said resilient member and said circuit carrying member and located substantially in alignment with said portion of said resilient member for being responsive to a pressure transmitted through the portion of the resilient member when the key member is depressed and brought into pressing contact with the portion of the resilient member.

36. A combination of an electric switch device and an electric circuit carrying member, (a) the electric circuit carrying member comprising a substrate having formed thereon circuit elements including a pair of conductor strips having respective regions spaced apart from each other, a film of insulator formed on said substrate and having openings through each of which each of said regions of said conductor strips is in part exposed, and a pair of stationary contact elements each comprising a conductive layer formed partially on the exposed portion of each of said conductor strips and partially on the portion of the insulator film overlying said region of the conductor strip, and (b) said switch device comprising a resilient insulator pad member attached to said insulator film and having a contact carrying portion carrying a movable contact element located in alignment with said pair of stationary contact elements, said contact carrying portion of said resilient insulator pad member being resiliently movable into and out of a position having said movable contact element in contact with said pair of stationary contact elements.

37. A combination as set forth in claim 36, in which said regions of said conductor strips are spaced apart from each other a distance within the range of 0.3 mm and 1.5 mm.

38. A combination as set forth in claim 36, in which said regions of said conductor strips are spaced apart from each other a distance of 0.5 mm.

39. A combination as set forth in claim 36, in which said switch device further comprises a resilient insulator pad member having a flat sheet portion attached to said insulator film and a hollow, generally semispherical skirt portion bulging from the surface of the insulator film, said stationary contact elements being located within the cavity defined by said skirt portion, a hollow tubular portion merging in one direction out of said skirt portion, an annular web portion extending in the other direction radially inwardly from the junction between the skirt and tubular portions, and a cylindrical contact support potion merging radially outwardly out of said annular web portion and axially extending in part within said skirt portion and in part within said tubular portion, said contact support portion having an end face directed to and aligned with said pair of stationary contact elements and carrying movable contact elements.

40. A keyboard assembly for forming a keyboard apparatus of an electronic musical instrument, the keyboard assembly including (a) at least one combination of at least two unitary key units consisting of first and second key units each comprising a plurality of key members and an elongated bracket portion integrally interconnecting the key members of each key unit together, and (b) a frame structure to which said key units are assembled together, characterized by (c) position restricting means establishing a predetermined positional relationship between said first and second key units for enabling the first and second key units to be positioned in said predetermined relationship with respect to each other before the key units are assembled to said frame structure.

41. A keyboard assembly as set forth in claim 40, further comprising (a) assembling means for disengageably fastening said key units to said frame structure while allowing each of the individual key members of the key units to rock independently of each other about an axis substantially fixed with respect to said frame structure and substantially parallel with said bracket portion.

42. A keyboard assembly for forming a keyboard apparatus of an electronic musical instrument, the keyboard assembly including (a) at least two combinations each of at least two unitary key units each comprising a plurality of key members and an elongated bracket portion integrally interconnecting the key members of each key unit together, and (b) a frame structure to which said key units are assembled together, characterized by (c) position restricting means establishing a predetermined positional relationship between each of the key units of one of said combinations and each of the key units of the other of said combinations for enabling the key units of the two combinations of key units to be positioned in said predetermined relationship with respect to each other before the key units are assembled to said frame structure.

43. A keyboard assembly as set forth in claim 42, further comprising (d) assembling means for disengageably fastening said key units to said frame structure while allowing each of the individual key members of the key units to rock independently of each other about an axis substantially fixed with respect to said frame structure and substantially parallel with said bracket portion.

44. A keyboard assembly for forming a keyboard apparatus of an electronic musical instrument, comprising (a) at least one combination of at least three unitary key units consisting of a first key unit having a first predetermined number of white key members and an elongated bracket portion integrally interconnecting the key members together, a second key unit having a second predetermined number of white key members and an elongated bracket portion interconnecting the key members of the second key unit together, a third key unit having a third predetermined number of black key members and an elongated bracket portion interconnecting the key members of the third key unit together, the key members of said first key unit and the key members of said second key unit being arranged alternately so that the individual key members of the first and second key units provide the standard sequential white key configuration, the key members of said third key unit being arranged in interdigital relationship to the key members of the first and second units, the bracket portion of each of said first, second and third key units being elongated in parallel with a direction in which said key members of said key units are arranged in a row, (b) a frame structure to which said key units are assembled together, (c) assembling means for disengageably fastening said key units to said frame structure while allowing each of the individual key members of the key units to rock independently of each other about an axis substantially fixed with respect to said frame structure and substantially parallel with said bracket portion, (d) first portion restricting means establishing a first predetermined positional relationship between said first and second key units for enabling the first and second key units to be positioned in said first predetermined relationship with respect to each other before the key units are assembled to said frame structure, said first position restricting means comprising a projection formed on the bracket portion of one of said first and second key units and a concavity formed in the bracket portion of the other of the first and second key units and having said projection received therein, and (e) second position restricting means establishing a second predetermined positional relationship between said second and third key units for enabling the second and third key units to be positioned in said second predetermined relationship with respect to each other before the key units are assembled to said frame structure, said second position restricting means comprising a projection formed on the bracket portion of one of said second and third units and a concavity formed in the bracket portion of the other of the second and third key units and having said projection of the second position restricting means received therein.

45. A keyboard assembly as set forth in claim 44, in which said key unit has four white key members respectively allocated to the notes C, E, G and B, said second key unit has three white key members respectively allocated to the notes D, F and A, and said third key unit has five black key members respectively allocated to the C-sharp or D-flat, D-sharp or E-flat, F-sharp or G-flat, G-sharp or A-flat and A-sharp or B-flat notes, said projection on or said concavity in the bracket portion of one of said first and second key units being located in the vicinity of the key member allocated to the note E of said first key unit and said concavity in or said projection on the bracket portion of the other of said first and second key units being located in the vicinity of the key member allocated to the note F of said second key unit, said projection on or said concavity in the bracket portion of one of said second and third key units being located in the vicinity of the key member allocated to the note F of said second key unit and said concavity in or said projection on the bracket portion of the other of said second and third key units being located in the vicinity of the key member allocated to the note F-sharp or G-flat of said third key unit.

46. A keyboard assembly as set forth in claim 44, in which said first key unit has four white key members respectively allocated to the notes F, A, C and E, said second key unit has three white key members respectively allocated to the notes G, B and D, and said third key unit has five black key members respectively allocated to the C-sharp or D-flat, D-sharp or E-flat, F-sharp or G-flat, G-sharp or A-flat and A-sharp or B-flat notes, said projection on or said concavity in the bracket portion of one of said first and second key units being located in the vicinity of the key member allocated to the note A of said first key unit and said concavity in or said projection on the bracket portion of the other of said first and second key unit being located in the vicinity of the key member allocated to the note B of said second key unit, said projection on or said concavity in the bracket portion of one of said second and third key units being located in the vicinity of the key member allocated to the note F of said second key unit and said concavity in or said projection on the bracket portion of the other of said second and third key units being located in the vicinity of the key member allocated to the note A-sharp or B-flat of said third key unit.

47. A keyboard assembly as set forth in claim 44, in which said first key unit has two white key members respectively allocated to the notes E and B, said second key unit has five white key members respectively allocated to the notes C, D, F, G and A, and said third key unit has five black key members reseptively allocated to the C-sharp or D-flat, D-sharp or E-flat, F-sharp or G-flat, G-sharp or A-flat and A-sharp or B-flat notes, said projection on or said concavity in the bracket portion of one of said first and second key units being located in the vicinity of the key member allocated to the note E of said first key unit and said concavity in or said projection on the bracket portion of the other of said first and second key units being located in the vicinity of the key member allocated to the note F of said second key unit, said projection on or said concavity in the bracket portion of one of said second and third key units being located in the vicinity of the key member allocated to the note F of said second key unit and said concavity in or said projection on the bracket portion of the other of said second and third key units being located in the vicinity of the key member allocated to the note F-sharp or G-flat of said third key unit.

48. A keyboard assembly as set forth in claim 44, in which said first key unit has two white key members respectively allocated to the notes C and F, said second key unit has five white key members respectively allocated to the notes D, D, G, A and B, and said third key unit has five black key members respectively allocated to the C-sharp or D-flat, D-sharp or E-flat, F-sharp or G-flat, G-sharp or A-flat and A-sharp or B-flat notes, said projection on or said concavity in the bracket portion of one of said first and second key units being located in the vicinity of the key member allocated to the note F of said first key unit and said concavity in or said projection on the bracket portion of the other of said first and second key units being located in the vicinity of the key member allocated to the note E of said second key units, said projection on or said concavity in the bracket portion of one of said second and third key units being located in the vicinity of a location between the key members respectively allocated to the notes E and G of said second key unit and said concavity in or said projection on the bracket portion of the other of said second and third key units being located in the vicinity of the key member allocated to the note F-sharp or G-flat of said third key unit.

49. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key units are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, the frame structure having a panel portion extending generally in parallel with a direction in which each of said key members is elongated, (c) stroke limiting means for limiting the distance of rocking movement of each of said key members in one direction with respect to said frame structure and the distance of rocking movement of said key member in the opposite direction with respect to said frame structure, (d) an electric circuit carrying member, and (e) a plurality of switch devices arranged respectively in conjunction with said key members, said switch devices being cooperative with said circuit carrying member and comprising a unitary resilient member common to the individual switch devices, (f) said stroke limiting means comprising an opening provided in said panel portion of said frame structure, and a portion forming part of said resilient member and engaging said panel portion of said frame structure through said opening provided in the panel portion of the frame structure.

50. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key units are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, the frame structure having a panel portion extending generally in parallel with a direction in which each of said key members is elongated, (c) stroke limiting means for limiting the distance of rocking movement of each of said key members in one direction with respect to said frame structure and the distance of rocking movement of said key member in the opposite direction with respect to said frame structure, (d) an electric circuit carrying member, and (e) a plurality of switch devices arranged respectively in conjunction with said key members, said switch devices being cooperative with said circuit carrying member and comprising a unitary resilient member common to the individual switch devices, (f) said stroke limiting means comprising an opening provided in said electric circuit carrying member, and a portion forming part of said resilient member and engaging said panel portion of said frame structure through said opening provided in the panel portion of the frame structure.

51. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key units are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, (c) first stroke limiting means for limiting the distance of rocking movement of each of said key members in one direction with respect to said frame structure, (d) second stroke limiting means for limiting the distance of rocking movement of each of said key members in the opposite direction with respect to said frame structure, (e) said frame structure having a first panel portion extending generally in parallel with a direction in which each of said key members is elongated and a second panel portion which is bent substantially perpendicularly to said first panel portion, said first stroke limiting means being fixedly located on said first panel portion and said second stroke limiting means being movable with respect to said second panel portion, (f) an electric circuit carrying member, and (g) a plurality of switch devices arranged respectively in conjunction with said key members, said switch devices being cooperative with said circuit carrying member and comprising a unitary resilient member common to the individual switch devices, (h) said first stroke limiting means comprising an opening provided in said first panel portion of said frame structure, and a portion forming part of said resilient member and engaging said first pane portion of said frame structure through said opening provided in the first panel portion of the frame structure, (i) said frame structure further having portions retaining said circuit carrying member to said first panel portion of said frame structure with said resilient member interposed between the first panel portion of the frame structure and said circuit carrying member, (j) said second stroke limiting means comprising a slot formed partly in said first panel portion and partly in said second panel portion of said frame structure, a hook portion forming part of each of said key members and movable with respect to said frame structure through said slot, and a portion of said resilient member, said portion of said resilient member being located close to each of said first and second panel portions of said frame structure and engageable with said portion of said resilient member for limiting the distance of rocking movement of said key member in said opposite direction with respect to said frame structure.

52. A keyboard assembly for forming a keyboard apparatus of an electronic musical instrument, comprising (a) a unitary key unit having a plurality of key members and a bracket portion integrally interconnecting the key members together and elongated in parallel with a direction in which said key members of said key units are arranged in a row, (b) a frame structure to which the bracket portion of said key unit is fastened while allowing each of the individual key members of the key unit to rock independently of each other about an axis substantially fixed with respect to said frame structure and substantially parallel with said bracket portion, and (c) stroke limiting means for limiting the distance of rocking movement of each of said key members with respect to said frame structure, said stroke limiting means comprising a plurality of openings provided in said frame structure and located reseptively in association of said key members so that each of the key members is rockable through the associated one of the openings, and resilient portions respectively associated with the key members of said key unit, the resilient portions engaging said frame structure respectively through said openings in the frame structure and each having opposite faces parallel with a portion of said frame structure, (d) wherein, during assemblage of said key unit to said frame structure, each of said key members is forced to rock about said axis and is brought into pressing engagement with one face of the associated one of said resilient portions through the associated one of the openings in the frame structure to force the resilient portion to deform away from said frame structure until each of the key members is released from the associated resilient portion and has a portion located close to the opposite face of the associated resilient portion and effective to prevent the key member from being disengaged from the frame structure.

53. A keyboard assembly as set forth in claim 52, further comprising (e) an electric circuit carrying member, and (f) a plurality of switch devices arranged respectively in conjunction with said key members, said switch devices being cooperative with said circuit carrying member and comprising a unitary resilient member common to the individual switch devices, said resilient portions of said stroke limiting means forming part of said resilient member, (g) said frame structure having portions retaining said circuit carrying member to said frame structure with said resilient member interposed between the frame structure and said circuit carrying member, (h) said stroke limiting means further comprising a slot formed partly in said frame structure, a hook portion forming part of each of said key members and movable with respect to said frame structure through said slot, and a portion of said resilient member, said portion of said resilient member being located close to each of said first and second panel portions of said frame structure and engageable with said portion of said resilient member for limiting the distance of rocking movement of said key member with respect to said frame structure.

* * * * *